US008329372B2

(12) United States Patent
Teshima et al.

(10) Patent No.: US 8,329,372 B2
(45) Date of Patent: Dec. 11, 2012

(54) LIQUID DEVELOPER, METHOD OF PREPARING LIQUID DEVELOPER, AND IMAGE FORMING APPARATUS

(75) Inventors: Takashi Teshima, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 1038 days.

(21) Appl. No.: 11/768,842

(22) Filed: Jun. 26, 2007

(65) Prior Publication Data

US 2008/0032225 A1 Feb. 7, 2008

(30) Foreign Application Priority Data

Jul. 14, 2006 (JP) ..... 2006-194910
Jul. 14, 2006 (JP) ..... 2006-194911
Feb. 26, 2007 (JP) ..... 2007-046263

(51) Int. Cl.
*G03G 9/00* (2006.01)

(52) U.S. Cl. ..... 430/115; 430/114

(58) Field of Classification Search ..... 430/114, 430/115; 399/237
See application file for complete search history.

(56) References Cited

U.S. PATENT DOCUMENTS 3,718,593 A 2/1973 Tamai
4,155,862 A 5/1979 Mohn et al.
4,197,211 A 4/1980 Amidon et al.
4,814,251 A 3/1989 Igoe
4,868,084 A 9/1989 Uchide et al.
4,886,726 A 12/1989 Chan et al.
5,143,811 A 9/1992 Itakura et al.
5,622,804 A 4/1997 Matsuoka et al.
5,723,250 A 3/1998 Matsuoka et al.
5,783,349 A 7/1998 Spiewak et al.
5,789,133 A 8/1998 Yabuuchi et al.
5,792,584 A 8/1998 Almog
5,843,613 A 12/1998 Fujiwara et al.
5,882,828 A 3/1999 Kato et al.
5,888,689 A * 3/1999 De Meutter et al. ..... 430/124.4
5,953,566 A 9/1999 Fujiwara et al.
5,958,643 A 9/1999 Fujiwara et al.
5,998,075 A 12/1999 Fujiwara et al.
6,146,804 A 11/2000 Miyamoto et al.
6,356,731 B1 3/2002 Shinjo
6,694,112 B2 2/2004 Sasaki et al.
6,777,154 B2 8/2004 Takahashi et al.
6,808,856 B2 10/2004 Fukuda et al.
6,876,822 B2 4/2005 Sasaki et al.
7,004,650 B2 2/2006 Sasaki et al.
7,049,040 B2 5/2006 Osan et al.
7,224,932 B2 5/2007 Omata
7,563,550 B2 7/2009 Akioka et al.
7,563,552 B2 7/2009 Kaiho et al.
7,566,520 B2 7/2009 Miura et al.
7,595,140 B2 * 9/2009 Akioka et al. ..... 430/116
7,608,376 B2 * 10/2009 Miura et al. ..... 430/115
7,670,732 B2 * 3/2010 Miura et al. ..... 430/45.2
7,723,005 B2 * 5/2010 Akioka et al. ..... 430/112
2002/0058731 A1 5/2002 Breton et al.
2002/0106220 A1 * 8/2002 Nakashima et al. ..... 399/237
2003/0186157 A1 10/2003 Teraoka et al.
2004/0241567 A1 12/2004 Teraoka et al.
2004/0259015 A1 12/2004 Tsubuko et al.
2004/0265756 A1 12/2004 Horie
2005/0003293 A1 1/2005 Takano et al.
2005/0078984 A1 4/2005 Fujita et al.
2005/0109240 A1 5/2005 Maeta et al.
2006/0099011 A1 * 5/2006 Kamijo et al. ..... 399/239
2006/0142425 A1 6/2006 Akioka et al.
2006/0188803 A1 8/2006 Yabuki et al.
2006/0204884 A1 * 9/2006 Teshima ..... 430/114
2006/0234150 A1 * 10/2006 Akioka et al. ..... 430/112
2007/0071501 A1 * 3/2007 Akioka ..... 399/237
2007/0128534 A1 6/2007 Miyakawa
2007/0141504 A1 6/2007 Miyakawa
2007/0184393 A1 8/2007 Miura et al.
2007/0202432 A1 * 8/2007 Akioka et al. ..... 430/115
2007/0258731 A1 11/2007 Miura et al.
2008/0038647 A1 2/2008 Teshima et al.
2008/0124645 A1 5/2008 Yamanaka et al.
2009/0214976 A1 8/2009 Teshima et al.

FOREIGN PATENT DOCUMENTS

JP 46008279 A 3/1971
JP 51040807 A 4/1976
JP 52004841 A 1/1977
JP 60076755 A 5/1985
JP 63301969 A 12/1988
JP 01113766 A 5/1989
JP 02081073 A 3/1990
JP 03119365 A 5/1991
JP 05061264 A 3/1993
JP 07092741 A 4/1995

(Continued)

OTHER PUBLICATIONS

Diamond, "Handbook of Imaging Materials" Marcel Dekker, Inc., New York, 1991, pp. 160-162.
http://www.chemexper.com/search/cas/1190632.html, published Mar. 13, 2009.
European search report dated Apr. 28, 2009 for corresponding European application 07012593.5.

*Primary Examiner* — Thorl Chea
(74) *Attorney, Agent, or Firm* — DLA Piper LLP (US)

(57) ABSTRACT

An liquid developer includes insulating liquid and toner particles dispersed in the insulating liquid. An average particle diameter of the toner particles based on volume is in the range of 0.7 to 3 μm, a width S of particle size distribution of the toner particles represented by the following formula (I) is 1.4 or less, and the insulating liquid include the unsaturated fatty acid glyceride:

$$S=[D(90)-D(10)]/D(50) \quad \text{(I)},$$

where D(X) represents the particle diameter at the point of X % in which X is the ratio of accumulated volume to the total volume when the volume is accumulated from the small particle diameter in the particle size distribution of the toner particles.

12 Claims, 9 Drawing Sheets

FOREIGN PATENT DOCUMENTS

| | | | |
|---|---|---|---|
| JP | 07092742 | A | 4/1995 |
| JP | 07-152256 | | 6/1995 |
| JP | 07325434 | A | 12/1995 |
| JP | 08036277 | A | 2/1996 |
| JP | 08160675 | A | 6/1996 |
| JP | 08220813 | A | 8/1996 |
| JP | 09304975 | A | 11/1997 |
| JP | 09311507 | A | 12/1997 |
| JP | 10333366 | A | 12/1998 |
| JP | 11160917 | A | 6/1999 |
| JP | 11212035 | A | 8/1999 |
| JP | 2000010357 | A | 1/2000 |
| JP | 2000019787 | A | 1/2000 |
| JP | 2000162829 | A | 6/2000 |
| JP | 2000162903 | A | 6/2000 |
| JP | 2001060046 | A | 3/2001 |
| JP | 2001098197 | A | 4/2001 |
| JP | 2001175034 | A | 6/2001 |
| JP | 2002014541 | A | 1/2002 |
| JP | 2002214849 | A | 7/2002 |
| JP | 2002251040 | A | 9/2002 |
| JP | 2002258542 | A | 9/2002 |
| JP | 2002365867 | A | 12/2002 |
| JP | 2003167456 | A | 6/2003 |
| JP | 2003345071 | A | 12/2003 |
| JP | 2004037954 | A | 2/2004 |
| JP | 2004205843 | A | 7/2004 |
| JP | 2004286859 | A | 10/2004 |
| JP | 2005017869 | A | 1/2005 |
| JP | 2005148356 | A | 6/2005 |
| JP | 2006195099 | A | 7/2006 |
| JP | 2006251253 | A | 9/2006 |
| JP | 2006317782 | A | 11/2006 |
| JP | 2007017583 | A | 1/2007 |
| JP | 2007017955 | A | 1/2007 |
| JP | 2007041027 | A | 2/2007 |
| JP | 2007041161 | A | 2/2007 |
| JP | 2007041163 | A | 2/2007 |
| JP | 2007212570 | A | 8/2007 |
| WO | 9603678 | A1 | 2/1996 |
| WO | 9829783 | A1 | 7/1998 |
| WO | 2006075656 | A1 | 7/2006 |

* cited by examiner

SHAPE FACTOR SF1

$$SF1 = \frac{(ML)^2}{A} \times \frac{\pi}{4} \times 100$$

SHAPE FACTOR SF2

$$SF2 = \frac{(CL)^2}{A} \times \frac{1}{4\pi} \times 100$$

LIQUID DEVELOPER, METHOD OF PREPARING LIQUID DEVELOPER, AND IMAGE FORMING APPARATUS

BACKGROUND

1. Technical Field

The entire disclosure of Japanese Patent Application Nos: 2006-194910, filed Jul. 14, 2006 and 2006-194911, filed Jul. 14, 2006 and 2007-46263, filed Feb. 26, 2007 are expressly incorporated by reference herein.

The present invention relates to a liquid developer, a method of preparing a liquid developer and an image forming apparatus using the same.

2. Related Art

For a developer used to develop electrostatic latent images formed on latent image carriers, there are available a method of using a dry toner, in which method a toner composed of a colorant such as pigment and the like and a material including a binding resin is used in a dry state; and a method of using a liquid developer in which a toner is dispersed in an electrically insulating carrier liquid (insulating liquid) (see, for example, JP-A-7-152256 (Patent Document 1)).

The method of using a dry toner involves dealing with a toner in the solid state, thus being advantageous in handling; however, the method has problems such as the concern about adverse effects of fine toner particles on human bodies, as well as contamination due to the scattering of toner particles, insufficient homogeneity in toner dispersion, and the like. Furthermore, a dry toner has such problems as that aggregation of particles is likely to occur, it is difficult to sufficiently reduce the size of toner particles, and it is difficult to form toner images with high resolution. Also, when the size of toner particles is made relatively small, the problems caused by fine toner particles as described above become even more significant.

Meanwhile, with regard to the method of using a liquid developer, since aggregation of toner particles in the liquid developer is effectively prevented, it is possible to use fine toner particles and use a binder resin having a low softening point (low softening temperature). As a result, the method of using a liquid developer has features, for example, good reproducibility of images with fine lines, good reproducibility of image tone, and an excellent reproducibility of colors. Furthermore, the method has an excellent feature that image formation is achieved at high speeds. One example of such a method for using the liquid developer is disclosed in Patent Document 1.

When the toner particles used in the liquid developer has a small particle size distribution, the toner images fixed on a recording medium are deemed to have excellent resolution and density properties. Moreover, the toner images thus obtained become less defective and more precise. Additionally, when the liquid developer in a developer vessel is supplied to a coating roller developer vessel, because the toner particles are uniform, a lot of voids are generated between the toner particles and a large quantity of insulating liquid exists between the toner particles. Thus, it is possible to efficiently develop and transfer the toner images. However, the large quantity of the insulating liquid between the toner particles present in the process of the development and transferring operations may remain adhering onto the surfaces of the toner particles upon fixation. Generally, when an image is formed using a known non-volatile mineral oil-based insulating liquid such as hydrocarbon-based or silicone-based insulating liquids, the insulating liquid adhering onto the surfaces of the toner particles may prevent the contact and aggregation of the toner particles upon fixation. For this reason, there was a problem that the toner images are likely to deteriorate by air, light, friction or the like when they are stored for a long period.

Meanwhile, when using the toner particles having a large particle size distribution, it is possible to prevent a decrease in the intensity of fixation. The toner particles having the large particle size distribution include a lot of fine toner particles having a size smaller than an average particle diameter. Accordingly, when the toner particles having the large particle size distribution are used in the liquid developer, the finer toner particles enter into the voids between the larger toner particles in the toner images on the recording medium, and thus the gaps between the toner particles become small. Therefore, only a small amount of the insulating liquid adheres onto the toner particles. As a result, since the amount of the insulating liquid adhering onto the toner particles on the recording medium becomes small, the contact and aggregation of the toner particles can be properly carried out upon fixation. For this reason, the toner images are not likely to deteriorate by air, light, friction or the like when they are stored for a long period. However, since only a small amount of the insulating liquid adheres onto the toner particles even in the process of the developing and transferring operations, there was a problem that the operations of developing and transferring the toner images are not properly carried out. Accordingly, it is difficult to form non-defective and high-resolution toner images on the recording medium.

SUMMARY

It is an advantage of some aspects of the invention to provide a liquid developer, a method of preparing the liquid developer, and an image forming apparatus using the liquid developer, capable of forming a non-defective and high-resolution toner image while maintaining an excellent long-term storage property when fixed onto a recording medium.

The aforementioned advantages can be achieved by some aspects of the invention as described below.

According to a first aspect of the invention, there is provided a liquid developer including insulating liquid; and toner particles dispersed in the insulating liquid, in which an average particle diameter of the toner particles based on volume is in the range of 0.7 to 3 μm, and in which a width S of particle size distribution of the toner particles represented by the following formula (I) is 1.4 or less, and the insulating liquid includes a unsaturated fatty acid glyceride:

$$S=[D(90)-D(10)]/D(50) \quad \text{(I)},$$

where D(X) represents the particle diameter at the point of X % in which X is the ratio of accumulated volume to the total volume when the volume is accumulated from the small particle diameter in the particle size distribution of the toner particles.

In the above-mentioned aspect of the invention, a shape factor SF1 of the toner particles represented by the following formula (II) may be in the range of 100 to 130, and a shape factor SF2 of the toner particles represented by the following formula (III) may be in the range of 110 to 150:

$$SF1=\{(ML)^2/A\}\times(100\pi/4) \quad \text{(II); and}$$

$$SF2=\{(CL)^2/A\}\times(100/4\pi) \quad \text{(III)},$$

where A [$\mu m^2$] is an area of a figure generated when the toner particles are projected onto a two-dimensional plane, and ML [μm] and CL [μm] are the maximum length and the circumferential length of the figure, respectively.

In the above-mentioned aspect of the invention, an iodine value of the insulating liquid may be in the range of 100 to 200.

In the above-mentioned aspect of the invention, a viscosity of the insulating liquid may be in the range of 5 to 1000 mPa·s.

In the above-mentioned aspect of the invention, the unsaturated fatty acid glyceride may include linoleic acid as an unsaturated fatty acid component.

In the above-mentioned aspect of the invention, the content ratio of the linoleic acid to the total fatty acid components of the unsaturated fatty acid glyceride may be 15 mol % or more.

In the above-mentioned aspect of the invention, the insulating liquid may include a fatty acid monoester containing an ester bond between monovalent alcohol and fatty acid.

In the above-mentioned aspect of the invention, the content ratio of the fatty acid monoester in the insulating liquid may be in the range of 5 to 55 wt %.

In the above-mentioned aspect of the invention, when the content ratio of the unsaturated fatty acid glyceride in the insulating liquid is referred to as A [wt %], and the content ratio of the fatty acid monoester is referred to as B [wt %] the relationship of $0.6 \leqq A/B \leqq 8.0$ may be satisfied.

In the above-mentioned aspect of the invention, the fatty acid monoester may include unsaturated fatty acid as a fatty acid component.

In the above-mentioned aspect of the invention, the fatty acid monoester may be maldistributed in the vicinity of surfaces of the toner particles.

In the above-mentioned aspect of the invention, a resin material constituting the toner particles may be a polyester resin.

According to a second aspect of the invention, there is provided a method of preparing a liquid developer, the method including obtaining associated particles by allowing microparticles mainly composed of a resin material to associate; obtaining toner particles by disintegrating the associated particles using a small amount of an insulating liquid; and dispersing the toner particles in a liquid containing a unsaturated fatty acid glyceride, in which the liquid developer thus obtained includes the insulating liquid and the toner particles dispersed in the insulating liquid, an average particle diameter of the toner particles based on volume is in the range of 0.7 to 3 μm, a width S of particle size distribution of the toner particles represented by the following formula (I) is 1.4 or less, and the insulating liquid includes the unsaturated fatty acid glyceride:

$$S=[D(90)-D(10)]/D(50) \quad \text{(I)},$$

where D(X) represents the particle diameter at the point of X % in which X is the ratio of accumulated volume to the total volume when the volume is accumulated from the small particle diameter in the particle size distribution of the toner particles.

According to a third aspect of the invention, there is provided an image forming apparatus having a fixing unit that fixes a toner image formed by a liquid developer onto a recording medium having the toner image adhering thereon by means of heat and pressure, in which the liquid developer includes an insulating liquid and toner particles dispersed in the insulating liquid, an average particle diameter of the toner particles based on volume is in the range of 0.7 to 3 μm, a width S of particle size distribution of the toner particles represented by the following formula (I) is 1.4 or less, and the insulating liquid includes the unsaturated fatty acid glyceride:

$$S=[D(90)-D(10)]/D(50) \quad \text{(I)},$$

where D(X) represents the particle diameter at the point of X % in which X is the ratio of accumulated volume to the total volume when the volume is accumulated from the small particle diameter in the particle size distribution of the toner particles.

In the above-mentioned aspect of the invention, the image forming apparatus may further include a liquid developer storage section that stores a plurality of liquid developers of different colors therein; a plurality of developing sections that form a unicolored image corresponding to each color using the plurality of liquid developers of different colors supplied from the liquid developer storage section, respectively; an intermediate transferring section in which an intermediate transfer image is formed by sequentially transferring a plurality of unicolored images formed in the plurality of developing sections and superposing the plurality of unicolored images; and a secondary transferring section that transfers the intermediate transfer image to the recording medium and thus forms the toner image on the recording medium.

In the above-mentioned aspect of the invention, the developing section may at least include a developing roller for forming a layer of the liquid developer on the surface thereof; a photosensitive member for developing the liquid developers on the developing roller so as to form the unicolored image; and a coating roller for supplying the liquid developers to the developing roller, and in which the coating roller is an anilox roller having grooves on the surface thereof, and supplies the liquid developers to the developing roller while carrying the liquid developers in the grooves.

In the above-mentioned aspect of the invention, the image forming apparatus may further include an ultraviolet irradiator for irradiating ultraviolet beams onto the toner image when fixing the toner particles onto the recording medium.

With such a configuration, it is possible to provide a liquid developer, a method of preparing the liquid developer, and an image forming apparatus using the liquid developer, capable of forming a non-defective and high-resolution toner image while maintaining an excellent long-term storage property when fixed onto a recording medium.

BRIEF DESCRIPTION OF THE DRAWINGS

The invention will be described with reference to the accompanying drawings, in which like numbers reference like elements.

DESCRIPTION OF EXEMPLARY EMBODIMENTS

Figure 1A:
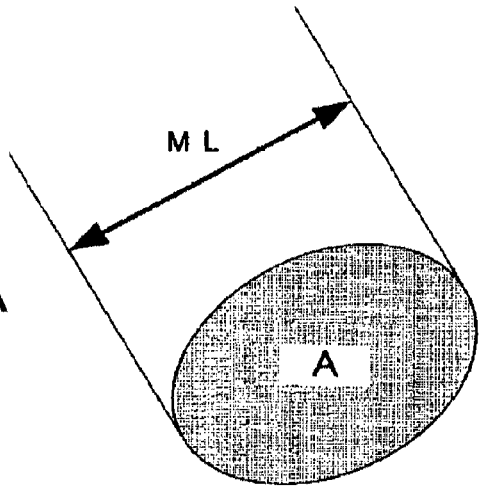
FIGS. 1A and 1B are diagrams for explaining a method of obtaining shape factors SF1 and SF2.

Hereinafter, exemplary embodiments of the invention will be described in detail.

Liquid Developer

First, a liquid developer of an embodiment of the invention will be described. The liquid developer of the embodiment of the invention is one in which toner particles are dispersed in an insulating liquid.

Insulating Liquid

Next, the insulating liquid will be described. According to an embodiment of the invention, the insulating liquid contains an unsaturated fatty acid glyceride. The unsaturated fatty acid glyceride is an ester (glyceride) of a fatty acid and a glycerin, and contains an unsaturated fatty acid as a fatty acid component.

The unsaturated fatty acid glyceride is a component capable of contributing to the improvement of an excellent long-term storage property of resulting toner images. Hereinafter, it will be described in detail. The unsaturated fatty acid component is a component capable of curing by itself by being oxidized. For this reason, when the toner images are formed and fixed onto the recording medium using the liquid developer containing the unsaturated fatty acid glyceride, the unsaturated fatty acid glyceride remaining together with the toner particles in the toner images can be oxidized and polymerized by oxygen in the air. Accordingly, the toner particles can firmly adhere to each other and to the recording medium. Additionally, since the unsaturated fatty acid glyceride covers the surface of the toner images while undergoing the oxidative polymerization, it is possible to form the cured unsaturated fatty acid glyceride as a protective film on the surface of the toner images. As mentioned above, since the toner images exhibit less deterioration under the air, light, or physical external forces such as friction for a long period, it is possible to obtain toner images having an excellent storage property.

In addition, since a small amount of the unsaturated fatty acid glyceride is oxidized at the fixation temperature of the fixation process, it is possible to improve the fixation intensity of the toner particles. Additionally, the unsaturated fatty acid glyceride has an effect (plasticizing effect) of plasticizing a resin component included in the toner particles during the fixing process. When the toner particles are fixed onto the recording medium by means of heat and pressure, the toner particles are effectively plasticized by the unsaturated fatty acid glyceride in the vicinity of the surface thereof. For this reason, when the image is formed using multi-colored toner particles, the plasticized toner particles can come into contact, melt and firmly bind to adjacent toner particles having different colors. As a result, in the area in which the toner particles having different colors are bound to each other, the colors of the toner particles are mixed with each other to make an intermediate color. Accordingly, it is possible to more assuredly obtain the image having a desired color tone. Additionally, since the toner particles are plasticized in the process of fixation, the surface of the toner images becomes smooth, and thus it is possible to obtain an excellent surface gloss. Since the unsaturated fatty acid glyceride is an environmentally friendly component, it is possible to reduce the environmental stress posed by the insulating liquid through the leakage of the insulating liquid to the outside of an image forming device, disposal of a used liquid developer, or the like. Consequently, an environmentally friendly liquid developer can be provided.

The unsaturated fatty acid of the glyceride is not particularly limited, but examples thereof include a monovalent unsaturated fatty acid such as crotonic acid, myristoleic acid, palmitoleic acid, oleic acid, elaidic acid, vaccenic acid, gadoleic acid, erucic acid, or nervonic acid; a multivalent unsaturated fatty acid such as linoleic acid, α-linolenic acid, γ-linolenic acid, arachidonic acid, eleostearic acid, stearidonic acid, arachidonic acid, clupanodonic acid, docosahexaenoic acid (DHA), or eicosapentaenoic acid (EPA); and derivatives thereof. Among these, one or a combination of two or more species can be used.

Among those described above, when a linoleic acid is used as the unsaturated fatty acid, the resulting toner images can have a particularly excellent long-term storage property. Additionally, the fixation intensity of the toner particles to the recording medium can be made particularly excellent. Since the linoleic acid has high affinity for the toner particles and rarely prevents the melting of the toner particles in the process of fixation, it is possible to easily obtain the image having a desired color tone. Moreover, since the linoleic acid has high affinity for the toner particles, the toner particles can stably disperse in the liquid developer, and thus it is possible to obtain a liquid developer having an excellent storage property.

Additionally, for example, a conjugated linoleic acid having a conjugated double bond can be configured to be used as linoleic acid component. Thanks to this, the resulting toner images can have a particularly excellent long-term storage property. Additionally, the fixation intensity of the toner particles on the recording medium can be configured to be excellent.

The content ratio of the linoleic acid to the total fatty acid component in the unsaturated fatty acid glyceride is not particularly limited, but the ratio is preferably not less than 15 mol %, further preferably not less than 25 mol %, and even more preferably not less than 45 mol %. To the contrast, when the content of the linoleic acid is less than the lower limit of the above range, the fixation intensity of the toner particles on the recording medium may decrease. Accordingly, there is the case that the toner particles are likely not to stably disperse, and the storage property of the liquid developer is likely to decrease.

Such unsaturated fatty acid glyceride can be efficiently obtained from, for example, naturally-occurring oils and fats, including plant-derived oils and fats, such as safflower oil, rice oil, rice bran oil, rapeseed oil, olive oil, canola oil, soybean oil, linseed oil, or castor oil; animal-derived oils and fats, such as cattle oil; and the like.

According to the embodiment of the invention, the content of unsaturated fatty acid glyceride in the insulating liquid is preferably in the range of 20 to 90 wt %, further preferably in the range of 30 to 80 wt %, further more preferably in the range of 40 to 70 wt %. When the content of unsaturated fatty acid glyceride in the insulating liquid exists in the allowable ranges, unsaturated fatty acid glyceride remaining in the formed toner images satisfies suitable quantity thereof, and the aforementioned overcoat is suitably formed on the surface of the resulting toner image. Therefore, the resulting toner images can have an excellent long-term storage property.

Additionally the toner-particle plasticization caused by oxidative polymerization reaction of the unsaturated fatty acid component and unsaturated fatty acid glyceride is initiated with balance in the process of fixation. As a result, the fixation intensity of the toner images on the recording medium can be configured to be excellent, and thus it becomes easier to obtain the image having the targeted color tone. In this case, when content of unsaturated fatty acid glyceride is less than the lower limit of the above range, it is hard to initiate the oxidative polymerization reaction of the unsaturated fatty acid, and thus the fixation intensity of the toner images on the recording medium is likely to decrease. On the contrary, when the content of unsaturated fatty acid glyceride is more than the upper limit in the process of fixation, the oxidative polymerization reaction, which is more than required, of the unsaturated fatty acid is initiated. Accordingly, depending on kinds of the unsaturated fatty acid components, since solidification occurs around the toner particles, between the toner particles do not melt in the process of fixing the toner particles on the recording medium, and thus it is occasionally hard to obtain the image having a desired color tone.

Additionally, the saturated fatty acid component may be included in unsaturated fatty acid glyceride. By including the saturated fatty acid component, it is possible to maintain further excellent chemical stability and electrical insulation property of the insulating liquid.

Examples of such a saturated fatty acid composing a saturated fatty acid component include butyric acid (C4), caproic acid (C6), caprylic acid (C8), capric acid (C10), lauric acid (C12), myristic acid (C14), palmitic acid (C16), stearic acid (C18), arachic acid (C20), behenic acid (C22), and lignoceric acid (C24). Among these, one or a combination of two or more species can be used. In these saturated fatty acids, the number of carbon atoms is preferably in the range of 6 to 22, further preferably in the range of 8 to 20, further more preferably in the range of 10 to 18. By including the saturated fatty acid component composed of these saturated fatty acids, the aforementioned effect becomes stronger.

As for liquid developer, it is desirable that the insulating liquid additionally includes a fatty acid monoester in addition to unsaturated fatty acid glyceride. With such a configuration, the toner particles are strongly fixed on the recording medium.

Hereinafter, the fatty acid monoester will be described. The fatty acid monoester is an ester of a fatty acid and a monovalent alcohol.

Since the fatty acid monoester is a component that can easily penetrate into the recording medium, the fatty acid monoester adhering to the vicinity of toner particle surface rapidly penetrates into the recording medium when the toner particles are contact with the recording medium in the process of fixation. Accompanied with this penetration of the fatty acid monoester, a part (resin material forming the toner particles) of toner particles melted by heat upon fixation penetrates into the recording medium, and the anchor effect acts thereon, thereby causing the fixation intensity to particularly improve. Additionally, accompanied with this penetration of the fatty acid monoester, a moiety of unsaturated fatty acid glyceride which exists on the vicinity of the toner particle surface also penetrate therein, and the oxidative polymerization is initiated in this state, thereby causing the toner particles to be more strongly fixed. The fatty acid monoester also has the same plasticizing effect as unsaturated fatty acid glyceride. Since the fatty acid monoester has lower molecular weight than unsaturated fatty acid glyceride, it is easy to penetrate among the toner particles, and the plasticizing effect is better. For this reason, when the fatty acid monoester exists in the insulating liquid, the toner particles melt to each other in the process of fixation, it is possible to more surely obtain the targeted color tone of the image. In addition, since the fatty acid monoester has comparatively low viscosity, it is possible to easily produce the toner particles having desired particle diameter and particle size distribution by using a method of preparing the liquid developer to be described later. Additionally, since the fatty acid monoester is an environmentally friendly component, it is possible to reduce the environmental stress posed by the insulating liquid through the leakage of the insulating liquid to the outside of an image forming device, disposal of a used liquid developer, or the like. Consequently, an environmentally friendly liquid developer can be provided.

Preferably, the aforementioned fatty acid monoester is maldistributed on the toner particle surface. Since the fatty acid monoester has high affinity for unsaturated fatty acid glyceride, it is possible to improve dispersibility of the toner particles by using the toner particles making the fatty acid monoester to be maldistributed on the vicinity of the surface thereof. As a result, precipitation, aggregation and the like of the toner particles can be more effectively prevented during storage. Consequently, the liquid developer can have an excellent storage property. In addition, the fatty acid monoester is maldistributed on the toner particle surface, and thus the plasticization of the toner particles is likely to be easily initiated in the process of fixation.

The fatty acid monoester may be not only maldistributed on the toner particle surface, but also included in inside toner particle and in the insulating liquid. In the case where the fatty acid monoester is included in inside the toner particles, the fatty acid monoester can begin to leak outside at the same time when the toner particles are plasticized or crashed in the process of fixation, and thus it is possible to more effectively promote the penetration of the melted toner particles into the recording medium.

Additionally, interfacial tension of the fatty acid monoester to the resin material (the resin material forming the toner) to be described later is preferably not more than 35 mN/m and further preferably not more than 32 mN/m. Accordingly, the fatty acid monoester can be surely maldistributed on the vicinity of the toner particle surface, and thus the toner particles can be more strongly fixed on the recording medium.

In addition, viscosity of the fatty acid monoester is preferably not more than 10 mPa·s and further preferably not more than 5 mPa·s. With such a configuration, accompanied with suitable penetration into the recording medium, it is possible to more surely promote that the toner particles melted by heat upon fixation and unsaturated fatty acid glyceride can penetrate into the recording medium. For example, when the liquid developer is prepared in the same manner as described later, it is possible to suitably obtain the toner particles having a uniform particle diameter. Here, the term viscosity as used in the present specification refers to the value measured at 25° C.

The content of the fatty acid monoester in the insulating liquid is preferably in the range of 5 to 55 wt %, further preferably in the range of 10 to 50 wt %, and further more preferably in the range of 20 to 50 wt %. When the content of the fatty acid monoester is in these allowable ranges, the fatty acid monoester is easy to adhere to the toner particles, the insulating liquid can penetrate into the recording medium, and thus it is possible to obtain particularly excellent fixing intensity. Since the fatty acid monoester suitable to the plasticization of the toner particles upon fixation adheres to the toner particle surface, it is possible to more surely obtain an image having particularly excellent gloss and a desired color tone, as a result of plasticizing and melting toner particles.

In this case, when the content of the fatty acid monoester is less than the lower limit of the above range, even though the fatty acid ester adds to the insulating liquid, there is a case where the effects of penetrating the recording medium and plasticizing the toner particles can not be sufficiently obtained. As compared therewith, when the content of the fatty acid monoester is more than the upper limit, the viscosity of the insulating liquid becomes small, and a small amount of the insulating liquid penetrates into the toner particles of the image formed on the recording medium, thereby hardly obtaining a sufficient fixing intensity. In addition, the fatty acid monoester penetrates into the toner particles even during storage and plasticizes the toner particles, thereby deteriorating the storage property of the toner particles.

The fatty acid monoester that can be used for the liquid developer of the embodiment of the invention is not particularly limited, but examples thereof include alkyl (methyl, ethyl, propyl, butyl and the like) monoesters of the unsaturated fatty acid such as oleic acid, palmitoleic acid, linoleic acid, α-linolenic acid, γ-linolenic acid, arachidonic acid, docosahexaenoic acid (DHA) or eicosapentaenoic acid (EPA); and alkyl (methyl, ethyl, propyl, butyl and the like) monoesters of the saturated fatty acid such as butyric acid, caproic acid, caprylic acid, capric acid, lauric acid, myristic acid, palmitic acid, stearic acid, arachic acid, behenic acid, or lignoceric acid. Among these, one or a combination of two or more species can be used.

Preferably, an unsaturated fatty acid monoester of which the fatty acid component has the unsaturated fatty acid is used as the fatty acid monoester. The unsaturated fatty acid component is a component that can contribute to improve fixing the toner particles on the recording medium. More clearly, the unsaturated fatty acid monoester initiate the oxidative polymerization upon fixation, and thus it is possible to particularly improve the fixation intensity between the toner particles and recording medium by curing it self. With such a configuration, since not only unsaturated fatty acid glyceride which penetrate into the recording medium but also the unsaturated fatty acid monoester can contribute to the oxidative polymerization, the aforementioned anchor effect becomes more effective, and thus it is possible to obtain especially excellent fixing intensity.

The content of the unsaturated fatty acid component in the total fatty acid component in the fatty acid monoester is preferably not less than 50 wt %, more preferably not less than 60 wt %. With such a configuration, since the aforementioned effect becomes more effective, it is possible to obtain particularly strong fixing intensity.

Preferably, the unsaturated fatty acid is configured as a main fatty acid component of the fatty acid monoester, but it is also allowed that the saturated fatty acid can be contained in a part of main fatty acid component. With such a configuration, the storage property and long-term stability of the insulating liquid can be made more excellent.

Even though the fatty acid monoester is an ester between a fatty acid and a monovalent alcohol, this alcohol is preferably an alkylalcohol having 1 to 4 carbon atoms. Then, the chemical stability of the liquid developer becomes excellent, and the storage property and long-term stability of the liquid developer become more excellent. Furthermore, such alcohol also adjusts the viscosity of the insulating liquid appropriate, so that the penetration of the liquid developer into the recording medium can be rendered more favorable. Examples of such alcohol include methanol, ethanol, propanol, butanol, isobutanol, and the like.

Preferably, the fatty acid monoester composing the insulating liquid is formed by the transesterification reaction between the fatty acid glyceride and the mono alcohol having 1 to 4 carbon atoms. With such a configuration, since affinity between the fatty acid monoester and the fatty acid glyceride further increases, the viscosity of the insulating liquid becomes more suitable to use, and thus the penetration of the liquid developer into the recording medium becomes more excellent. Accordingly, the fixation intensity of the toner particles on the recording medium becomes excellent, and the liquid developer can be suitably applied to the image forming at high speed.

When the content of the unsaturated fatty acid glyceride in the insulating liquid is referred to as A [wt %], and the content of the fatty acid monoester is referred to as B [wt %], it is preferable that the relationship of $0.6 \leqq A/B \leqq 8.0$ is satisfied; it is more preferable that the relationship of $1.1 \leqq A/B \leqq 6.0$ is satisfied; and it is even more preferable that the relationship of $1.1 \leqq A/B \leqq 3.0$ is satisfied. When such relationships are satisfied, the storage property of the liquid developer can be made more excellent, thereby it being possible to more firmly fix the toner particles to the recording medium.

Additionally, in the liquid developer of the embodiment of the invention, the fatty acid monoester is included in the insulating liquid. When the fatty acid monoester exists in the insulating liquid, the plasticizing effect caused by the fatty acid monoester on the toner particles is comparatively small, and high stability of the toner particles can maintain in storage. However, when the fatty acid monoester is included as a component material of the toner particles, the toner particles are easily plasticized by the plasticizing effect of the fatty acid monoester, and thus deteriorating the storage stability of the toner particles.

Additionally, the insulating liquid may be configured to include components other than the aforementioned components. Examples thereof include mineral oils such as Isopar E, Isopar G, Isopar H, Isopar L (EXXON Mobile Corp.), Shellsol 70, Shellsol 71 (Shell Oil Company, Ltd.), Amsco OMS, Amsco 460 solvent (American Mineral Spirits Company, Ltd.), or low-viscosity/high-viscosity liquid paraffins (Waco Pure Chemical Industries, Ltd.); decomposition products of fatty acid glyceride such as saturated fatty acids of glyceride, glycerin, or fatty acid; octane, isooctane, decane, isodecane, decalin, nonane, dodecane, isododecane, cyclohexan, cyclooctane, cyclodecane, benzene, toluene, xylene, mesitylene and the like. Among these, one or a combination of two or more species can be used.

The liquid developer (the insulating liquid) may include an antioxidant having a function of preventing and minimizing the oxidation of the unsaturated fatty acid component. With such a configuration, it is possible to prevent unwilling oxidation of the unsaturated fatty acid component in the liquid developer. As a result, it is possible to prevent deterioration of the liquid developer (the insulating liquid), and thus it is possible to maintain excellent dispersibility of the toner particles and excellent fixation intensity of the toner particles on the recording medium for prolonged period. Namely, the long-term stability (the storage stability) of the liquid developer can be made more excellent.

Examples of such antioxidant as described above include vitamin E such as tocopherol, d-tocopherol, dl-α-tocopherol, acetic acid -α-tocopherol, acetic acid dl-α-tocopherol, acetic acid tocopherol, or α-tocopherol; vitamin C such as dibutylhydroxytoluene, butylhydroxyanisol, ascorbic acid, ascorbic acid salts, or ascorbate stearate esters; green tea extract, coffee extract, sesamol, sesaminol and the like. Among these, one or a combination of two or more species can be used.

Among those described above, when vitamin E is used, the following effects are obtained. That is, since vitamin E is an environmentally friendly component, and also the oxidation products thereof have less influence on the liquid developer, the liquid developer can be made more environmentally friendly. Also, since vitamin E is highly dispersible in a liquid (especially glycerin) containing the above-described unsaturated fatty acid component and saturated fatty acid component, it can be favorably used as an antioxidant. When vitamin E is used in combination with the above-described glycerides, the affinity of the insulating liquid for toner particles can be further improved. As a result, the storage property of the liquid developer, the fixation intensity of the toner particles to recording media, and the like can become particularly excellent.

Among those described above, when vitamin C is used, the following effects can be obtained. That is, in a manner similar to that of vitamin E described above, vitamin C is an environmentally friendly component, and the oxidation products thereof have less influence on the liquid developer, thus it being able to make the liquid developer more environmentally friendly. In addition, since vitamin C has a relatively low thermal decomposition temperature, during storage and the like of the liquid developer (including the idling time of image forming devices), vitamin C can sufficiently manifest the function as an antioxidant, while upon fixation, can promote the oxidative polymerization reaction of unsaturated fatty acid components by deteriorating the function as an antioxidant.

The thermal decomposition temperature of the antioxidant is preferably lower than or equal to the fixation temperature during the fixing process. Then, during the storage of the liquid developer or the like, deterioration of the insulating liquid can be effectively prevented, while during fixation, the antioxidant in the insulating liquid adhered on the surface of toner particles can be thermally decomposed to effectively cure the unsaturated fatty acid components (oxidative polymerization), thus sufficiently excellent fixation intensity of the toner particles to recording media being obtained.

Specifically, the thermal decomposition temperature of the antioxidant is preferably 200° C. or lower, and more preferably 180° C. or lower. Then, the fixation intensity of toner particles can be more effectively improved while sufficiently maintaining the function as an antioxidant.

The content of the antioxidant in the insulating liquid is preferably 0.01 to 15 parts by weight, more preferably 0.1 to 7 parts by weight, and even more preferably 1 to 7 parts by weight, relative to 100 parts by weight of the insulating liquid. Then, the deterioration of the unsaturated fatty acid components due to oxidation can be more assuredly prevented upon storage or the like of the liquid developer, and when necessary (upon fixation), curing of the unsaturated fatty acid components (oxidative polymerization reaction) can be efficiently implemented.

The liquid developer may also contain an oxidative polymerization accelerator (curing accelerator) which accelerates the oxidative polymerization reaction (curing reaction) of the unsaturated fatty acid components contained in the above-described fatty acid monoesters and fatty acid triglycerides. Then, when necessary (upon fixation), the unsaturated fatty acid components can be effectively oxidatively polymerized (cured). Consequently, the fixation intensity of the toner particles to recording media can be made particularly excellent.

When the liquid developer contains the oxidative polymerization accelerator, the oxidative polymerization accelerator is not particularly limited, but those which do not substantially contribute to the oxidative polymerization reaction of the unsaturated fatty acid components during storage or the like (including the idling time of image forming devices and the like), but contribute to the oxidation polymerization (curing) reaction of the unsaturated fatty acid components when necessary (upon fixation), are preferred. Then, a liquid developer having an excellent storage property (long-term stability) can be obtained, and a particularly excellent fixation intensity of the toner particles to recording media can be attained.

For such oxidative polymerization accelerator, for example, a material which has a function of accelerating the oxidative polymerization reaction (curing reaction) of the unsaturated fatty acid component under heating conditions, and does not have a function of substantially accelerating the oxidative polymerization reaction (curing reaction) of the unsaturated fatty acid component near room temperature, that is, a material having relatively high activation energy in the oxidative polymerization reaction (curing reaction) of the unsaturated fatty acid component.

Examples of such material (oxidative polymerization accelerator) include various fatty acid metal salts and the like, and among them, one or a combination of two or more species can be used. When such material (oxidative polymerization accelerator) is used, the oxidative polymerization of the unsaturated fatty acid component can be effectively performed upon fixation, while maintaining the stability of the liquid developer during storage or the like. In particular, since fatty acid metal salts can accelerate the oxidative polymerization reaction of the unsaturated fatty acid component by supplying oxygen during fixation, the salts can effectively accelerate the oxidative polymerization reaction during heating upon fixation or the like. Accordingly, while more certainly preventing the occurrence of the oxidative polymerization reaction during storage or the like, the oxidative polymerization reaction can be more effectively accelerated during fixation or the like. Furthermore, since fatty acid metal salts have high dispensability in the liquid (especially glycerin) containing the above-described unsaturated fatty acid component and saturated fatty acid component, the salts can be uniformly dispersed in the insulating liquid, and as a result, the oxidative polymerization reaction can be integrally and efficiently carried out upon fixation.

Examples of such fatty acid metal salt include resin acid metal salts (for example, cobalt salts, manganese salts, lead salts, etc.), linolenic acid metal salts (for example, cobalt salts, manganese salts, lead salts, etc.), octylic acid metal salts (for example, cobalt salts, manganese salts, lead salts, zinc salts, calcium salts, etc.), naphthenic acid metal salts (for example, zinc salts, calcium salts, etc.), and the like, and among these, one or a combination of two or more species can be used.

The oxidative polymerization accelerator may be contained in the insulating liquid in an encapsulated state. Then, in a manner similar to the above, the oxidative polymerization accelerator can be made to substantially not contribute to the oxidative polymerization reaction of the unsaturated fatty acid component during storage or the like (including the idling time of image forming devices, and the like), but to contribute to the oxidative polymerization (curing) reaction of the unsaturated fatty acid component when necessary. That is, the oxidative polymerization reaction can be more assuredly prevented during the storage or the like of the liquid developer; but during fixation, the encapsulation is disintegrated by the pressure of fixation or the like, and the oxidative polymerization accelerator comes into contact with the unsaturated fatty acid component to assuredly allow the oxidative polymerization reaction of the unsaturated component to proceed. With such constitution, there is available a wide range of selection for the material of the oxidative polymerization accelerator. In other words, even an oxidative polymerization accelerator with high reactivity (an oxidative polymerization accelerator contributing to the oxidative polymerization reaction of the unsaturated fatty acid component at a relatively low temperature) can be favorably used, and the fixation intensity of toner particles onto a recording medium can be made particularly excellent.

The content of the oxidative polymerization accelerator in the insulating liquid is preferably 0.01 to 15 parts by weight, more preferably 0.05 to 7 parts by weight, and even more preferably 0.1 to 5 parts by weight, relative to 100 parts by weight of the insulating liquid. Then, the oxidative polymerization reaction of the unsaturated fatty acid component upon fixation can be more certainly performed, while sufficiently preventing the oxidative polymerization reaction during the storage or the like of the liquid developer.

An iodine value of the insulating liquid is preferably in the range of 100 to 200, more preferably in the range of 100 to 180, further more preferably in the range of 110 to 170. With such a configuration, the toner particles may be excellently fixed on the recording medium, and the image having a desired color tone can be easily obtained. In this case, when the iodine value of the insulating liquid is less than the lower limit of the above range, it is hard to initiate the oxidative polymerization reaction of the unsaturated fatty acid, and thus the fixation intensity of the toner particles on the recording medium may occasionally decrease. Conversely, when the iodine value of the insulating liquid is more than the upper limit of the above range, solidification occurs around the toner particles by unwilling overreaction of the oxidative polymerization, and thus there is a case where the toner particles do not melt to each other in the process of fixing the toner particles on the recording medium and the image having a desired color tone is hard to be obtained.

The viscosity of the insulating liquid is not particularly limited, but the viscosity is preferably in the range of 5 to 1000 mPa·s, more preferably in the range of 50 to 800 mPa·s, and even more preferably in the range of 100 to 500 mPa·s. When the viscosity of the insulating liquid is in these ranges, in the case where the coating roller is immersed in the liquid developer in the developer vessel, optimum dose of the insulating liquid adheres to the toner particles, and thus the toner images has excellent developability and transferability. Since an appropriate amount of the insulating liquid adheres to the toner particles adhering onto the recording medium, the toner images to be formed can have a particularly excellent fixing intensity. Additionally, since the toner particles easily melt to each other by the plasticization of the toner particles upon fixation, the image having a desired color tone can be very easily obtained. In addition, the dispersibility of the toner particles can be configured to be excellent, and in the image forming apparatus to be described later, the liquid developer can be uniformly supplied to a coating roller, and dripping the liquid developer from the coating roller can be effectively prevented. Additionally, since aggregation and precipitation of the toner particles can be prevented, the toner particles can have excellent dispersibility in the insulating liquid.

In this case, when viscosity of the insulating liquid is less than the lower limit of the above range, in the case where the coating roller is immersed in the liquid developer in the developer vessel, the insulating liquid adhering to the toner particles becomes small, and thus the toner images may not have excellent transferability and developability. Since an amount of the insulating liquid adhering to the toner particles which exists on the recording medium is small, upon fixation, it is not enough to initiate the oxidative polymerization reaction of the insulating liquid, and it becomes hard to obtain sufficient fixing intensity. Additionally, in the image forming apparatus to be described later, there is a possibility to cause problems such as dripping the liquid developer from the coating roller and the like. Conversely, when viscosity of the insulating liquid is more than the upper limit of the above range, since a large quantity of the insulating liquid adheres to the toner particles on the recording medium, there are cases where the toner particles do not melt to each other and the image having a desired color tone is hard to obtain. Additionally, there are also cases that the dispersibility of the toner particles can not be sufficiently made more excellent, and the liquid developer can not be uniformly supplied to the coating roller in the image forming apparatus to be described later. Here, the term viscosity as used in the present specification refers to the value measured at 25° C.

The electrical resistance of the above-described insulating liquid at room temperature (20° C.) is preferably $1\times10^{9}$ Ωcm or greater, more preferably $1\times10^{11}$ Ωcm, and even more preferably $1\times10^{13}$ Ωcm.

The dielectric constant of the insulating liquid is preferably 3.5 or less.

Toner Particles

Hereinafter the toner particles will be described.

Compositional Materials of Toner Particles

The toner particles (toner) which constitute the liquid developer according to the embodiment of the invention contain at least a binding resin (resin material) and a colorant.

1. Resin Material

The toner particles which constitute the liquid developer are composed of a material including a resin material as the main component.

According to an embodiment of the invention, the resin (binder resin) is not particularly limited so long as the resin has properties as described above, and examples thereof include styrene-based resins, including homopolymers or copolymers containing styrene or styrene substituents, such as polystyrene, poly-α-methylstyrene, chloropolystyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylic acid ester copolymers, styrene-methacrylic acid ester copolymers, styrene-acrylic acid ester-methacrylic acid ester copolymers, styrene-methyl α-chloroacrylate copolymers, styrene-acrylonitrile-acrylic acid ester copolymers, styrene-vinyl methyl ether copolymers and the like; polyester resins, epoxy resins, urethane-modified epoxy resins, silicone-modified epoxy resins, vinyl chloride resins, rosin-modified maleic acid resins, phenyl resins, polyethylene-based resins, polypropylene, ionomer resins, polyurethane resins, silicone resins, ketone resins, ethylene-ethyl acrylate copolymers, xylene resins, polyvinylbutyral resins, terpene resins, phenolic resins, aliphatic or alicyclic hydrocarbon resins, and the like. Among these, one or a combination of two or more species can be used. Among those described above, since a polyester resin has high affinity for the fatty acid monoester and the unsaturated fatty acid glyceride thanks to the similarity in chemical structures thereof, when a polyester resin is used, a liquid developer having particularly excellent dispersibility for toner particles can be obtained. Additionally, since the polyester resin is likely to manifest plasticizing effect, the toner particles plasticized by the fatty acid component of the insulating liquid becomes easy to penetratpenetrate into the recording medium upon fixation. In addition, coming in contact with between toner particles adjacent to each other, the toner particles are easy to melt. For this reason, when using multi-colored liquid developer, the toner particles having a plurality of colors are mutually mixed up, and the toner image may show intermediate color. As a result, when the polyester resin is used as a resin, the liquid developer has a particularly excellent storage property, the formed image has particularly excellent fixation intensity, and thus it is possible to more assuredly obtain the image having a desired color tone.

The softening temperature of the resin (resin material) is not particularly limited, but is preferably 50 to 140° C., more preferably 50 to 130° C., and further more preferably 60 to 120° C. Additionally, the term softening temperature used in the present specification refers to a temperature for initiation of softening, as measured using a Koka flow tester (Shimadzu Corp.) under the measuring conditions of: a rate of temperature increase of 5° C./min and a die hole diameter of 1.0 mm.

2. Colorant

The toner also contains a colorant. Examples of the colorant that can be used include pigments, dyes and the like. Examples of such pigments and dyes include carbon black, spirit black, lamp black (C.I. No. 77266), magnetite, titanium black, chrome yellow, cadmium yellow, mineral fast yellow, navel orange yellow, Naphthol Yellow S, Hanza Yellow G, Permanent Yellow NCG, chrome yellow, Benzidine Yellow, quinoline yellow, Tartrazine Lake, chrome orange, molybdenum orange, Permanent Orange GTR, Pyrazolone Orange, Benzidine Orange G, cadmium red, Permanent Red 4R, Watching Red calcium salt, eosine lake, Brilliant Carmine 3B, manganese violet, Fast Violet B, Methyl Violet Lake, prussian blue, cobalt blue, Alkali Blue Lake, Victoria Blue Lake, Fast Sky Blue, Indanthrene Blue BC, ultramarine blue, aniline blue, Phthalocyanine Blue, Calco Oil Blue, chrome green, chromium oxide, Pigment Green B, Malachite Green Lake, Phthalocyanine Green, Final Yellow Green G, Rhodamine 6G, quinacridone, Rose Bengal (C.I. No. 45432), C.I. Direct Red 1, C.I. Direct Red 4, C.I. Acid Red 1, C.I. Basic Red 1, C.I. Mordant Red 30, C.I. Pigment Red 48:1, C.I. Pigment Red 57:1, C.I. Pigment Red 122, C.I. Pigment Red 184, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Pigment Blue 15:1, C.I. Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, Nigrosine dye (C.I. No. 50415B); metal complex dyes, silica, aluminum oxide, magnetite, maghemite, various ferrites; metal oxides such as cupric oxide, nickel oxide, zinc oxide, zirconium oxide, titanium oxide, magnesium oxide and the like; magnetic materials including magnetic metals such as Fe, Co and Ni; and the like. Among these, one or a combination of two or more species can be used.

3. Other Component

The toner may also contain components other than the above-described components. Examples of such components include waxes, antistatic agents, magnetic powders and the like.

Examples of the wax include hydrocarbon-based waxes such as ozokerite, ceresin, paraffin waxes, microwaxes, microcrystalline waxes, petrolatum, Fisher-Tropsch wax and the like; ester-based waxes such as carnauba wax, rice wax, methyl laurate, methyl myristate, methyl palmitate, methyl stearate, butyl stearate, candelilla wax, cotton wax, wood wax, beeswax, lanolin, montan wax, fatty acid esters and the like; olefin-based waxes such as polyethylene wax, polypropylene wax, oxidized polyethylene wax, oxidized polypropylene wax and the like; amide-based waxes such as 12-hydroxystearic acid amide, stearic acid amide, anhydrous phthalic acid imide and the like; ketone-based waxes such as laurone, stearone and the like; ether-based waxes; and the like. Among these, one or a combination of two or more species can be used.

Examples of the antistatic agent include metal salts of benzoic acid, metal salts of salicylic acid, metal salts of alkylsalicylic acid, metal salts of catecholic acid, metal-containing bisazo dyes, Nigrosine dyes, tetraphenyl borate derivatives, quaternary ammonium salts, alkylpyridinium salts, chlorinated polyesters, nitrofunic acid, and the like.

Examples of the magnetic powder include magnetite, maghemite, various ferrites; metal oxides such as cupric oxide, nickel oxide, zinc oxide, zirconium oxide, titanium oxide, magnesium oxide and the like; materials composed of magnetic materials containing magnetic metals such as Fe, Co and Ni; and the like.

For the compositional material (component) of the toner particles, in addition to the above-described materials, zinc stearate, zinc oxide, cerium oxide, silica, titanium oxide, iron oxide, fatty acids, fatty acid metal salts, and the like may be also used.

Shape of Toner Particles

The average particle size of the toner particles composed of the materials as described above is in the range of 0.7 to 3 μm based on volume. If the average particle size of the toner particles falls within the described range, the resolution of the toner images formed by the liquid developer can be sufficiently increased, while particularly reducing differences in the properties of the individual toner particles, and particularly increasing the reliability of the liquid developer as a whole. Additionally, by making the dispersion of the toner particles into the insulating liquid uniform, the storage property of the liquid developer can be made more excellent.

In this case, when an average particle diameter of the toner particles is less than the lower limit, the irregularity of the toner particles in properties and compositions becomes large, and the difference of the particle diameter between the toner particles greatly changes the individual properties of the toner particles. As a result, high reliability of the liquid developer cannot be made as a whole, excellent developability and transferability cannot be obtained, and the resulting toner image has a lot of defects, uneven concentrations, and the like. Additionally, the aggregation of the toner particles is likely to occur during storage, the storage property of the liquid developer can not be made to be sufficient.

Conversely, when an average particle diameter of the toner particles is more than the upper limit, high resolution of the formed toner image can not be obtained. Additionally, since coarse particles increase, defects, uneven concentrations, and the like increase. Additionally, during storage of the liquid developer, precipitation is easy to occur, and the liquid developer cannot have a sufficient storage property.

The average particle diameter of the toner particles needs only to be in the aforementioned ranges, but more remarkable effect can be obtained in the case where the average particle diameter is preferably in the range of 0.8 to 2.5 μm, and more preferably in the range of 0.8 to 2.0 μm. The term average particle diameter used in the present specification refers to an average particle diameter based on volume.

In the embodiment of the invention, width S of the particle size distribution of the toner particles represented by the following formula (I) is 1.4 or less.

$$S=[D(90)-D(10)]/D(50) \quad \text{(I)}$$

where D (X) represents the particle diameter at the point of X % in which X is the ratio of accumulated volume to the total volume when the volume is accumulated from the small particle diameter in the particle size distribution of the toner particles.

When the width S of the particle size distribution of the toner particles is smaller than the upper limit, the irregularity of the particle diameter between the toner particles decrease, in the case where the coating roller and the like are immersed in the liquid developer in the developing vessel, gap between the toner particles becomes large, and thus effective transfer and development can be performed by adhering optimum dose of the insulating liquid to the toner particles. Additionally, since the coarse particles decrease, the resulting toner image becomes a fine image which has little defects, stripes, uneven concentrations and the like. In addition, the optimum dose of the insulating liquid exists between the toner particles upon fixation. Accordingly, it is possible to obtain excellent fixation intensity. Moreover, since the irregularity of the particle diameter between the toner particles is small, the toner particles receive the pressure and heat in a uniform manner upon fixation, and the toner particles uniformly melt, thereby it is possible to obtain the image having a desired color tone. Since the toner particles melt uniformly, the toner image has excellent smoothness, and thus the toner image can have an excellent surface gloss. When the liquid developer remaining in roller members such as a developing roller or a coating roller is collected and recycled after use, even if the aggregation of the toner particles exists, the aggregation can be decomposed into fine toner particles by applying weak external force such as agitation, thereby suitably preventing occurrence of the coarse particles in the recycled liquid developer. For this reason, very fine toner image can be formed and provided for long time. For this reason, the liquid developer has excellent recyclability.

As mentioned above, generally, when using toner particles having narrow particle size distribution, a lot of insulating liquid remains in the formed toner image. When using the known liquid developer, the remained insulating liquid prevents the toner particles adhering to each other, and the long-term storage property of the toner image decrease. However, since the liquid developer of the embodiment of the invention include unsaturated fatty acid glyceride, unsaturated fatty acid glyceride is oxidatively polymerized, thereby strongly fixing the toner particles on the recording medium. Additionally, unsaturated fatty acid glyceride forms overcoat processed by the oxidative polymerization on surface of the toner image. As a result, the long-term storage property of the toner image can be made excellent.

In this case, when the width S of the particle size distribution of the toner particles is greater than the upper limit, the non-uniformity of the particle diameter between the toner particles, and the gap of the toner particles becomes small in the case where the coating roller and the like are immersed in the liquid developer in the developing vessel. Therefore, the amount of the insulating liquid adhering to the toner particles is not sufficient, and thus it is difficult to perform effective transfer and development. Additionally, since the coarse particles increase, defects, stripes, uneven image, and the like increase on the resulting toner image, thereby it is not possible to obtain fine toner image. Additionally, since pressure and heat upon fixation not uniformly apply to the toner particles and the toner particles can not melt uniformly, the image having a desired color tone can not be obtained. The smoothness of the toner image also becomes bad, and thus the gloss of the toner image becomes low. Additionally, when recovering and recycling the remained liquid developer after forming an image, a lot of aggregations of toner particles that can not be dispersed by comparatively weak external force such as an agitation and the like occur, and thus recyclability decreases.

The width S of the particle size distribution of the toner particles is preferably 1.3 or less, more preferably 1.2 or less. When the above condition is satisfied, it is possible to obtain a remarkable effect.

The toner particles' shape factor SF1 represented by the following formula (II) is preferably in the range of 100 to 130, more preferably in the range of 100 to 125, even more preferably in the range of 100 to 120.

$$SF1=\{(ML)^2/A\}\times(100\pi/4) \quad \text{(II)}$$

where A [$\mu m^2$] is an area of a figure generated when the toner particles of a subject of measurement are projected onto a two-dimensional plane, and ML [μm] is the maximum length of the figure, as shown in FIG. 1A. Additionally, according to an embodiment of the invention, the SF1 of the toner particles can be obtained as an average value by randomly observing 100 or more toner particles in the liquid developer.

Generally, the shape factor SF1 can be used as an indicator of sphericity of a particulate, and a smaller value of the SF1 means that the particulate becomes more similar to the perfect spherical shape. Additionally the minimum value of the SF1 is 100, at that time, it can be said that the particles are formed in a perfect spherical shape. When the average value of the SF1 thereof is suitably small, the transfer and development can be made more excellent, and a fine image without defects can be surely easy to obtain. When a plurality of the toner particles are contact with each other, the contact between the toner particles decreases. Additionally, a larger amount of the insulating liquid can adhere to around the toner particles. Because of this even if the toner particles coheres between them at recycling process, aggregation of the toner particles can be easily decomposed by weak external force such as agitation, and thus the toner particulate can be dispersed in the insulating liquid. For this reason, the liquid developer has excellent recyclability.

Generally, in the same kinds of the image forming apparatus as described later, when the SF1 of the toner particles has a sufficiently small value as mentioned above, the toner particles may not be properly removed by a cleaning blade in the process of removing the toner particles adhering to a developing roller, a photosensitive member, and the like equipped in a transferring section and a developing section. However, according to the embodiment of the invention, SF2 (which will be described in the following section) of the toner particles is in the allowable range as described below, and thus the toner particles adhering to the developing roller, the photosensitive member, and the like can be easily removed by the cleaning blade.

Figure 1B:
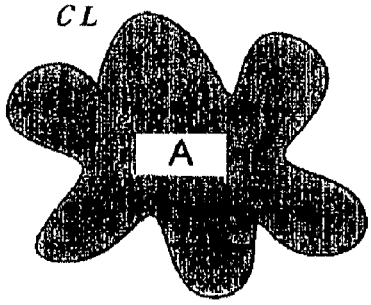

The toner particles' shape factor SF2 represented by the following formula (III) is preferably in the range of 110 to 150, more preferably in the range of 115 to 145, even more preferably in the range of 120 to 140.

$$SF2=\{(CL)^2/A\}\times(100/4\pi) \quad \text{(III)}$$

where A [$\mu m^2$] is an area of a figure generated when the toner particles are projected onto a two-dimensional plane, and CL [μm] is the circumferential length of the figure, as shown in FIG. 1B. Additionally, according to an embodiment of the invention, the SF2 of the toner particles can be obtained as an average value by randomly observing 100 or more toner particles in the liquid developer.

Generally, the shape factor SF2 can be used as an indicator of irregularities of a particulate surface, a smaller value of the SF2 means that the particulate surface becomes smoother, and a larger value of the SF2 means that the particulate surface becomes more uneven. For this reason, when the average value of the SF2 thereof is in the above range, the toner particulate has suitably minute irregularities. Because of this, the particles are easy to catch on the blade in the process of cleaning, and the remained toner particles can be removed from the photosensitive member and an intermediate transfer member. As a result, the liquid developer has excellent cleaning ability. Additionally, when recycling after cleaning, occurrence of the toner particles' aggregation can be suitably prevented. As mentioned above, by including suitably the minute irregularities of the toner particles, superabundant contact between the toner particles can be prevented while retaining a larger amount of the insulating liquid on the particle surface. As a result, while facilitating dispersion of the toner particles in the insulating liquid, the aggregation of the plural toner particles can be suitably prevented during storage. For this reason, the liquid developer including the toner particles can obtain an excellent storage property. Additionally, the liquid developer remaining in members and the like after image formation can be easily recycled. Additionally, when the toner particles have minute irregularities, the surface area in the vicinity of the volume of the toner particles is large, and the area of the toner particle surface in contact with the insulating liquid is large. For this reason, the unsaturated fatty acid glyceride and fatty acid monoester in the insulating liquid more effectively act as a plasticizer upon fixation, and the toner particles can be easily plasticized. Additionally, since irregularities the toner particles have minute uneven surface, the contact area between the toner particles on the recording medium is increased, and the toner particles can easily melt with each other upon fixation. As a result, the fixation intensity of the formed image can be made more excellent. Additionally, since especially high gloss can be obtained, it is possible to more assuredly obtain the image having a desired color tone.

The average value of the degree of circularity R (average degree of circularity) of the toner particles constituting the liquid developer, as represented by the following formula (IV), is preferably 0.85 or greater, more preferably 0.90 to 0.99, and even more preferably 0.92 to 0.99.

$$R=L_0/L_1 \quad \text{(IV)}$$

where $L_1$ [μm] represents the perimeter of a projected image of toner particles of a subject of measurement; and $L_0$ [μm] represents the perimeter of a perfect circle having the same area as the area of a projected image of toner particles of the subject of measurement.

Then, a particularly excellent transfer efficiency and mechanical strength of the toner particles can be obtained, while keeping the particle size of the toner particles sufficiently small.

The standard deviation of the average degree of circularity among the toner particles that constitute the liquid developer is preferably 0.15 or less, more preferably 0.001 to 0.10, and even more preferably 0.001 to 0.05. Then, the differences in the properties among individual toner particles, such as antistatic property, fixing property and the like, are particularly reduced, and the reliability of the liquid developer as a whole is further improved.

The toner particles that can be used in the invention are not particularly limited so long as they satisfy the above-mentioned conditions, i.e., the particle diameter conditions and the particle size distribution conditions. Examples of the toner particles include a particle formed by cohering microparticles containing resin and coloring material, a particle formed by associating microparticles containing resin and coloring material (hereinafter, it is referred to as associated particles), a spherical shaped particle obtained by polymerization method for polymerizing a monomer component and forming microparticles of insoluble resin in the insulating liquid, a particle obtained by performing a splay drying on aqueous emulsion containing resin and coloring material, a particle obtained by performing pulverizing or disintegrating the just above-mentioned particles in the insulating liquid, a particle obtained by a pulverizing method and the like.

In the aforementioned examples, a particle obtained by disintegrating associated particles in the insulating liquid as described later (hereinafter, the particle is referred to as a associated/disintegrated particle) is preferable, since the particle is easily able to satisfy the allowable particle diameter and particle size distribution as mentioned above. Such a particle is also easily able to satisfy the aforementioned shape factor SF1 and SF2.

Since the associated/disintegrated particles are processed by disintegrating aggregations of microparticles, the toner particulate has minute irregularities on the surface thereof. Since the associated/disintegrated particulate has minute irregularities, a larger amount of the insulating liquid can keep on the particle surface. For this reason, by facilitating dispersion of the toner particles in the insulating liquid during storage, the storage property of the liquid developer containing the toner particles can be made more excellent. Additionally, when the toner particulate has the minute irregularities, surface area per volume of the toner particulate is large, and the area of the toner particle surface in contact with the insulating liquid is large. For this reason, the insulating liquid having the plasticizing effect upon fixation is more effective as a plasticizer, and the toner particles can be easily plasticized. In addition, due to the result that the contact area between the toner particles increases on the recording medium by the minute irregularities of the toner particles, the toner particles easily melt with each other upon fixation. Accordingly, it is possible to obtain the particularly excellent fixation intensity of the formed image and the particularly excellent gloss, and thus it is possible to more assuredly obtain the image having a desired color tone.

Method of Preparing Liquid Developer

The case of using associated/disintegrated particles will be described as an example of a method of preparing a liquid developer. The method of preparing a liquid developer according to the present embodiment includes a process for associated particle formation, in which associated particles are obtained by allowing resin microparticles mainly composed of a resin material to associate, and a process for obtaining toner particles by disintegrating the associated particles in the insulating liquid.

Preparation of Associated Particles

First, an exemplary method of preparing associated particles in which resin microparticles mainly composed of a resin material are in an associated state will be described.

The associated particles may be prepared by any method, but according to the present embodiment, the associated particles are obtained by obtaining an aqueous emulsion in which a dispersoid (microparticles) mainly composed of a resin material (toner material) is dispersed in an aqueous dispersion medium composed of an aqueous liquid, and allowing the dispersoid in the aqueous emulsion to associate.

Aqueous Emulsion

Hereinafter, the aqueous emulsion of the present embodiment will be described.

The aqueous emulsion obtained by a process of preparing aqueous emulsion to be described later is configured such that the dispersoid (microparticles) is microdispersed in the aqueous dispersion medium composed of the aqueous liquid.

Aqueous Dispersion Medium (Aqueous Liquid)

The aqueous dispersion medium is composed of an aqueous liquid.

According to embodiments of the invention, the term "aqueous liquid" means a liquid composed of water and/or a liquid having excellent compatibility with water (for example, a liquid having a solubility of 30 g or more in 100 g of water at 25° C.). Although the aqueous liquid is composed of water and/or a liquid having excellent compatibility with water as such, the aqueous liquid is preferably one composed mainly of water, and more preferably one having a water content of 70 wt % or greater, and even more preferably one having a water content of 90 wt % or greater. By using such a liquid, for example, the dispersibility of the dispersoid in the aqueous dispersion medium can be increased, and it is possible to have a dispersoid which has a relatively smaller particle size and small differences in the size of particles, in the aqueous emulsion. As a result, the toner particles in finally obtained liquid developer have small differences in the size and shape of the particles, and have a large degree of circularity.

Preferably, the aqueous dispersion medium (aqueous liquid) has low compatibility with high insulating liquid to be described later. For example, solubility of the aqueous dispersion medium in high insulating liquid 100 g at 25° C. is preferably 0.01 g or less. With such a configuration, a shape of dispersoid can suitably maintain in a compound liquid obtained by a preparation process of the compound liquid to be described later, and thus the final shape of the toner particles in the liquid developer can be made more uniformly.

Detailed examples of aqueous liquids include alcohol based solvents such as water, methanol, ethanol, and propanol; ether based solvents such as 1,4-dioxane and tetrahydrofuran (THF); heteroaromatic compound based solvents such as pyridine, pyrazine, and pyrrole; amide based solvents such as N,N-dimethylformamide (DMF) and N,N-dimethylacetamide (DMA); nitrile based solvents such as acetonitrile; aldehyde based solvents such as acetoaldehyde; and the like.

Dispersoid (Microparticles)

Dispersoid includes components constituting the toner particles in the liquid developer, and the dispersoid is composed of materials including resin or precursor thereof as at least one main component (hereinafter, those are referred to as "resin material"). Examples of the precursors of resin include monomer, dimer, oligomer, and prepolymer of the corresponding resin.

Hereinafter, components of the dispersoid will be described.

1. Resin (Resin Material)

The dispersoid is composed of materials including resin as a main component.

The resin material is not particularly limited, and the resin constituting the aforementioned toner particles and the precursor thereof can be used. It is also allowed that a curing agent is contained in the aforementioned resin depending on demands.

2. Solvent

The dispersoid may include solvent dissolving at least one part of the component thereof. With such a configuration, for example, since fluidity of the dispersoid in the aqueous emulsion can increase, the dispersoid in the aqueous emulsion may have comparatively small particle diameter and uniform size. As a result, differences in the properties such as shape and size of the individual toner particles finally obtained in the liquid developer decrease and degree of circularity thereof increases.

Any kinds of solvent can be used if the solvent can dissolve at least a part of the component constituting the dispersoid, but it is desirable that boiling point of the solvent is lower than that of the aforementioned aqueous liquid.

Preferably, the solvent has low compatibility with the aforementioned aqueous dispersion medium (aqueous liquid). For example, solubility of the aqueous dispersion medium in aqueous emulsion medium 100 g at 25° C. is preferably 30 g or less. With such a configuration, the dispersoid in the aqueous emulsion can be minutely dispersed in stable state.

Additionally, composition of the solvent can be properly selected depending on composition of the aforementioned resin and colorant, composition of the aqueous dispersion medium, and the like.

Examples of such a solvent include inorganic solvents and organic solvents such as carbon disulfide and carbon tetrachloride; ketone based solvents such as methylethylketone (MEK), acetone, diethylketone, methylisobutylketone (MIBK), methylisopropylketone (MIPK), cyclohexanone, 3-heptanone, and 4-heptanone; alcohol based solvents such as methanol, ethanol, n-propanol, isopropanol, n-butanol, i-butanol, t-butanol, 3-methyl-1-butanol, 1-pentanol, 2-pentanol, n-hexanol, cyclohexanol, 1-heptanol, 1-octanol, 2-octanol, 2-methoxyethanol, allyl alcohol, furfuryl alcohol, and phenol; ether based solvents such as diethyl ether, dipropyl ether, diisopropyl ether, dibutyl ether, 1,2-dimethoxyethane (DME), 1,4-dioxane, tetrahydrofuran (THF), tetrahydropyran (THP), anisole, diethylene glycol dimethyl ether (diglyme), and 2-methoxyethanol; cellosolve based solvents such as methylcellosolve, ethylcellosolve, and phenylcellosolve; aliphatic hydrocarbon based solvents such as hexan, pentane, heptane, cyclohexan, methylcyclohexan, octane, didecane, methylcyclohexane, and isoprene; aromatic hydrocarbon based solvents such as toluene, xylene, benzene, ethylbenzene, and naphthalene; heteroaromatic compound based solvents such as pyridine, pyrazine, furan, pyrrole, thiophene, 2-methylpyridine, 3-methylpyridine, 4-methylpyridine, and furfuryl alcohol; amide based solvents such as N,N-dimethylformamide (DMF) and N,N-dimethylacetamide (DMA); halogen compound based solvents such as dichloromethane, chloroform, 1,2-dichloroethane, trichloroethylene, and chlorobenzene; ester based solvents such as acetylacetone, ethylacetate, methylacetate, isopropylacetate, isobutylacetate, isopentylacetate, chloroethylacetate, chlorobutylacetate, chloroisobutylacetate, ethylformate, isobutylformate, ethylacrylate, methylmethacrylate, and ethylbenzoate; amine based solvents such as trimethylamine, hexylamine, triethylamine, and aniline; nitrile based solvents such as acrylonitrile and acetonitrile; nitro based solvents such as nitromethane and nitroethane; aldehyde based solvents such as acetoaldehyde, propionaldehyde, butylaldehyde, pentanal, and acrylaldehyde; and the like. Among these, one or a combination of two or more species can be used.

Additionally, colorant is usually contained in the dispersoid. For example, pigment, dyes, and the like can be used as the colorant. The pigment and dyes are not particularly limited, but for example, those materials as exemplified as constituting the aforementioned toner particles can be used.

The content of the colorant in the aqueous emulsion is not particularly limited, but the content is preferably in the range of 0.1 to 15 wt %, and more preferably in the range of 0.3 to 10 wt %. When the content of the colorant is less than the lower limit, a visible image having sufficient concentration in accordance with the kinds of the colorant may be difficult to form. Conversely, the content of the colorant is greater than the upper limit, the fixation intensity and charging characteristics of the toner finally obtained may be lowered.

Wax may be included in the dispersoid. The wax is usually used for the purpose of improving mold-releasing characteristics. The wax is not particularly limited, but for example, the examples of materials constituting the aforementioned toner particles can be used.

The content of the wax in the aqueous emulsion is not particularly limited, but the content is preferably 1.0 wt % or less, and more preferably 0.5 wt % or less. When the content of the wax is too much, the wax is released from the toner particles and becomes coarse in the liquid developer finally obtained, and thus the gravitation that the transfer efficiency of the toner decreases can be observed.

The softening temperature of the wax is not particularly limited, but the softening temperature is preferably in the range of 50 to 130° C., and more preferably in the range of 50 to 120° C.

Components other than these materials may be included in the aqueous emulsion. Examples of such a component include emulsifying dispersant, charge control agent, magnetic powder and the like. When using the emulsifying dispersant of the examples, differences in the properties such as shape and size of the individual dispersoids in the aqueous emulsion can be particularly reduced and the dispersoids can be formed in a nearly spherical shape, while improving dispersibility of the dispersoid. As a result, the final liquid developer can be formed so as to be composed of toner particles having a nearly spherical shape, uniform shape, and uniform size. Here, examples of such a emulsifying dispersant include emulsifier, dispersant, dispersion assisting agent, and the like.

Examples of such a dispersant include inorganic dispersants such as clay mineral, silica, and tricalcium phosphate; nonionic organic dispersants such as polyvinyl alcohol, carboxymethyl cellulose, polyethylene glycol, and hydroxystearic acid ester; anionic organic dispersants such as metallic salt of tristearic acid (for example, aluminum salt, and the like), metallic salt of distearic acid (for example, aluminum salt, barium salt, and the like), metallic salt of stearic acid (for example, calcium salt, lead salt, zinc salt, and the like), metallic salt of linolenic acid (for example, cobalt salt, manganese salt, lead salt, zinc salt, and the like), metallic salt of octanoic acid (for example, aluminum salt, calcium salt, cobalt salt, and the like), metallic salt of oleic acid (for example, calcium salt, cobalt salt, and the like), metallic salt of palmitic acid (for example, zinc salt, and the like), metallic salt of naphthene acid (for example, calcium salt, cobalt salt, manganese salt, lead salt, zinc salt, and the like), metallic salt of resin acid (for example, calcium salt, cobalt salt, manganese salt, zinc salt, and the like), metallic salt of polyacrylic acid (for example, sodium salt, and the like), metallic salt of polymethacrylic acid (for example, sodium salt, and the like), metallic salt of polymaleic acid (for example, sodium salt, and the like), metallic salt of acrylic acid/maleic acid copolymer (for example, sodium salt, and the like), and metallic salt of polystyrenesulfone acid (for example, sodium salt, and the like); cationic organic dispersants such as quaternary ammonium salt. In these examples, the nonionic organic dispersants or the anionic organic dispersants is particularly preferable to use.

The content of the dispersant in the aqueous emulsion is not particularly limited, but the content is preferably 3.0 wt % or less, and more preferably in the range of 0.01 to 1.0 wt %.

Additionally, examples of such a dispersion assisting agent include anion, cation, nonionic surfactant, and the like.

It is desirable that the dispersion assisting agent is used with dispersant. When the aqueous emulsion includes the dispersant, the content of the dispersion assisting agent in the aqueous emulsion is not particularly limited, but the content is preferably 2.0 wt % or less, and more preferably in the range of 0.005 to 0.5 wt %.

The charge control agent and the magnetic powder are not particularly limited, but for example, the examples of materials constituting the aforementioned toner particles can be used.

Additionally, for example, zinc stearate, zinc oxide, cerium oxide, and the like other than the material mentioned above may add in the aqueous emulsion.

Additionally, components other than the dispersoid may be dispersed as an insoluble matter in the aqueous emulsion. For example, inorganic impalpable powder such as silica, titanium oxide, and iron oxide; and organic impalpable powder such as fatty acid and metallic salt of fatty acid may be dispersed in the aqueous emulsion.

According to the aqueous emulsion of the embodiment of the invention as mentioned above, the dispersoid shows gravitation that the shape of the dispersoid has high degree of circularity (sphericity) by the surface tension thereof since the dispersoid is liquid state. Accordingly, the toner particles in the liquid developer obtained finally has high degree of circularity and small variation of shape among particles.

The content of the dispersoid in the aqueous emulsion is not particularly limited, but the content is preferably in the range of 5 to 55 wt %, and more preferably in the range of 10 to 50 wt %. With such a configuration, it is possible to make productivity of the toner particles (liquid developer) to be particularly excellent while more surely preventing the aggregation between the dispersoids in the aqueous emulsion.

The average particle diameter of the dispersoid (dispersoid in the liquid state) in the aqueous emulsion is not particularly limited, but the content is preferably in the range of 0.01 to 3 μm, and more preferably in the range of 0.1 to 2 μm. With such a configuration, size of the toner particles finally obtained is configured as optimum thereof.

Preparation Process of Aqueous Emulsion

For example, the aforementioned aqueous emulsion can be prepared as described below (preparation process of aqueous emulsion).

First, aqueous solution in which the dispersant is added in the aforementioned aqueous liquid according to need is provided.

Meanwhile, resin solution including resin or the precursor thereof (hereinafter, those are referred to as "resin material") which are main components of the aforementioned toner is prepared. For example, in the preparation of the resin solution, the aforementioned solvent can be available in addition to the resin material. Additionally, liquid melted by heating the resin material may be used as the resin solution. In the preparation of the resin solution, for example, materials for toner such as the resin material and the colorant may be used as kneaded material obtained by a kneading process. When such a kneading product is used, even in the case where the compositional materials for toner include components that are difficult to be dispersed or compatibilized with each other, those components can be sufficiently compatibilized or microdispersed in the kneading product obtained by subjecting the components to kneading. In particular, in the case where a pigment (colorant) having relatively low dispersibility in a solvent as described above is used, if the pigment is treated with kneading in advance before being dispersed in the solvent, the peripheries of the pigment particles are effectively coated with a resin component or the like, thereby the dispersibility of the pigment in the solvent being improved (particularly, microdispersion in the solvent is made possible), and the chromogenicity of the finally obtained toner being good. From this, even in the case where a component having poor dispersibility in the aqueous emulsion medium of the aqueous emulsion described above, or a component having poor solubility in the solvent contained in the dispersion medium of the aqueous emulsion is included in the toner constituent materials, the dispersibility of the dispersoid in the aqueous emulsion can be made particularly excellent.

Next, as the toner material solution is slowly added dropwise into the aqueous dispersion medium in an agitated state, an aqueous emulsion in which the dispersoid containing the toner material is dispersed in an aqueous dispersion medium is obtained. By using the preparation method of the aqueous emulsion as mentioned above, the degree of circularity of the dispersoid in the aqueous emulsion can further increase. As a result, the toner particles in the liquid developer finally obtained has high degree of circularity and small shape variance among the particles. Additionally, the aqueous solution and/or resin solution may undergo a heat process when performing dripping of the resin solution. For example, when solvent is used in the preparation of the resin solution, at least a moiety of solvent contained in the dispersoid may be removed by heating and decompressing the aqueous emulsion obtained after performing the above dripping.

Additionally, instead of the operation, water-soluble solution may gradually add in the resin solution in the agitated state while gradually dripping. By adding the water-soluble solution, the resin solution inverts the phase and is emulsified, and thus it is possible to obtain the aqueous emulsion which is the same as the aqueous emulsion obtained by the operation and of which the dispersoid including the resin material is dispersed in the aqueous dispersion medium.

Process for Associated Particle Formation

Next, an electrolyte is added to the aqueous emulsion thus obtained to allow the dispersoid to associate to form associated particles (process for associated particle formation).

Examples of the electrolyte to be added include acidic substances such as hydrochloric acid, sulfuric acid, phosphoric acid, acetic acid, oxalic acid and the like; organic and inorganic water-soluble salts such as sodium sulfate, ammonium sulfate, potassium sulfate, magnesium sulfate, sodium phosphate, sodium dihydrogen phosphate, sodium chloride, potassium chloride, ammonium chloride, calcium chloride, sodium acetate and the like; and the like. Among these, one or a combination of two or more species can be used. Among them, a sulfuric acid salt of a monovalent cation, such as sodium sulfate, ammonium sulfate or the like can be favorably used in inducing uniform association.

Moreover, before adding the electrolyte or the like, an inorganic dispersion stabilizer such as hydroxyapatite or the like, or an ionic or nonionic surfactant may be added as a dispersion stabilizer. When an electrolyte is added in the presence of a dispersion stabilizer (emulsifier), non-uniform association can be prevented.

Examples of such dispersion stabilizer include nonionic surfactants such as polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, various Pluronics, and the like; anionic surfactants of alkylsulfuric acid ester salt type; cationic surfactants of quaternary ammonium salt type; and the like. Among them, the anionic and nonionic surfactants are effective in dispersion stability even if a small amount is added, and thus can be favorably used. The clouding point of the nonionic surfactant is preferably 40° C. or higher.

The amount of the electrolyte to be added is preferably 0.5 to 15 parts by weight, more preferably 1 to 12 parts by weight, and even more preferably 1 to 10 parts by weight, relative to 100 parts by weight of the solid components in the aqueous emulsion. If the amount of added electrolyte is less than the lower limit, association of the dispersoid may not sufficiently occur. If the amount of added electrolyte exceeds the upper limit, association of the dispersoid occurs non-uniformly so that coarse large particles may be possibly generated, and there is a possibility that differences may occur in the size of the finally obtained toner particles.

Then, after the association, filtration, washing, drying and the like are performed to yield the associated particles.

The average particle size of the resulting associated particles is preferably 1 to 10 μm, and more preferably 1 to 7 μm. Then, an appropriate particle size can be obtained for the finally obtained toner particles. Additionally, when the average particle diameter of the associated particles satisfies the range mentioned above, it can prevent the associated particles from aggregating and being coarse, while facilitating a drying process, in the process of drying.

Disintegration Process

Next, the associated particles obtained in the manner described above are disintegrated in the insulating liquid constituting the liquid developer (disintegration process). By this process, the toner particles of a sufficiently small size are stably dispersed in the insulating liquid and the liquid developer with a sufficiently narrow particle distribution of the toner particles can be provided.

In further detail, even in the case where toner particles of a relatively small size are obtained by disintegration, generation of coarse toner particles due to aggregation can be prevented because the toner particles are disintegrated in the insulating liquid. Further, the insulating liquid can be hold on concavities and convexities on the toner particles derived from fine particles (dispersoid) and, as a result, it is possible to make the dispersibility of the toner particles excellent.

Further, since the toner particles are obtained by disintegrating the associated particles, generation of fine particles (particles excessively smaller than the particles of intended size) can be prevented efficiently as compared to the related art pulverization method and the wet pulverizing method. As a result, decrease in the characteristics such as a charging property of the finally resulting liquid developer can be efficiently prevented.

It can be conceivable to prepare associated particles of a relatively small size and disperse them into the insulating liquid as the toner particles to prepare the liquid developer without disintegrating the associated particles. However, in this case, the associated particles are apt to aggregate, for example, at the time of drying because the associated particles are small in the particle size, so that the particle size of the resulting toner particles fluctuate.

When the associated particles are disintegrated using a part of the insulating liquid, the same liquid as the insulating liquid used in the disintegration may be added as the insulating liquid after the disintegration, or a liquid different from the insulating liquid used in the disintegration may be added as the insulating liquid after the disintegration. The latter case facilitates adjustment of the characteristics such as a viscosity of the finally resulting liquid developer. Also, when the associated particles are disintegrated using a part of the insulating liquid, it is preferred that the associated particles are disintegrated using the liquid containing the fatty acid monoester. Since the fatty acid monoester has a relatively small viscosity and is excellent in the affinity to resins, it easily intrudes between the fine particles (dispersoid) constituting the associated particles so that the associated particles are suitably disintegrated. Also, since the fatty acid monoester is excellent in dispersibility of the associated particles because of the excellent affinity to the resins, it can prevent generation of coarse toner particles due to aggregation during or after the disintegration. In addition, by applying a large shear force to the associated particles by disintegration, the toner particles are allowed to unevenly hold (absorb) the fatty acid monoester in the vicinity of its surface in the finally resulting liquid developer. Further, by disintegrating the associated particles in the liquid containing the fatty acid monoester as described above, the particle distribution and the particle size of the toner particles can be easily and surely controlled to the range described above. Also, the shape factors SF1 and SF2 of the toner particles can be easily and surely controlled to the preferred range described above.

Although the embodiment of the liquid developer of the invention in which the associated particles are used for preparing the toner particles is explained above, the toner particles can be prepared in a method in which a dispersion of dispersoids containing the resin and the colorant is ejected and the ejected liquid is dried to give particles. In this method, the fine dispersoids smaller than the toner particles to be prepared can be dispersed in the dispersion. Accordingly, even when the respective dispersoids vary in the size and the characteristics, a plurality of the dispersoids can be combined at the time of ejecting and drying the dispersion, so that the toner particles having small fluctuation in the size and the characteristics can be obtained. Also, the size of droplets can be controlled by regulating the amount of the dispersion to be ejected by means of piezoelectric pulses and the like, so that the toner particles of a small fluctuation in the size and the form can easily obtained. The toner particles can be obtained in the form of combined particles of fine particles having convexes and concaves or the spherical form with no convex and concave by applying heat treatment to the combined particles of the fine particles. When the method in which the dispersion is ejected is employed, the resulting liquid developer has a narrow particle distribution and a small fluctuation of the particles, and thus it is excellent in developing property and transferring property.

Image Forming Apparatus

Hereinafter, an image forming apparatus according to preferred embodiments of the invention will be described. The image forming apparatus of the embodiments of the invention uses the liquid developer as described above, and includes a mechanism for allowing toner particles adhering onto a recording medium to be fixed onto the recording medium by means of heat and pressure.

First Embodiment

First, an image forming apparatus according to a first embodiment of the invention will be described. The image forming apparatus of the present embodiment is one which forms a color image on the recording medium using the liquid developer of the invention.

Figure 2:
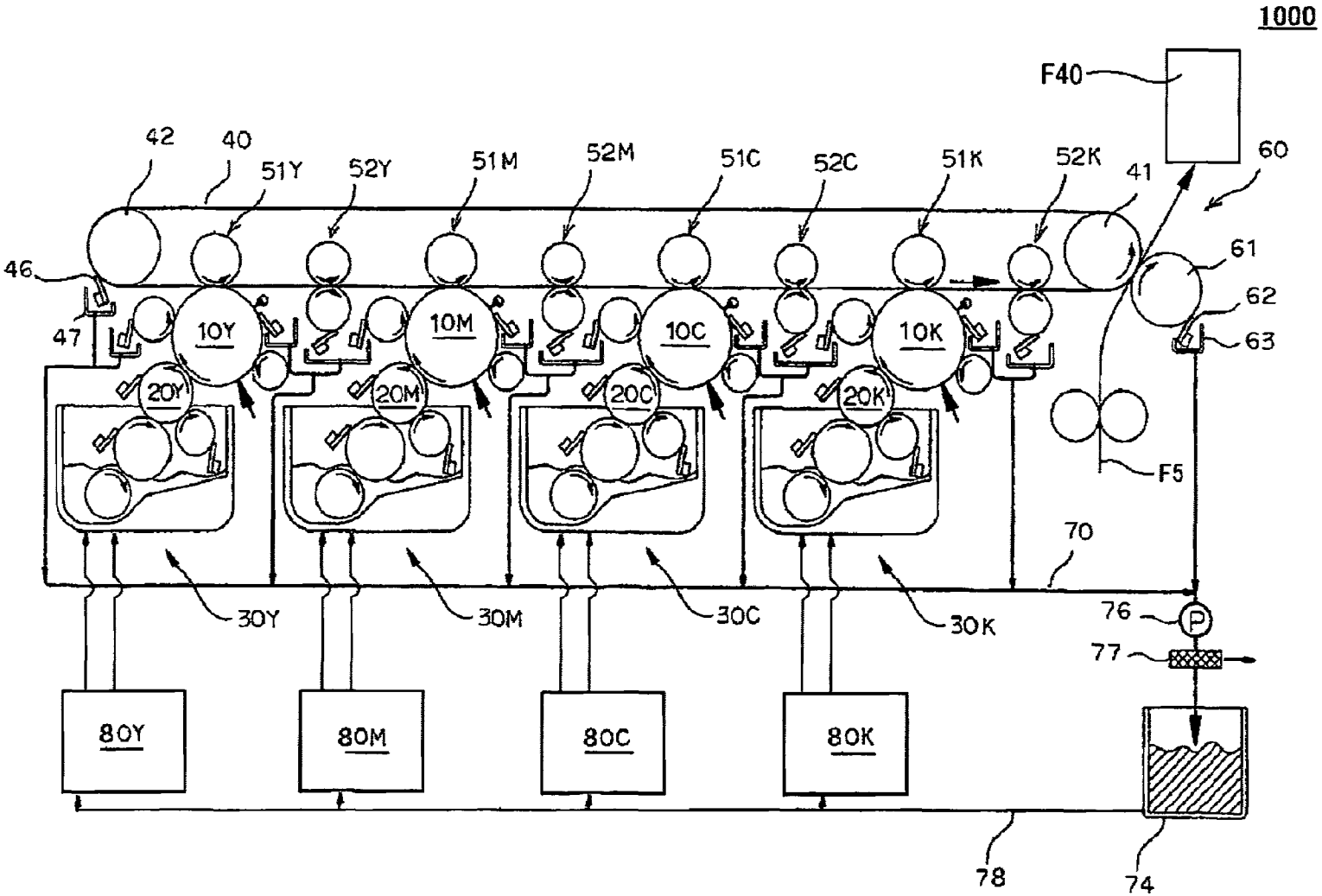
FIG. 2 is a schematic view illustrating an example of an image forming apparatus to which a liquid developer of an embodiment of the invention is applied.
Figure 3:
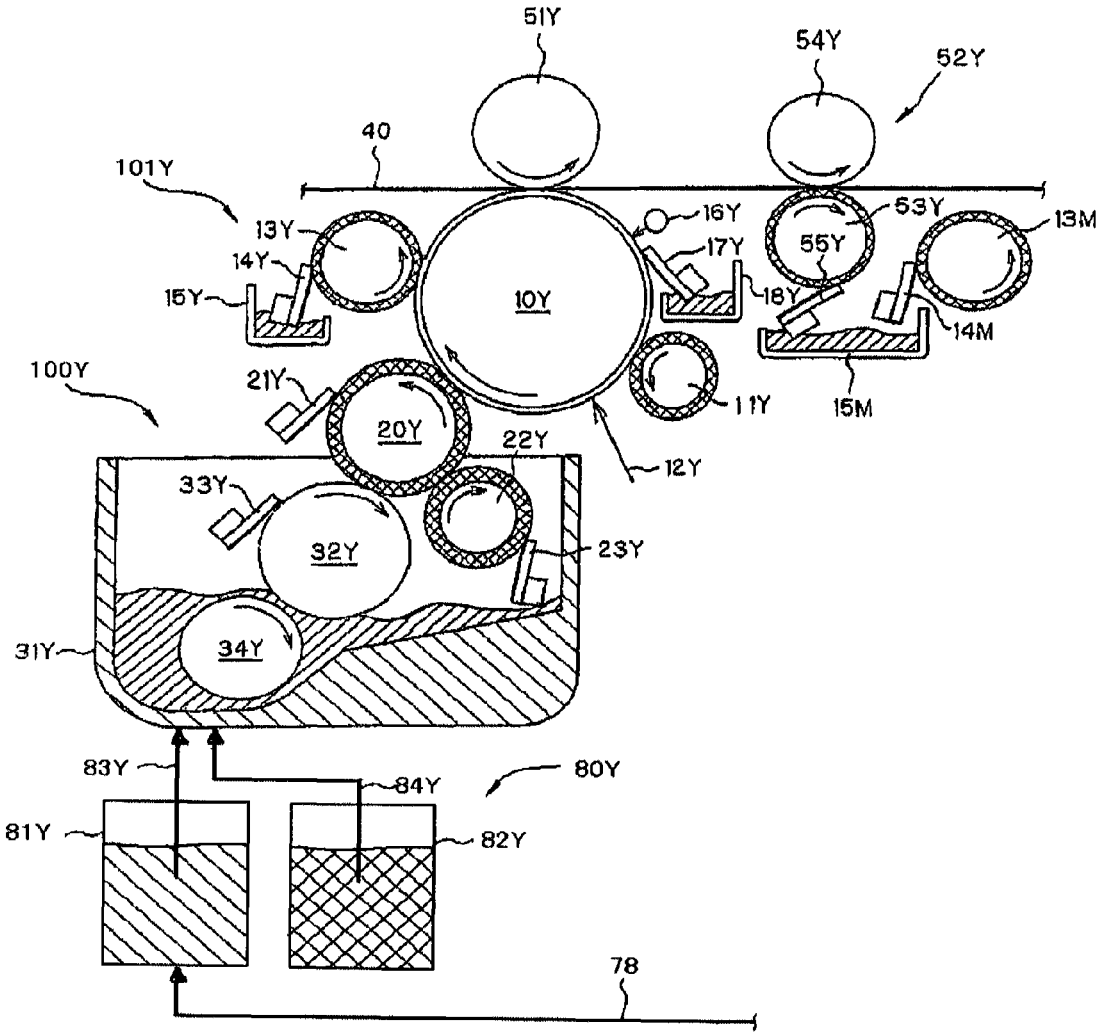
FIG. 3 is an enlarged view of a part of the image forming apparatus shown in FIG. 2.
Figure 4:
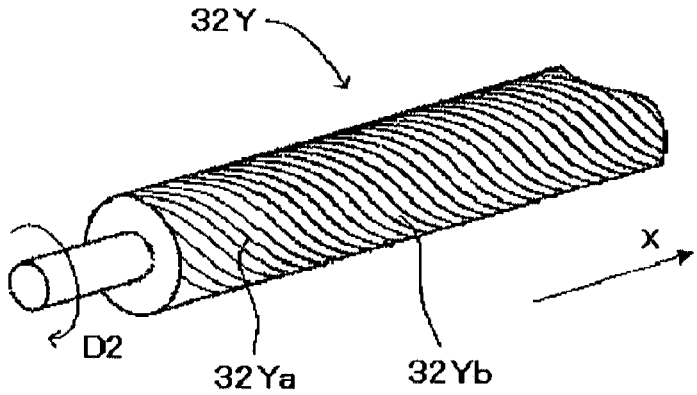
FIG. 4 is a perspective conceptual diagram illustrating a coating roller of the image forming apparatus shown in FIG. 2.
Figure 5:
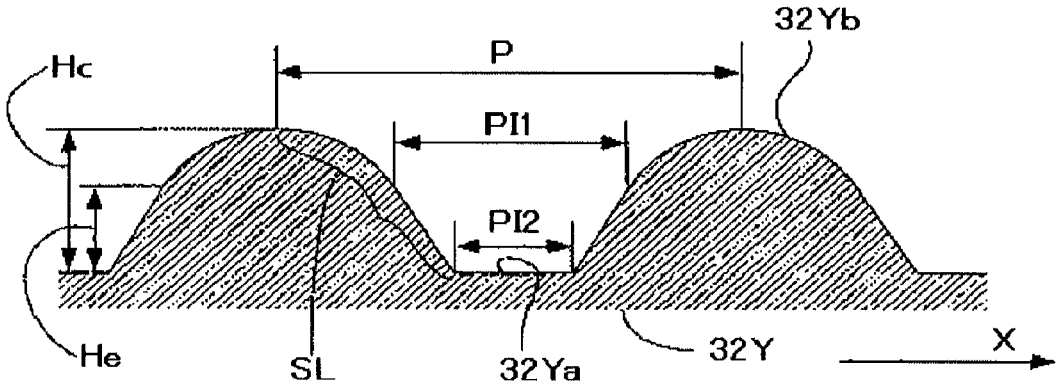
FIG. 5 is an enlarged schematic view of the coating roller shown in FIG. 4.
Figure 6:
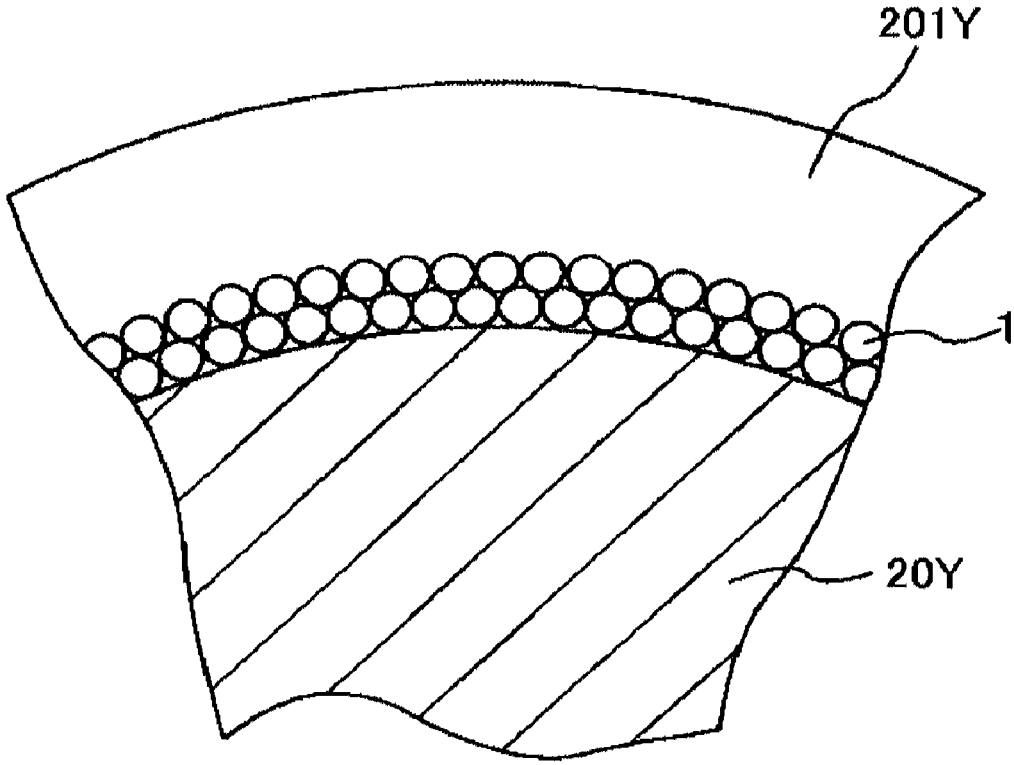
FIG. 6 is a schematic view illustrating the state of toner particles in a liquid developer layer on a developing roller of the image forming apparatus shown in FIG. 2.
Figure 7:
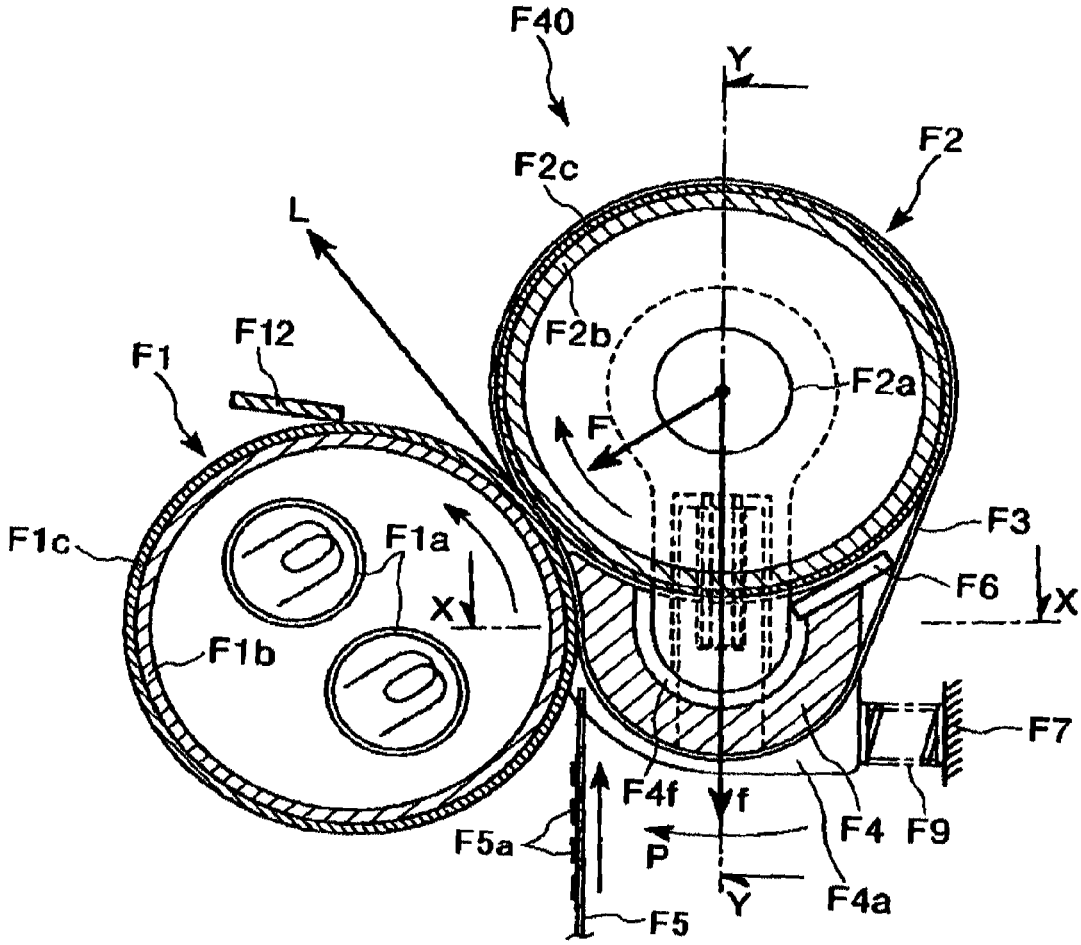
FIG. 7 is a sectional view illustrating an example of a fixing device used for the image forming apparatus shown in FIG. 2.

FIG. 2 is a schematic view illustrating an example of an image forming apparatus to which a liquid developer of an embodiment of the invention is applied. FIG. 3 is an enlarged view of a part of the image forming apparatus shown in FIG. 2. FIG. 4 is a perspective conceptual diagram illustrating a coating roller of the image forming apparatus shown in FIG. 2. FIG. 5 is an enlarged schematic view of the coating roller shown in FIG. 4. FIG. 6 is a schematic view illustrating the state of toner particles in a liquid developer layer on a developing roller of the image forming apparatus. FIG. 7 is a sectional view illustrating an example of a fixing device used for the image forming apparatus shown in FIG. 2.

The image forming apparatus 1000 includes, as shown in FIGS. 2 and 3, four developing sections 30Y, 30M, 30C, and 30K, an intermediate transfer section 40, a secondary transfer unit (secondary transfer section) 60, a fixing section (fixing device) F40, and four liquid developer supply section 80Y, 80M, 80C, and 80K.

The developing sections 30Y, 30M, and 30C have a function of forming latent images by means of a yellow liquid developer Y, a magenta liquid developer M, and a cyan liquid developer C and forming unicolored color images corresponding to each color. The developing section 30K has a function of forming a latent image by means of a black liquid developer K and forming a unicolored black image.

Since the developing sections 30Y, 30M, 30C, and 30K have the same configuration, only the configuration of the developing section 30Y will be described.

The developing section 30Y includes, as shown in FIG. 3, a photosensitive member 10Y as an example of an image carrying member. In the developing section 30Y, a charge roller 11Y, an exposure unit 12Y, a developing unit 100Y, a photosensitive member squeeze device 101Y, a primary transfer backup roller 51Y, a charge removing unit 16Y, a photosensitive member cleaning blade 17Y, and a developer collecting section 18Y are disposed in the rotating direction of the photosensitive member 10Y.

The photosensitive member 10Y includes a cylindrical base and a photosensitive layer formed on the outer periphery, and the photosensitive member 10Y can rotate about the center shaft, in the present embodiment, in the clockwise direction as indicated with an arrow as shown in FIG. 2.

The photosensitive member 10Y is supplied with a liquid developer from the developing unit 100Y to be described later, and a developer layer is formed on the surface of the photosensitive member 10Y.

The charge roller 11Y is a device for charging the photosensitive member 10Y. The exposure unit 12Y is a device for forming a latent image on the charged photosensitive member 10Y by means of laser irradiation. The exposure unit 12Y includes a semiconductor laser, a polygon mirror, a F-θ lens, and the like, and laser beams are irradiated onto the charged photosensitive member 10Y based on image signals supplied from a host computer (not shown) such as personal computers or word processors.

The developing unit 100Y is a device for developing the latent image formed on the photosensitive member 10Y using the liquid developer of the invention. Details of the developing unit 100Y will be described later.

The photosensitive member squeeze device 101Y is disposed downstream to the developing unit 100Y in the rotating direction so as to face the photosensitive member 10Y. The photosensitive member squeeze device 101Y includes a photosensitive member squeeze roller 13Y, a cleaning blade 14Y that removes the liquid developer adhering onto the surface while making pressing contact with the photosensitive member squeeze roller 13Y, and a developer collecting section 15Y that collects the liquid developer thus removed. The photosensitive member squeeze device 101Y has a function of collecting the surplus carrier (insulating liquid) overflowing from the photosensitive member 10Y after the development and naturally unnecessary foggy toner particles and thus increasing the proportion of toner particles in the developer. The toner particles 1 adhering onto the photosensitive member squeeze roller 13Y are in a densely populated state by means of a developer pressurizing roller 22Y to be described later. In this case, however, by employing the liquid developer as described above, the toner particles 1 can be easily removed from the photosensitive member squeeze roller 13Y by the cleaning blade 14Y.

The primary transfer backup roller 51Y is a device for transferring the unicolored image formed on the photosensitive member 10Y onto an intermediate transfer section 40 to be described later.

The charge removing unit 16Y is a device for removing the charges remaining on the photosensitive member 10Y after the intermediate transfer image is transferred onto the intermediate transfer section 40 by the primary transfer backup roller 51Y.

The photosensitive member cleaning blade 17Y is a rubber member making contact with the surface of the photosensitive member 10Y. The photosensitive member cleaning blade 17Y has a function of scraping the liquid developer remaining on the photosensitive member 10Y after the intermediate transfer image is transferred onto the intermediate transfer section 40 by the primary transfer backup roller 51Y. The toner particles 1 adhering onto the photosensitive member 10Y are in a densely populated state by means of the developer pressurizing roller 22Y to be described later. In this case, however, by employing the liquid developer as described above, the toner particles 1 can be easily removed from the photosensitive member 10Y by the photosensitive member cleaning blade 17Y.

The developer collecting section 18Y has a function of collecting the liquid developer removed by means of the photosensitive member cleaning blade 17Y.

The intermediate transfer section 40 is an endless belt-shaped elastic member, and is stretched between a belt drive roller 41 and a tension roller 42 while being wound around the belt drive roller 41 and the tension roller 42. The intermediate transfer section 40 can rotate with the rotation of the belt drive roller 41, while the primary transfer backup rollers 51Y, 51M, 51C, and 51K make contact with the corresponding photosensitive members 10Y, 10M, 10C, and 10K.

In this case, unicolored images corresponding to each color formed on the developing sections 30Y, 30M, 30C, and 30K are sequentially transferred onto the intermediate transfer section 40 by means of the primary transfer backup rollers 51Y, 51M, 51C, and 51K, and the respective unicolored images transferred thereto are overlapped to each other. With such a configuration, a full-colored developer image (intermediate transfer image) can be formed on the intermediate transfer section 40.

In the intermediate transfer section 40, the unicolored images formed on the photosensitive members 10Y, 10M, 10C, and 10K are transferred thereto, and the unicolored images transferred thereto are sequentially secondarily transferred in an overlapping manner to the recording medium F5 such as paper, film or fabric. For this reason, there is provided an elastic belt member as a means for improving the secondary transfer characteristics when the toner images are transferred to the recording medium F5 having an uneven surface in the secondary transfer process (for example, in the case of a sheet medium having uneven surfaces due to fabric materials).

A cleaning device including an intermediate transfer section cleaning blade 46 and a developer collecting section 47 is disposed in the side of the tension roller 42 that stretches the intermediate transfer section 40 in cooperation with the belt drive roller 41.

The intermediate transfer section cleaning blade 46 has a function of scraping the liquid developer adhering on the intermediate transfer section 40 after the images are transferred onto the recording medium F5 by the secondary transfer roller 61. The liquid developer adhering onto the intermediate transfer section 40 usually has lots of solid components, and it is thus difficult to remove the liquid developer in the solid state. However, by using a liquid developer having an excellent cleaning property as described above, the liquid developer adhering onto the intermediate transfer section 40 can be securely removed by the intermediate transfer section cleaning blade 46.

The developer collecting section 47 has a function of collecting the liquid developer removed by the intermediate transfer section cleaning blade 46.

In addition, an intermediate transfer section squeeze device 52Y is disposed downstream to the primary transfer backup roller 51Y in the moving direction of the intermediate transfer section 40.

The intermediate transfer section squeeze device 52Y is provided as a means for removing the surplus insulating liquid overflowing from the intermediate transfer section 40 when the liquid developer transferred onto the intermediate transfer section 40 is not in a desirable dispersion state.

The intermediate transfer section squeeze device 52Y includes an intermediate transfer section squeeze roller 53Y, an intermediate transfer section squeeze backup roller 54Y disposed to face the intermediate transfer section squeeze roller 53Y with the intermediate transfer section 40 therebetween, an intermediate transfer section squeeze cleaning blade 55Y that cleans the surface of the intermediate transfer section squeeze device 52Y while making pressing contact with the intermediate transfer section squeeze roller 53Y, and a developer collecting section 15M.

The intermediate transfer section squeeze device 52Y has a function of collecting the surplus carrier overflowing from the developer primarily transferred onto the intermediate transfer section 40 and thus increasing the proportion of toner particles in the developer and collecting naturally unnecessary foggy toner particles. In the developer collecting section 15M, a collecting mechanism for collecting carriers collected by a cleaning blade 14M of a magenta-photosensitive member squeeze roller disposed downstream in the moving direction of the intermediate transfer section 40 is also used for the intermediate transfer section squeeze cleaning blade 55Y of the intermediate transfer section squeeze roller 53Y. In this manner, in the developer collecting sections 15M, 15C, and 15K corresponding to a second or subsequent color of the image carrying member squeeze device; the collecting mechanism is also used as the developer collecting section of the intermediate transfer section squeeze devices 52Y, 52M, and 52C disposed downstream to the primary transfer backup rollers 51Y, 51M, and 51C corresponding to a previous color in the moving direction of the intermediate transfer section 40. Accordingly, it is possible to maintain the gaps therebetween at constant and thus to simplify the structure, thereby enabling to decrease the overall size of the apparatus.

In the secondary transfer unit 60, a secondary transfer roller 61 is disposed to face the belt drive roller 41 with the intermediate transfer section 40 disposed therebetween. The secondary transfer unit 60 includes a cleaning device having a cleaning blade 62 of the secondary transfer roller 61 and a developer collecting section 63.

In synchronization with the arrival timing at which the intermediate transfer image formed on the intermediate transfer section 40 with colors overlapping with each other arrives at the transfer position of the secondary transfer unit 60, the recording medium F5 is transported and supplied to the secondary transfer unit 60, and the intermediate transfer image is secondarily transferred onto the recording medium F5.

The toner image (transfer image) F5*a* transferred onto the recording medium F5 by the secondary transfer unit 60 is transported to a fixing section F40 to be described later and is subjected to a fixing process.

The cleaning blade 62 has a function of scraping and removing the liquid developer adhering on the secondary transfer roller 61 after the image is transferred onto the recording medium F5 by the secondary transfer roller 61. The liquid developer adhering onto the secondary transfer roller 61 usually has lots of solid components, and it is thus difficult to remove the liquid developer in the solid state. However, by using the liquid developer as described above, the liquid developer adhering onto the secondary transfer roller 61 can be securely removed by the cleaning blade 62.

The developer collecting section 63 has a function of collecting the liquid developer removed by the cleaning blade 62.

Next, the developing units 100Y, 100M, 100C, and 100K will be described in detail. In the following descriptions, only the developing unit 100Y will be described.

The developing unit 100Y includes, as shown in FIG. 3, a liquid developer storage section 31Y, a coating roller 32Y, a regulating blade 33Y, a developer mixing roller 34Y, a developing roller 20Y, a developing roller cleaning blade 21Y, and a developer pressurizing roller (pressurizing means) 22Y.

The liquid developer storage section 31Y has a function of storing a liquid developer for developing the latent image formed on the photosensitive member 10Y.

The coating roller 32Y has a function of supplying the liquid developer to the developing roller 20Y.

The coating roller 32Y is, as shown in FIG. 4, an anilox roller made of a metal material, such as iron, and having a diameter of about 25 mm, in which grooves 32Ya are uniformly formed on the surface in a spiral shape and nickel plating is performed thereon. In the present embodiment, as shown in FIG. 4, a plurality of grooves 32Ya are formed with an inclination to the rotating direction D2 of the coating roller 32Y by means of a cutting process or a rolling process.

The coating roller 32Y carries the liquid developer in the liquid developer storage section 31Y to the grooves 32Ya to be contained therein by making contact with the liquid developer while rotating in the clockwise direction and transports the liquid developer carried therein to the developing roller 20Y. Therefore, the coating roller 32Y can coat the developing roller 20Y with the liquid developer corresponding to the widths of the grooves 32Ya in the X direction.

In this case, the groove pitch (the gap between two lands forming one of the grooves 32Ya in the X direction in FIG. 5) is desirably in the range of 55 and 250 μm depending on a desired thickness of the liquid developer layer. In the present embodiment, the coating roller 32Y is constructed such that the groove pitch P is about 80 μm, the width of the land is about 40 μm, the upper width PI1 of the groove 32Ya is about 50 μm, the bottom width PI2 of the groove 32Ya is about 30 μm, the depth He of the groove 32Ya is about 20 μm, and the height Hc of the land 32Yb is about 30 μm. Also, a slope portion SL is formed with a modest inclination from the central portion of the land 32Yb toward the bottom portion of the groove 32Ya. In addition, in the present embodiment, the surface roughness R1*a* of the land portions 32Yb is set to about 1.0 μm, and the surface roughness R2*a* of the groove portions 32Ya is set to about 1.0 μm.

The regulating blade 33Y regulates the amount of the liquid developer D on the coating roller 32Y while making contact with the surface of the coating roller 32Y. That is, the regulating blade 33Y accomplishes a function of scraping the surplus liquid developer on the coating roller 32Y and thus metering the liquid developer D on the coating roller 32Y to be supplied to the developing roller 20Y. The regulating blade 33Y is made of a urethane rubber as an elastomer, and is supported by a regulating blade supporting member made of a metal material such as iron. Incidentally, the regulating blade 33Y is disposed in a side (in the left side of FIG. 3 when viewed from a vertical plane A described above) at which the coating roller 32Y departs from the liquid developer D while rotating, when viewed from the vertical plane A. The rubber hardness of the regulating blade 33Y is about 77 degrees based on JIS-A measurement. Moreover, the hardness (about 77 degrees) of a portion of the regulating blade 33Y making contact with the surface of the coating blade 32Y is set smaller than the hardness (about 85 degrees) of a portion of the elastomer layer of the developing roller 20Y described later making pressing contact with the surface of the coating roller 32Y.

The developer mixing roller 34Y has a function of mixing the liquid developer in a uniformly dispersed manner. With such a configuration, it is possible to disperse a plurality of toner particles 1 in a suitable manner even when they are coagulated with each other. In particular, by employing the liquid developer as described above, the toner particles 1 can be dispersed in an easy and secure manner. Even when the liquid developer once used is recycled, the toner particles 1 can be suitably dispersed.

In the liquid developer storage section 31Y, the toner particles in the liquid developer are charged positively, and the liquid developer is mixed by means of the developer mixing roller 34Y in a uniformly dispersed manner. With the rotation of the coating roller 32Y, the liquid developer is drawn from the liquid developer storage section 31Y and supplied to the developing roller 20Y with the amount of the liquid developer being regulated by the regulating blade 33Y.

The developing roller 20Y carries and transports the liquid developer to a development position opposite the photosensitive member 10Y in order to develop the latent image carried onto the photosensitive member 10Y with the liquid developer.

The developing roller 20Y is supplied with the liquid developer from the coating roller 32Y described above, and a liquid developer layer 201Y is formed on the surface of the developing roller 20Y.

The developing roller 20Y has a conductive elastomer layer in the peripheral portion of an inner shaft thereof made of a metal material such as iron, and the diameter thereof is about 20 mm. The elastomer layer has a two-layered structure in which the inner layer is made of an urethane rubber with a thickness of about 5 mm and having a rubber hardness of about 30 degrees based on JIS-A measurement, and the surface layer (outer layer) is made of an urethane rubber with a thickness of about 30 μm and having a rubber hardness of about 85 degrees based on JIS-A measurement. The surface layer of the developing roller 20Y functions as a pressing contact portion that makes pressing contact with the coating roller 32Y and the photosensitive member 10Y in an elastically deformed manner.

The developing roller 20Y can rotate about the center axis thereof, and the center axis is disposed below the center of the rotating axis of the photosensitive member 10Y. The developing roller 20Y rotates in a direction (in the counterclockwise direction in FIG. 3) opposite to the rotating direction (in the clockwise direction in FIG. 3) of the photosensitive member 10Y. When developing the latent image formed on the photosensitive member 10Y, electric field is formed between the developing roller 20Y and the photosensitive member 10Y.

The developer pressurizing roller 22Y is a device having a function of pressurizing the toner particles in the liquid developer carried and formed onto the developing roller 20Y. In other words, the developer pressurizing roller 22Y is a device having a function of applying electric field with the same polarity as the toner particles 1 to the liquid developer layer 201Y as described above and distributing the toner particles 1 over the liquid developer layer 201Y so that the toner particles 1 are maldistributed toward the vicinity of the surface of the developing roller 20Y. Such maldistribution of the toner particles contributes to the improvement in the development concentration (development efficiency), and thus it is possible to obtain a clear and high-quality image.

The developer pressurizing roller 22Y includes a cleaning blade 23Y.

The cleaning blade 23Y has a function of removing the liquid developer adhering onto the developer pressurizing roller 22Y.

The developing unit 100Y includes a developing roller cleaning blade 21Y made of a rubber material making contact with the surface of the developing roller 20Y. The developing roller cleaning blade 21Y is a device for scraping and removing the liquid developer remaining on the developing roller 20Y after a developing process is performed at the development position. The liquid developer removed by the developing roller cleaning blade 21Y is collected into the liquid developer storage section 31Y for later recycling.

Meanwhile, the toner particles 1 maldistributed in the vicinity of the surface of the developing roller 20Y by the developer pressurizing roller 22Y are in the coagulated state. In this case, however, by employing the liquid developer with the toner particles 1 having a small particle size distribution as described above, the liquid developer adhering onto the developing roller 20Y and the developer pressurizing roller 22Y can be easily collected even when the toner particles 1 are in the coagulated state. Moreover, since the collected toner particles 1 in the coagulated state can be uniformly dispersed, the toner particles 1 can be suitably recycled. This is believed to be attributable to the fact that an insulating liquid having a sufficient insulating property can be present between the toner particles 1 so that the toner particles can be re-dispersed easily.

As shown in FIGS. 2 and 3, the image forming apparatus 1000 includes liquid developer supplying sections 80Y, 80M, 80C, and 80K that supply the liquid developer and the insulating liquid to the developing section 30Y. Since the liquid developer supplying sections 80Y, 80M, 80C, and 80K have the same configuration, only the configuration of the liquid developer supplying section 80Y will be describe.

The liquid developer supplying section 80Y includes a supplemental insulating liquid storage section 81Y, a supplemental liquid developer storage section 82Y, and transporting means 83Y and 84Y.

The supplemental insulating liquid storage section 81Y mainly stores the insulating liquid, and supplies the insulating liquid to the liquid developer storage section 31Y of the developing section 30Y by means of the transporting means 83Y. The supplemental liquid developer storage section 82Y stores the liquid developer, and supplies the liquid developer to the liquid developer storage section 31Y by means of the transporting means 84Y. The composition of the liquid developer stored in the supplemental liquid developer storage section 82Y may be the same as or different from that of the liquid developer stored in the liquid developer storage section 31Y. For example, the liquid developer stored in the supplemental liquid developer storage section 82Y may contain a relatively large amount of solid components in order to easily adjust the amount of solid components in the liquid developer to be stored in the liquid developer storage section 31Y. That is, by supplying an appropriate proportion of the liquid developer containing the solid components and an appropriate proportion of the insulating liquid, it is possible to easily adjust the amount of solid components in the liquid developer to be stored in the liquid developer storage section 31Y.

The image forming apparatus 1000 includes a recycling device for recycling the insulating liquid in the liquid developer collected into the developer collecting sections 15, 18, 47, and 63.

The recycling device includes a transport passage 70 along which the liquid developer collected from the developer collecting sections is transported, a filtering means 77 for removing solid components (toner particles, for example) from the liquid developer transported thereto, an insulating liquid storage section 74 for storing the insulating liquid remaining after the solid components are removed by the filtering means 77, and a transporting means 78 for supplying the insulating liquid stored in the insulating liquid storage section 74 to the respective supplemental insulating liquid storage sections of the liquid developer supplying sections 80Y, 80M, 80C, and 80K.

A pump 76 is disposed in the transport passage 70, and the liquid developer collected into the developer collecting sections is transported to the insulating liquid storage section 74 by the pump 76.

The insulating liquid stored in the insulating liquid storage section 74 is appropriately transported to the supplemental insulating liquid storage sections by the transporting means 78 for later recycling.

The solid components removed by the filtering means 77 are detected by means of a detecting means (not shown) configured as a filter. The filtering means 77 is replaced based on the detection result. Accordingly, a stable filtering function of the filtering means 77 can be maintained. Incidentally, the liquid developer of the invention includes toner particles having a small particle size distribution and contains little microparticles. For this reason, the solid components can be securely removed by the filtering means 77, and thus it is possible to decrease the amount of solid component, particularly microparticles in the insulating liquid to be stored in the insulating liquid storage section 74. Accordingly, deterioration of the insulating liquid due to recycling can be reduced, and thus it is possible to recycle the insulating liquid in an appropriate manner.

Hereinafter, a fixing section will be described.

The fixing section F40 is to fix an unfixed toner image F5*a* which has been formed on the above-described developing section, transferring section or the like, onto the recording medium F5.

The fixing section F40 has, as described in FIG. 7, a heat fixing roller F1, a pressurizing roller F2, a heat-resistant belt F3, a belt stretching member F4, a cleaning member F6, a frame F7, and a spring F9.

The heat fixing roller (fixing roller) F1 has a roller base F1*b* composed of a pipe material, an elastic body F1*c* coating the outer periphery, and a cylindrically shaped halogen lamp F1*a* inside the roller base F1*b* as a heating source, and the heat fixing roller F1 can rotate in the counterclockwise direction as indicated with an arrow in the drawing.

There are two cylindrical halogen lamps F1*a* and F1*a* which constitute a heat source built in the inside of the heat fixing roller F1, and the heat generating elements of these cylindrical halogen lamps F1*a* and F1*a* are disposed at different sites. As each of the cylindrical halogen lamps F1*a* and F1*a* is selectively turned on, it is set up such that the temperature controller is easily operated under the condition in which the fixing nip site where the heat-resistant belt F3 to be described later is wound around the heat fixing roller F1 is different from the site where the belt stretching member F4 to be described later is in contact with the heat fixing roller F1, or under the condition in which the respective widths of the recording media used are different from each other, or the like.

The pressurizing roller F2 is disposed to face the heat fixing roller F1, and is operable to apply pressure to the recording medium F5 where an unfixed toner image F5*a* has been formed, via the heat-resistant belt F3 to be described later.

The pressurizing roller F2 has a roller base F2*b* composed of a pipe material, and an elastic body F2*c* coating the outer periphery, and the pressurizing roller F2 can rotate in the clockwise direction as indicated with an arrow in the drawing.

A PFA layer is disposed on the surface layer of the elastic body F1*c* of the heat fixing roller F1. Thus, although the respective thicknesses of the elastic bodies F1*c* and F2*c* are different from each other, the two elastic bodies F1*c* and F2*c* undergo approximately uniform elastic deformation, and a so-called horizontal nip is formed. Also, since there is no difference in the transport speed of the heat-resistant belt F3 which will be described later, or of the recording medium F5, with respect to the circumferential velocity of the heat fixing roller F1, extremely stable image fixation is made possible.

The heat-resistant belt F3 is a belt having a shape of endless circle which is pressed between the heat fixing roller F1 and the pressurizing roller F2, and is enabled to move while being lined along the outer peripheries of the pressurizing roller F2 and the belt stretching member F4.

This heat-resistant belt F3 has a thickness of 0.03 mm or larger, and is formed into a seamless tube consisting of two layers, such as its surface (the surface of the side contacting with the recording medium F5) formed of PFA, and the opposite side (the surface of the side contacting with the pressurizing roller F2 and the belt stretching member F4) formed of polyimide. In addition, the heat-resistant belt F3 is not limited thereto, and may also be formed of other materials, such as into a metal tube such as a stainless steel tube, an electroformed nickel tube or the like, a heat resistant resin tube such as a silicone tube or the like.

The belt stretching member F4 is disposed upstream to the fixing nip portion of the heat fixing roller F1 and the pressurizing roller F2 in the recording medium F5 transporting direction, and at the same time, is disposed to be able to oscillate about the rotating axis F2*a* of the pressurizing roller F2 in the direction of the arrow P.

The belt stretching member F4 is constituted to stretch the heat-resistant belt F3 in the tangential direction of the heat fixing roller F1, in a state where the recording medium F5 does not pass through the fixing nip portion. If the fixing pressure is large at the initial position where the recording medium F5 enters the fixing nip portion, the entry is not made smoothly, and in some cases, the recording medium F5 may be fixed with its front end being folded. However, with the configuration of stretching the heat-resistant belt F3 in the tangential direction of the heat fixing roller F1 as such, a feed port portion for the recording medium F5 where the entry of the recording medium F5 is made smooth can be formed, thereby it being possible to make stable entry of the recording medium F5 into the fixing nip portion.

The belt stretching member F4 is an approximately half-moon shaped belt sliding member (the heat-resistant belt F3 slides on the belt stretching member F4) which is inserted to fit with the inner periphery of the heat-resistant belt F3 and cooperates with the pressurizing roller F2 to impart tension f to the heat-resistant belt F3. This belt stretching member F4 is disposed at a position where the heat-resistant belt F3 is wound around the heat fixing roller F1 from the tangential line L of the pressing portion between the heat fixing roller F1 and the pressurizing roller F2 to form a nip. A protruding wall F4*a* is protruded from at one edge or at both edges in the axial direction of the belt stretching member F4, and this protruding wall F4*a* is to prevent swaying of the heat-resistant belt F3 to a side by allowing this heat-resistant belt F3 to come into contact with this protruding wall F4*a*, when the heat-resistant belt F3 is swayed to one side of the axial direction edges. A spring F9 is built in between the edge portion of the protruding wall F4*a* on the side opposite to the heat fixing roller F1 and the frame, so that the protruding wall F4*a* of the belt stretching member F4 lightly presses against the heat fixing roller F1, and the belt stretching member F4 is in sliding contact with the heat fixing roller F1 to be positioned.

The position at which the belt stretching member F4 is slightly pressed against the heat fixing roller F1 is considered as the nip initial position, and the position where the pressurizing roller F2 is pressed against the heat fixing roller F1 is considered as the nip end position.

In the fixing section F40, the recording medium F5 on which an unfixed toner image F5*a* has been formed enters the fixing nip portion at the nip initial position, passes through between the heat-resistant belt F3 and the heat fixing roller F1, and leaves through the nip end position, so that the unfixed toner image F5*a* formed on the recording medium F5 is thermally fixed, and then the recording medium F5 is discharged in the tangential direction L of the pressing portion of the pressurizing roller F2 against the heat fixing roller F1.

The cleaning member F6 is disposed between the pressurizing roller F2 and the belt stretching member F4.

This cleaning member F6 is in sliding contact with the inner circumferential surface of the heat-resistant belt F3 to clean any foreign materials, abrasion powder or the like on the inner circumferential surface of the heat-resistant belt F3. By cleaning the foreign materials, abrasion powder or the like as such, the heat-resistant belt F3 is refreshed so that a factor for the instability of friction coefficient as described above is removed. Also, a depressed portion F4*f* is disposed on the belt stretching member F4, and is configured to accept the foreign materials, abrasion powder or the like removed from the heat-resistant belt F3.

Additionally, the fixing apparatus F40 include a removing blade F12 (removing means) to remove insulating liquid remaining on the surface of the heat fixing roller F1 after fixing the toner image F5*a* on the recording medium F5. The removing blade F12 is able to remove the insulating liquid and the toner and the like staining the heat fixing roller F1 upon fixation.

In addition, in order to stably drive the heat-resistant belt F3 with the pressurizing roller F2 by stretching using the pressurizing roller F2 and the belt stretching member F4, it is preferable to set the friction coefficient between the pressurizing roller F2 and the heat-resistant belt F3 to be larger than the friction coefficient between the belt stretching member F4 and the heat-resistant belt F3. However, the friction coefficient may become unstable because of intrusion of any foreign material between the heat-resistant belt F3 and the pressurizing roller F2 or between the heat-resistant belt F3 and the belt stretching member F4, or because of abrasion of the portion of the heat-resistant belt F3 contacting with the pressurizing roller F2 and the belt stretching member F4, or the like.

There, it is set up such that the contact angle between the belt stretching member F4 and the heat-resistant belt F3 is smaller than the contact angle between the pressurizing roller F2 and the heat-resistant belt F3, and such that the diameter of the belt stretching member F4 is smaller than the diameter of the pressurizing roller F2. Then, the length of the heat-resistant belt F3 sliding on the belt stretching member F4 is shortened, thus making it possible to avoid the destabilizing factors with respect to changes over time, disturbances or the like, and the heat-resistant belt F3 can be stably driven by the pressurizing roller F2.

The heat to be added by the heat fixing roller F1 (fixing temperature) is specifically preferably 80 to 200° C., and more preferably 100 to 180° C.

Second Embodiment

Hereinafter, a second embodiment of the image forming apparatus according to the invention will be described.

Figure 8:
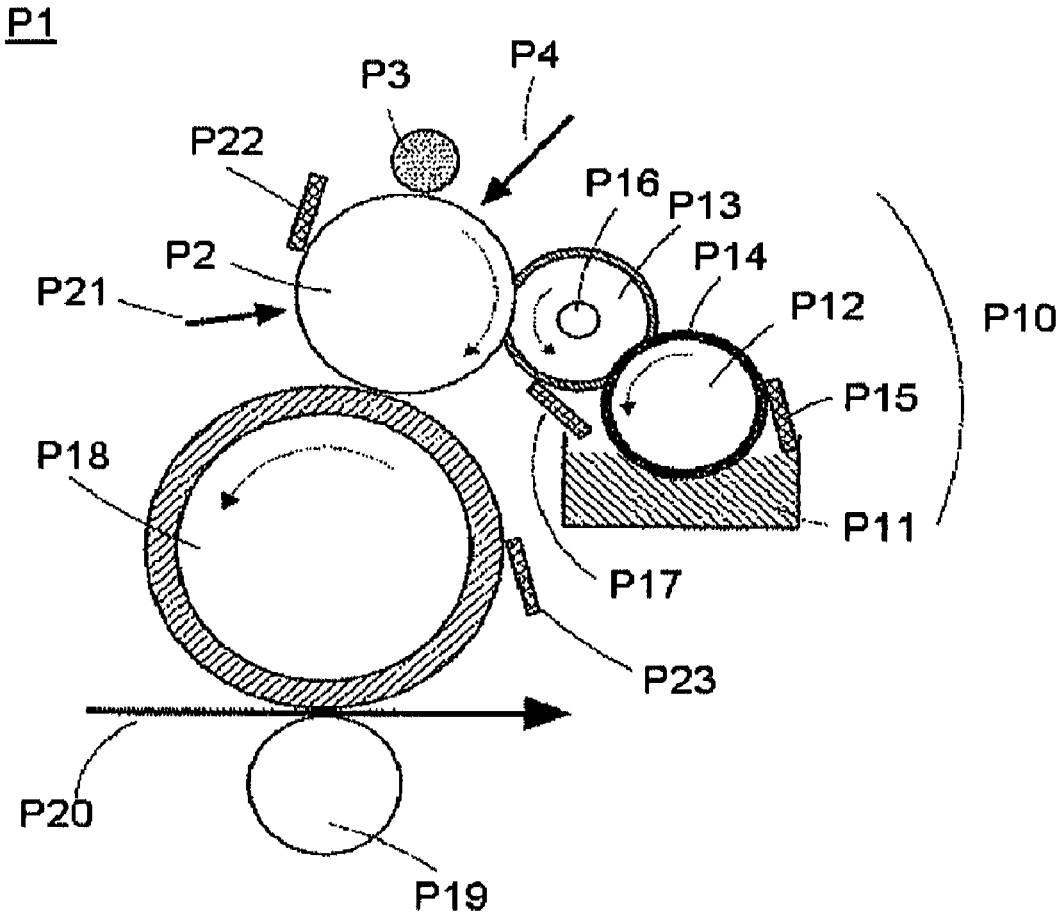
FIG. 8 is a sectional view illustrating an example of a contact-type image forming apparatus according to an embodiment of the invention.
Figure 9:
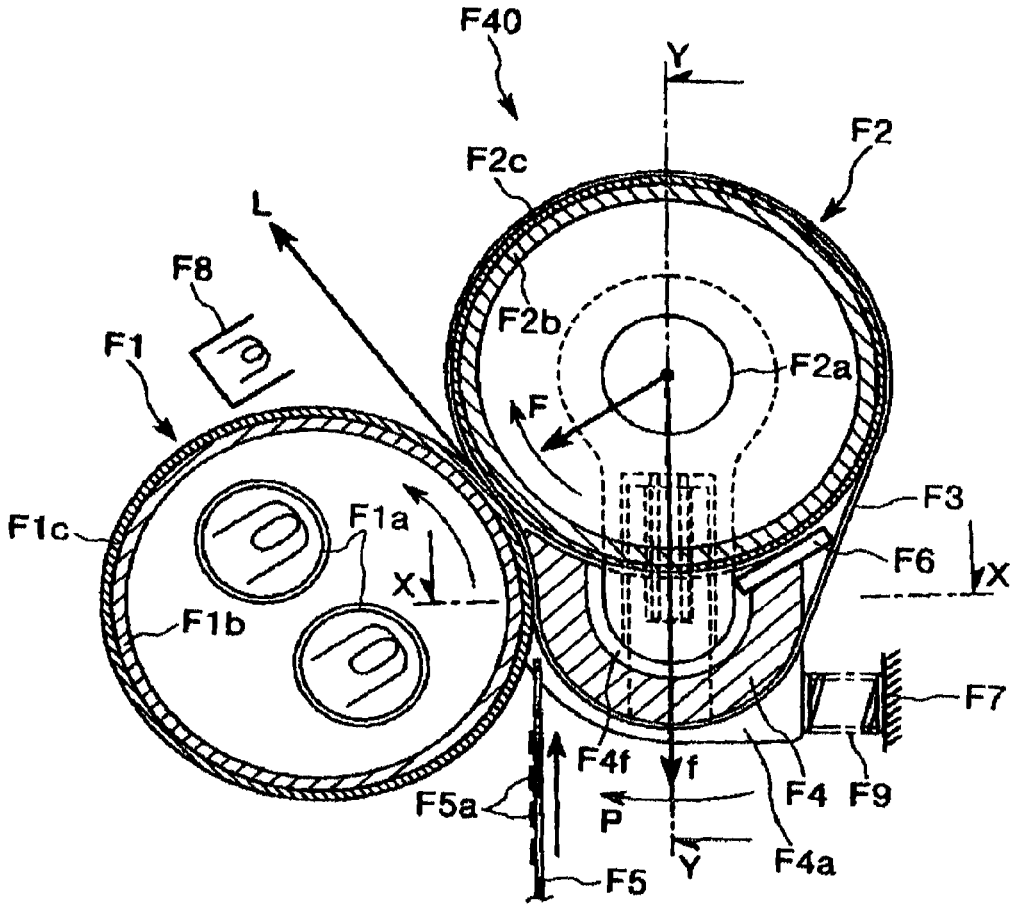
FIG. 9 is a sectional view illustrating an example of a fixing device of the image forming apparatus according to an embodiment of the invention.

FIG. 8 illustrates an example of image forming apparatus according to the invention, and FIG. 9 is a sectional view of a fixing device (the fixing section) belonging to the image forming apparatus as shown in FIG. 8. Additionally, the image forming apparatus is illustrated by omitting the fixing device in FIG. 8. In the image forming apparatus P1, the photosensitive member P2 is uniformly charged on the surface by an electric charger P3 made of epichlorohydrin rubber and the like with a cylindrically shaped drum of photosensitive member P2, and then exposure P4 corresponding to the information to be recorded is performed by means of a laser diode or the like, thereby an electrostatic latent image being formed.

The developing machine P10 has a coating roller P12 and a developing roller P13, which have their parts immersed in the developer vessel P11. The coating roller P12 is, for example, a gravure roller made of metallic material, and the coating roller P12 rotates facing the developing roller P13. The coating roller P12 also has a liquid developer coating layer P14 formed on the surface, and the thickness is maintained constant by a metering blade P15.

The liquid developer is transferred from the coating roller P12 to the developing roller P13. The developing roller P13 consists of a low-hardness silicone rubber layer on a roller core P16 made of metal such as stainless steel or the like, and a fluororesin layer composed of electroconductive PFA (polytetrafluoroethylene-perfluorovinyl ether copolymer) or the like is formed on the outermost layer. The developing roller P13 rotates at the same speed as that of the photosensitive member P2 to transfer the liquid developer to a latent image portion. The liquid developer remaining on the developing roller P13 after the transfer to the photosensitive member P2 is removed by a developing roller cleaning blade P17 and recovered into the developer vessel P11.

Also, after the transfer of a toner image from the photosensitive member P2 to the intermediate transfer roller P18, the photosensitive member P2 is removed of charge by a charge removing light P21, and at the same time, the after-transfer toner remaining on the photosensitive member P2 is removed by a cleaning blade P22 composed of urethane rubber or the like.

Likewise, after the transfer from the intermediate transfer roller P18 to an information recording medium P20, the after-transfer toner remaining on the intermediate transfer roller P18 is removed by a cleaning blade P23 composed of urethane rubber or the like.

The toner image formed on the photosensitive member P2 is first transferred to the intermediate transfer roller P18, and then a transfer current is allowed to flow through a secondary transfer roller P19 so that the image is transferred onto the information recording medium P20, which may be a sheet of paper passing between the two. Thereafter, the toner image transferred onto the information recording medium P20 such as paper is fixed by using the fixing device as shown in FIG. 2. Additionally, the image formation using a unicolored liquid developer has been described, but it is also possible to form a color image combining the images corresponding to the colors formed by using a multi-colored developing machine, respectively, when using multi-colored toners.

FIG. 9 is a sectional view of a fixing device (fixing section) of the image forming apparatus according to an embodiment. As shown in FIG. 9, the fixing apparatus F40 has a heat fixing roller F1 (hereinafter, it is also referred to as heat roll), a pressurizing roller F2, a heat-resistant belt F3, a belt stretching member F4, a cleaning member F6.

The heat fixing roller (fixing roller) F1 has a roller substrate F1*b* composed of a pipe material having an outer diameter of about 25 mm and a thickness of about 0.7 mm, an elastic body F1*c* having a thickness of 0.4 mm coating the outer periphery, and twin cylindrically shaped halogen lamps F1*a* of 1,050 W inside the roller base F1*b* as a heating source, and the heat fixing roller can rotate in the counterclockwise direction as indicated with an arrow in the drawing. The pressurizing roller F2 has a roller substrate F2*b* composed of a pipe material having an outer diameter of about 25 mm and a thickness of about 0.7 mm, an elastic body F2*c* having a thickness of 0.2 mm coating the outer periphery. The pressurizing roller F2 has a configuration that a contact pressure between the heat fixing roller F1 and the pressurizing roller F2 is set to 10 kg or less, and the nip length is 10 mm. Additionally, the pressurizing roller F2 is disposed to face the heat fixing roller F1, and can rotate in the clockwise direction as indicated with an arrow in the drawing.

Accordingly, since the outer diameter of the heat fixing roller F1 and the pressurizing roller F2 is configured as a small diameter of about 25 mm, a sheet material F5 after fixation does not wind around the heat fixing roller F1 and the heat-resistant belt F3, so that means for forcibly removing the sheet material is not necessary. Additionally, the PFA layer of 30 μm is provided on the surface of the elastic body F1*c* of the heat fixing roller F1, thereby improving rigidity. Thus, although the respective thicknesses of the elastic bodies F1*c* and F2*c* are different, the two elastic bodies F1*c* and F2*c* undergo approximately uniform elastic deformation, and a so-called horizontal nip is formed. Also, since there is no difference in the transport speed of the heat-resistant belt F3 which will be described later, or of the sheet material F5, with respect to the circumferential velocity of the heat fixing roller F1, extremely stable image fixation is made possible.

There are two cylindrical halogen lamps F1*a* and F1*a* which constitute a heat source built in the inside of the heat fixing roller F1, and the heat generating elements of these cylindrical halogen lamps F1*a* and F1*a* are disposed at different sites. As each of the cylindrical halogen lamps F1*a* and F1*a* is selectively turned on, it is set up such that the temperature controller is easily operated under the condition in which the fixing nip site where the heat-resistant belt F3 is wound around the heat fixing roller F1 is different from the site where the belt stretching member F4 is in contact with the heat fixing roller F1, or under the condition in which a wide sheet material and a narrow sheet material are different, or the like.

The heat-resistant belt F3 is a belt having a shape of endless circle which is pressed between the heat fixing roller F1 and the pressurizing roller F2, and is enabled to move while being lined along the outer peripheries of the pressurizing roller F2 and the belt stretching member F4. This heat-resistant belt F3 has a thickness of 0.03 mm or larger, and is formed into a seamless tube consisting of two layers, such as its surface (the surface of the side contacting with the sheet material F5)

formed of PFA, and the opposite side (the surface of the side contacting with the pressurizing roller F2 and the belt stretching member F4) formed of polyimide. In addition, the heat-resistant belt F3 is not limited thereto, and may also be formed of other materials, such as into a metal tube such as a stainless steel tube, an electroformed nickel tube or the like, a heat resistant resin tube such as a silicone tube or the like.

The belt stretching member F4 is disposed upstream to the fixing nip portion of the heat fixing roller F1 and the pressurizing roller F2 in the sheet material F5 transporting direction, and at the same time, is disposed to be able to oscillate about the rotating axis F2*a* of the pressurizing roller F2 in the direction of the arrow P. The belt stretching member F4 is constituted to stretch the heat-resistant belt F3 in the tangential direction of the heat fixing roller F1, in a state where the sheet material F5 does not pass through the fixing nip portion. If the fixing pressure is large at the initial position where the sheet material F5 enters the fixing nip portion, the entry is not made smoothly, and in some cases, the sheet material F5 may be fixed with its front end being folded. However, with the configuration of stretching the heat-resistant belt F3 in the tangential direction of the heat fixing roller F1 as such, a feed port portion for the recording medium where the entry of the sheet material F5 is made smooth can be formed, thereby it being possible to make stable entry of the sheet material F5 into the fixing nip portion.

The belt stretching member F4 is an approximately half-moon shaped belt sliding member (the heat-resistant belt F3 slides on the belt stretching member F4) which is inserted to fit with the inner periphery of the heat-resistant belt F3 and cooperates with the pressurizing roller F2 to impart tension f to the heat-resistant belt F3. This belt stretching member F4 is disposed at a position where the heat-resistant belt F3 is wound around the heat fixing roller F1 from the tangential line L of the pressing portion between the heat fixing roller F1 and the pressurizing roller F2 to form a nip. A protruding wall F4*a* is protruded from at one edge or at both edges in the axial direction of the belt stretching member F4, and this protruding wall F4*a* is to prevent swaying of the heat-resistant belt F3 to a side by allowing this heat-resistant belt F3 to come into contact with this protruding wall F4*a*, when the heat-resistant belt F3 is swayed to one side of the axial direction edges. A spring F9 is built in between the edge portion of the protruding wall F4*a* on the side opposite to the heat fixing roller F1 and the frame F7, so that the protruding wall F4*a* of the belt stretching member F4 lightly presses against the heat fixing roller F1, and the belt stretching member F4 is in sliding contact with the heat fixing roller F1 to be positioned.

In order to stably drive the heat-resistant belt F3 with the pressurizing roller F2 by stretching using the pressurizing roller F2 and the belt stretching member F4, it is preferable to set the friction coefficient between the pressurizing roller F2 and the heat-resistant belt F3 to be larger than the friction coefficient between the belt stretching member F4 and the heat-resistant belt F3. However, the friction coefficient may become unstable because of intrusion of any foreign material between the heat-resistant belt F3 and the pressurizing roller F2 or between the heat-resistant belt F3 and the belt stretching member F4, or because of abrasion of the portion of the heat-resistant belt F3 contacting with the pressurizing roller F2 and the belt stretching member F4, or the like.

There, it is set up such that the contact angle between the belt stretching member F4 and the heat-resistant belt F3 is smaller than the contact angle between the pressurizing roller F2 and the heat-resistant belt F3, and such that the diameter of the belt stretching member F4 is smaller than the diameter of the pressurizing roller F2. Then, the length of the heat-resistant belt F3 sliding on the belt stretching member F4 is shortened, thus making it possible to avoid the destabilizing factors with respect to changes over timer disturbances or the like, and the heat-resistant belt F3 can be stably driven by the pressurizing roller F2.

In addition, the cleaning member F6 is disposed between the pressurizing roller F2 and the belt stretching member F4. This cleaning member F5 is in sliding contact with the inner circumferential surface of the heat-resistant belt F3 to clean any foreign materials, abrasion powder or the like on the inner circumferential surface of the heat-resistant belt F3'. By cleaning the foreign materials, abrasion powder or the like as such, the heat-resistant belt F3 is refreshed so that a factor for the instability of friction coefficient as described above is eliminated. Also, a depressed portion F4*f* is disposed on the belt stretching member F4, and is configured to accept the foreign materials, abrasion powder or the like removed from the heat-resistant belt F3.

The position at which the belt stretching member F4 is slightly pressed against the heat fixing roller F1 is considered as the nip initial position, and the position where the pressurizing roller F2 is pressed against the heat fixing roller F1 is considered as the nip end position. The sheet material F5 on which an unfixed toner image F5*a* has been formed enters the fixing nip portion at the nip initial position, passes through between the heat-resistant belt F3 and the heat fixing roller F1, and leaves through the nip end position, so that the unfixed toner image F5*a* formed on the sheet material F5 is thermally fixed, and then the sheet material F5 is discharged in the tangential direction L of the pressing portion of the pressurizing roller F2 against the heat fixing roller F1.

When fixing the unfixed toner images, the fixing temperature is preferably 100 to 200° C., and more preferably 100 to 180° C. If this fixing temperature has a value within the above-mentioned range, in the case where those as described above are contained as the antioxidant, decomposition of the antioxidant becomes easier, and the intensity of fixation of the toner particles can be more effectively improved. If this fixing temperature has also a value within the above-mentioned range, the oxidative polymerization reaction of the unsaturated fatty acid component can proceed more effectively. In the case where an oxidative polymerization promoter is contained in the liquid developer, this tendency is more notably manifested.

Additionally, it is also preferable to install the device as the ultraviolet irradiator F8 for irradiating ultraviolet upon the surface where the toner image of the discharged sheet material F5 is formed.

By heating the unfixed toner images on the recording medium by the heat fixing roller and irradiating ultraviolet radiation, the unsaturated fatty acid component absorbed into the recording medium firmly undergoes the oxidative polymerization, thereby being capable of contributing to the fixation. With such configuration, the absorbed unsaturated fatty acid component contained in the insulating liquid is solidified by heat and ultraviolet irradiation and causes anchor effect, so that the toner particles can be more firmly fixed onto the recording medium. In addition, since the ultraviolet irradiation allows firm fixation of the toner particles onto the recording medium even without heating to a particularly high temperature by the heat fixing roller F1, the toner particles can be more firmly fixed to the recording medium as well. Moreover, since large amounts of heat energy are not needed for the fixing process, even if the time for passing through the fixing nip portion is relatively short, the toner particles can be satisfactorily fixed onto the recording medium by the ultraviolet irradiation. That is, because fixation is not time-consuming, further enhancement of printing speed can be attempted. Moreover, since fixation does not require large amounts of heat energy, energy saving can be attempted. As a result, an environmentally friendly fixing process can be performed.

Third Embodiment

Hereinafter, a third embodiment of the image forming apparatus according to the invention will be described.

Figure 10:
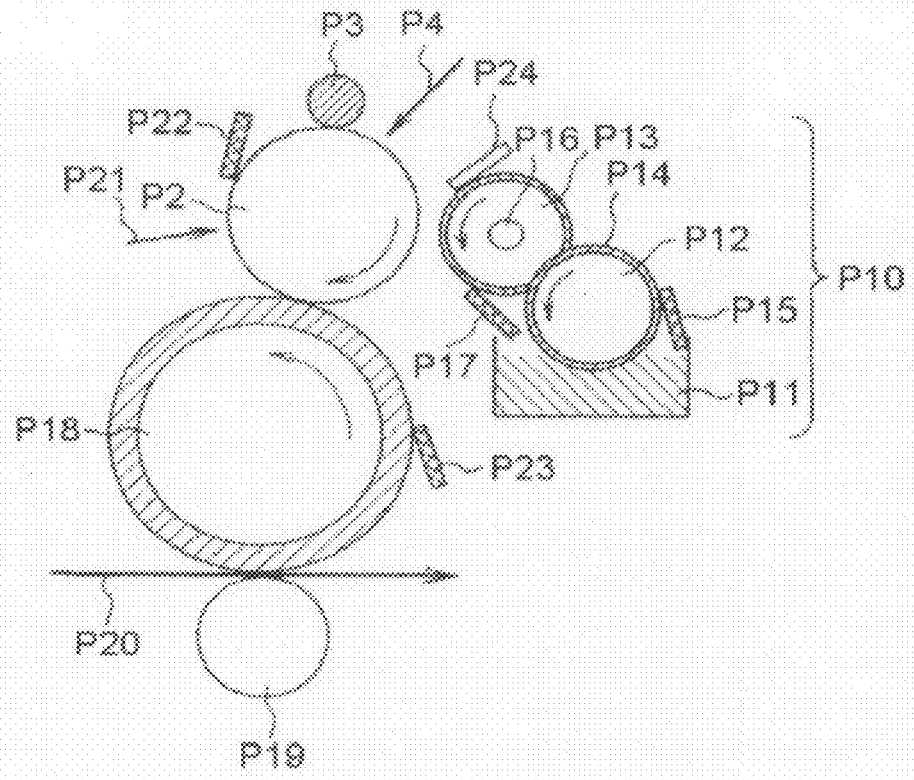
FIG. 10 is a sectional view illustrating an example of a non-contact type image forming apparatus according to an embodiment of the invention.

FIG. 10 is a diagram illustrating an exemplary non-contact type image forming apparatus. In the non-contact mode, a charging blade P24 constituted of a phosphor-bronze plate having a thickness of 0.5 mm is mounted on the developing roller P13. The charging blade p24 has a function of charging by friction by contacting with the liquid developer layer. At the same time, since the coating roller P12 is a gravure roller, and a developer layer corresponding to the irregularities of the gravure roller surface is formed on the developing roller P13, the charging blade P24 is to accomplish a function of averaging the irregularities uniformly. Thus, the charging blade P24 may be arranged in a counter direction to the rotating direction of the developing roller, or in a trailing direction, and may have a roller shape instead of a blade shape.

Also, it is preferable that an interval of 200 μm to 800 μm is disposed between the developing roller P13 and the photosensitive member P2, and at the same time, an alternating voltage of 500 to 3000 Vpp, which corresponds to a direct voltage of 200 to 800 V, having a frequency of 50 to 3000 Hz is applied between the developing roller P13 and the photosensitive member P2. Other than these, the image forming apparatus is the same as that described with reference to FIG. 8.

In the case where the image is formed by the methods and devices described above, by adding energy such as heat or ultraviolet irradiation on the unfixed toner images when fixing the unfixed toner images, the unsaturated fatty acid glyceride adhering to surface of the toner particles undergoes the oxidative polymerization, so that the insulating liquid between toners undergoes solidification reaction. As a result, the toner images having excellent fixation intensity and particularly excellent image resolution can be obtained.

As such, the invention was explained on the basis of preferred embodiments, but the invention is not intended to be limited thereto.

For instance, the liquid developer of the invention is not limitedly applied to the image forming apparatus and the fixing device as described above.

Additionally, in the aforementioned embodiment of the method of preparation described above, it has been described that associated particles are obtained by obtaining an aqueous emulsion, and adding an electrolyte to the aqueous emulsion, but the present invention is not limited thereto. For example, associated particles may be prepared using an emulsion polymerization association method in which a colorant, a monomer, a surfactant and a polymerization initiator are dispersed in an aqueous liquid, an aqueous emulsion is prepared by emulsion polymerization, and an electrolyte is added to the aqueous emulsion to induce association, or alternatively, associated particles may also be obtained by, for example, spray drying the obtained aqueous emulsion.

EXAMPLES

[1] Preparation of Liquid Developer

Example 1

Preparation of Liquid Constituting Insulating Liquid

Liquid mainly containing an unsaturated fatty acid glyceride used as an insulating liquid and liquid mainly containing an unsaturated fatty acid methyl ester were prepared as described below.

First of all, crude soybean oil was purified as described below, and thus the purified soybean oil was obtained.

First, the crude soybean oil was roughly purified by low temperature crystallization in which methanol, diethyl ether, petroleum ether, acetone, and the like were used as a solvent.

Next, 300 parts by volume of the roughly purified crude soybean oil (first roughly purified oil) was introduced into a flask, and then 100 parts by volume of boiling water was poured into the flask, which was then stoppered.

Next, the flask was shaken to mix the roughly purified soybean oil (first roughly purified oil) and boiling water.

Next, the flask was left to stand until the liquid mixture in the flask underwent separation to three layers.

After confirming complete separation, the flask was transferred to a freezer and was left to stand for 24 hours.

Thereafter, unfrozen components were transferred to another flask.

These unfrozen components were repeatedly subjected to the operation described above, and the resulting unfrozen components were removed to obtain crude oil and fat (second roughly purified oil).

Next, 100 parts by volume of the crude oil and fat (second roughly purified oil) obtained as described above, and 35 parts by volume of activated white clay mainly composed of hydrated aluminum silicate were mixed and agitated in a flask.

Then, the resulting mixture was stored under pressure (0.18 MPa) for 48 hours to completely precipitate the activated white clay.

Thereafter, the soybean oil purified by removing a precipitate (hereinafter, it is simply referred to as soybean oil) was obtained. Additionally, since the soybean oil mainly contains fatty acid glyceride which contains linoleic acid as a main component, the content of unsaturated fatty acid glyceride in the soybean oil was about 98 wt %. Content of the linoleic acid component in the total fatty acid component was about 53 mol %.

Next, by causing transesterification reaction between a moiety of the soybean oil and methanol and removing the glycerin caused by the reaction, glycerin generated by this reaction was removed to obtain a liquid composed mainly of fatty acid monoesters. In addition, by purifying this liquid, a soyate fatty acid methyl ester having a content of the fatty acid monoester of about 99.9 wt % or greater was obtained. The fatty acid monoester thus obtained was mainly composed of unsaturated fatty acid monoesters such as methyl oleate, methyl linolate, methyl α-linoleate and the like, and saturated fatty acid monoesters such as methyl palmitate, methyl stearate and the like, while the content of the unsaturated fatty acid monoester therein was about 84%.

Preparation of Colorant Master Solution

First a mixture (weight ratio 50:50) of a polyester resin (softening temperature: 125° C., glass transition temperature: 60.5° C., and acid number: 7.7) and a cyan pigment (Dainichiseika Color & Chemicals Mfg. Co., Ltd., Pigment Blue 15:3) as a colorant was provided. These components were mixed using a 20 L type Henschel mixer to obtain a raw material for toner preparation.

Next, this raw material (mixture) was kneaded using a twin-screw kneading extruder. The kneading product extruded through the extrusion orifice of the twin-screw kneading extruder was cooled.

The kneading product thus cooled was subjected to coarse pulverization to obtain a powder having an average particle size of 1.0 mm or less. The coarse pulverization of the kneading product was performed using a hammer mill.

Methyl ethyl ketone was added so that the content of the solid components in the resulting powder of the kneading product became about 30% by weight, and the resultant was subjected to wet dispersion with an Aiger motor mill (Aiger US, Inc., M-1000), thus to prepare a colorant master solution.

Preparation of Resin Solution 140 parts by weight of methyl ethyl ketone and 60 parts by weight of the above-described polyester resin were added to 133 parts by weight of the colorant master solution, and the resultant was mixed with an Aiger motor mill (Aiger US, Inc., M-1000) to prepare a resin solution. In addition, the pigment was uniformly microdispersed in this solution.

Preparation of Aqueous Emulsion

In a 2-L cylindrical separable flask having a Maxblend stirring blade, 500 parts by weight of the resin solution and 45.5 parts by weight of methyl ethyl ketone were introduced, and the content of the solid components in the resin solution was adjusted to 55%.

Then, 41.7 parts by weight of 1 Normal aqueous ammonia (molar equivalent ratio with respect to the total amount of the carboxyl group carried by the polyester resin is 1.1) was added to the resin solution in the flask, and was sufficiently stirred by a Three One Motor (Shinto Scientific Co., Ltd.), with the speed of rotation of the stirring blade set at 210 rpm (peripheral speed of the stirring blade: 0.71 m/s). Thereafter, while maintaining the stirring, 133 parts by weight of deionized water was added. The temperature of the solution inside the flask was adjusted to 25° C., and stirring was continued. 133 parts by weight of deionized water was added dropwise to the resin solution to induce phase inversion emulsification, thus to obtain an aqueous emulsion in which a dispersoid containing the resin material was dispersed.

Preparation of Associated Particles by Association

Next, while continuing the stirring in the flask, 285 parts by weight of deionized water was added so that the total amount of 1 Normal aqueous ammonia and water in the aqueous emulsion became 593 parts by weight. Subsequently, 2.6 parts by weight of Emal O (Kao Corp.), an anionic emulsifier, was diluted in 30 parts of deionized water, and the resultant was added to the aqueous emulsion.

Thereafter, while maintaining the temperature of the aqueous emulsion at 25° C., 300 parts by weight of a 3.5% aqueous solution of ammonium sulfate was added dropwise at a speed of rotation of the stirring of 150 rpm (peripheral speed of the stirring blade: 0.54 m/s), and the particle size of the association product of the dispersoid was adjusted to 3.5 μm. After the dropwise addition, stirring was continued until the particle size of the association product of the dispersoid increased to 5.0 μm, and the association operation was terminated.

The resulting association product dispersion was dried by distilling off the organic solvent under reduced pressure, to obtain associated particles.

In addition, the average particle sizes of the respective particles in the Examples and Comparative Examples were volume-based average particle sizes, and the average particle size and particle size distribution of these particles were measured by a Mastersizer 2000 particle analyzer (Malvern Instruments, Ltd.).

Preparation of Liquid Developer

The associated particles of 40 g thus obtained, the soyate fatty acid methyl ester of 60 g, the soybean oil of 100 g, a polyamine aliphatic polycondensation product of 1 g (Lubrizol Japan, Ltd., trade name "Solsperse 11200"), and aluminum stearate of 0.5 g (Nippon Oils and Fats Corp.) were introduced into a ceramic pot (internal capacity 600 ml), and zirconium oxide balls (ball diameter: 3 mm) were further introduced into the ceramic pot to a volumetric filling ratio of 30%. Disintegration was performed for 200 hours with a bench pot mill at a speed of rotation of 220 rpm, and the dispersion in the pot was separated from the zirconium oxide balls to obtain a liquid developer.

Example 2

Crude rapeseed oil was purified in the same way as the soybean oil of Example 1, and the purified rapeseed oil (hereinafter, it is simply referred to as rapeseed oil) was obtained. Additionally, since the rapeseed oil mainly contains fatty acid glyceride which contains oleic acid as a main component, the content of unsaturated fatty acid glyceride in the rapeseed oil was about 98 wt %. Additionally, the contents of the oleic acid component and the linoleic acid component in the total fatty acid component were about 52 mol % and 24 mol %, respectively.

Next, by causing transesterification reaction between a moiety of the rapeseed oil and methanol and removing the glycerin caused by the reaction, glycerin generated by this reaction was removed to obtain a liquid composed mainly of fatty acid monoesters. In addition, by purifying this liquid, a rapeseed oil fatty acid methyl ester having a content of the fatty acid monoester of about 99.9 wt % or greater was obtained.

Hereinafter, Other than using rapeseed oil fatty acid methyl ester of 60 g instead of the soyate fatty acid methyl ester as insulating liquid and the rapeseed oil of 100 g instead of the soybean oil, the liquid developer was prepared in the same manner as Example 1.

Example 3

Crude castor oil was purified in the same way as the soybean oil of Example 1, and the purified castor oil (hereinafter, it is simply referred to as castor oil) was obtained. Additionally, since the castor oil mainly contains fatty acid glyceride which contains oleic acid as a main component, the content of unsaturated fatty acid glyceride in the castor oil was about 98 wt %. Additionally, the contents of the oleic acid component and the linoleic acid component in the total fatty acid component were about 92 mol % and 3 mol %, respectively.

Next, by causing transesterification reaction between a moiety of the castor oil and methanol and removing the glycerin caused by the reaction, glycerin generated by this reaction was removed to obtain a liquid composed mainly of fatty acid monoesters. In addition, by purifying this liquid, a castor oil fatty acid methyl ester having a content of the fatty acid monoester of about 99.9 wt % or greater was obtained.

Hereinafter, Other than using castor oil fatty acid methyl ester of 60 g instead of the soyate fatty acid methyl ester as insulating liquid and the castor oil of 100 g instead of the soybean oil, the liquid developer was prepared in the same manner as Example 1.

Example 4

Other than setting disintegration time in a bench pot mill to 80 hours, the liquid developer was prepared in the same manner as Example 1.

Example 5

In the disintegration process by using the bench pot mill, the liquid developer was prepared in the same manner as Example 1 other than using a zirconium oxide ball having diameter of 1 mm and setting disintegration time to 240 hours.

Example 6

Crude linseed oil was purified in the same way as the soybean oil of Example 1, and the purified linseed oil (hereinafter, it is simply referred to as linseed oil) was obtained. Additionally, since the linseed oil mainly contains fatty acid glyceride which contains α-linolenic acid as a main component, the content of unsaturated fatty acid glyceride in the linseed oil was about 98 wt %. Additionally, the contents of the α-linolenic acid component and the linoleic acid component in the total fatty acid component were about 18 mol % and 15 mol %, respectively.

Next, by causing transesterification reaction between a moiety of the linseed oil and methanol and removing the glycerin caused by the reaction, glycerin generated by this reaction was removed to obtain a liquid composed mainly of fatty acid monoesters. In addition, by purifying this liquid, a linseed oil fatty acid methyl ester having a content of the fatty acid monoester of about 99.9 wt % or greater was obtained.

Hereinafter, Other than using linseed oil fatty acid methyl ester of 60 g instead of the soyate fatty acid methyl ester as insulating liquid; and the linseed oil of 80 g and the soybean oil of 20 g instead of the soybean oil, the liquid developer was prepared in the same manner as Example 1.

Example 7

Other than using linseed oil fatty acid methyl ester of 60 g instead of the soyate fatty acid methyl ester as insulating liquid and the linseed oil of 100 g instead of the soybean oil, the liquid developer was prepared in the same manner as Example 1.

Example 8

Crude palm oil was purified in the same way as the soybean oil of Example 1, and the purified palm oil (hereinafter, it is simply referred to as palm oil) was obtained. Additionally, the palm oil mainly contains fatty acid glyceride which contains lauric acid as a main component. Additionally, the contents of the lauric acid component and the linoleic acid component in the total fatty acid component were about 47 mol % and 1 mol %, respectively.

Next, by causing transesterification reaction between a moiety of the palm oil and methanol and removing the glycerin caused by the reaction, glycerin generated by this reaction was removed to obtain a liquid composed mainly of fatty acid monoesters. In addition, by purifying this liquid, a palm oil fatty acid methyl ester having a content of the fatty acid monoester of about 99.9 wt % or greater was obtained.

Hereinafter, Other than using palm oil fatty acid methyl ester of 60 g instead of the soyate fatty acid methyl ester as insulating liquid, the liquid developer was prepared in the same manner as Example 1.

Example 9

Other than using soyate fatty acid methyl ester of 96 g and soybean oil of 64 g as insulating liquid, the liquid developer was prepared in the same manner as Example 1.

Example 10

Other than using soyate fatty acid methyl ester of 6.5 g, soybean oil of 50 g, and adepsine oil of 103.5 g as insulating liquid, the liquid developer was prepared in the same manner as Example 1.

Example 11

Other than using soyate fatty acid methyl ester of 23 g and soybean oil of 137 g as insulating liquid, the liquid developer was prepared in the same manner as Example 1.

Example 12

Other than using soyate fatty acid methyl ester of 50 g, soybean oil of 30 g, and adepsine oil of 80 g as insulating liquid, the liquid developer was prepared in the same manner as Example 1.

Example 13

Other than using soyate fatty acid methyl ester of 120 g and soybean oil of 40 g as insulating liquid, the liquid developer was prepared in the same manner as Example 1.

Example 14

Other than using soyate fatty acid methyl ester of 15 g, soybean oil of 130 g, and adepsine oil of 15 g as insulating liquid, the liquid developer was prepared in the same manner as Example 1.

Example 15

First, 80 parts by weight of a polyester resin (glass transition point: 55° C., softening temperature: 123° C.) that is used as a self-dispersion resin and of which side chains have a number of —SO3-groups (sulfone acid Na group), and 20 parts by weight of a cyan based pigment (manufactured by Dainichiseika corp., pigment blue 15:3) that is used as a colorant were provided. Raw material for producing a toner was obtained by mixing the respective components by 20 L type Henschel mixer.

Next, the raw material (mixture) was kneaded by using a twin screw kneading extruder. The kneaded material extruded from an extruding outlet of the twin screw kneading extruder was cooled.

The kneading product cooled as described above was subjected to coarse pulverization to obtain a powder having an average particle size of 1.0 mm. A hammer mill was used for the coarse pulverization of the kneading product.

Next, 100 parts by weight of the coarse pulverization product of the kneading product was added to 250 parts by weight of toluene, and the resultant was treated for 1 hour using an ultrasonic homogenizer (output power: 400 μA), to obtain a solution in which the self-dispersion resin of the kneading product was dissolved. Also, the pigment was uniformly microdispersed in such solution.

Meanwhile, an aqueous liquid having 700 parts by weight of ion-exchanged water was provided.

The aqueous liquid was agitated, while the speed of rotation was adjusted using a homomixer (Tokushu Kika Kogyo Co., Ltd.).

The solution (toluene solution of the kneading product) was added dropwise to the aqueous liquid which had been agitated. Thus, an aqueous emulsion in which a dispersoid having an average particle size of 0.2 μm is uniformly dispersed could be obtained.

Thereafter, under the conditions such as at a temperature of 100° C. and a pressure of 80 kPa, toluene in the aqueous emulsion was removed, the resultant was cooled to room temperature, and then a predetermined amount of water was added to adjust the concentration, thereby to obtain an aqueous suspension having solid microparticles dispersed therein. The obtained aqueous suspension did not substantially have any toluene remaining. The solid component (dispersoid) concentration in the resulting aqueous suspension was 30.5 wt %. Also the average particle size of the dispersoid (solid microparticles) dispersed in the suspension was 0.15 μm.

The suspension liquid obtained by the method mentioned above was discharged from a discharging outlet while controlling discharge rate by using piezoelectric pulse, a dispersion medium of a droplet was removed, and then a heating process proceeded, thereby toner particles having no unevenness, spherical shape, and uniform particle diameter were obtained.

The obtained toner particles of 40 g, soyate fatty acid methyl ester of 60 g and soybean oil of 100 g as an insulating liquid, a polyamine aliphatic polycondensation product of 1 g (Lubrizol Japan, Ltd., trade name "Solsperse 11200") as a dispersoid and magnesium stearate of 0.5 g as a charge control agent were provided.

These components was made to be dispersed by using an emulsifying and dispersing apparatus (manufactured by M technique corp.) of which revolution speed was set to 10000 rpm, while observing liquid temperature so as not to be resin's grass transition temperature or more.

Additionally, an average particle diameter of the toner particles in the obtained liquid developer was 1.03 μm.

Example 16

Other than using epoxy resin (softening temperature: 80.5° C., grass transition point: 55° C., acid number: 12) as toner resin instead of polyester resin, the liquid developer was prepared in the same manner as Example 1.

Example 17

Other than using soybean oil of 160 g without using soyate fatty acid methyl ester as insulating liquid, the liquid developer was prepared in the same manner as Example 1.

Comparative Example 1

Other than using adepsine oil of 160 g instead of soyate fatty acid methyl ester and soybean oil as insulating liquid, the liquid developer was prepared in the same manner as Example 1.

Comparative Example 2

Other than using soyate fatty acid methyl ester of 160 g without using soybean oil as insulating liquid, the liquid developer was prepared in the same manner as Example 1.

Comparative Example 3

Other than setting disintegration time in a bench pot mill to 40 hours, the liquid developer was prepared in the same manner as Example 1.

Comparative Example 4

In the disintegration process by using the bench pot mill, the liquid developer was prepared in the same manner as Example 1 other than using a zirconium oxide ball having diameter of 1 mm and setting disintegration time to 300 hours.

Comparative Example 5

In the disintegration process by using the bench pot mill, the liquid developer was prepared in the same manner as Example 1 other than using a zirconium oxide ball having diameter of 5 mm.

Regarding to the aforementioned examples and comparative examples, producing conditions and physical properties of the liquid developers are represented by Table 1. With respect to items of unsaturated fatty acids in the table, oleic acid, linoleic acid, and α-linolenic acid are referred to as OL, LN, and LL, respectively. Additionally, with respect to SF1 and SF2 of the toner particles, measure was performed as follows. First, with respect to the toner particles in the liquid developer, random sampling from images of the toner particles was performed 100 times by using FE-SEM (S-800, manufactured by Hitachi, Ltd.). Next, the obtained images of the toner particles were analyzed by using an image analysis device (LUSEX3, manufactured by Nireco corp.), and thus calculating SF1 and SF2 of an average value of the toner particles.

TABLE 1

| | Toner Particle | | | | | | | Insulating Liquid Unsaturated Fatty Acid Glyceride | |
|---|---|---|---|---|---|---|---|---|---|
| | Resin Material | | | | | | | | |
| | Type | Glass Transition Temp. [° C.] | Average Particle Size [μm] | Particle Size Distribution S | SF1 | SF2 | Type of Unsaturated Fatty Acid | Linoleic Acid Component in Fatty Acid Component [mol %] | Content A of Unsaturated Fatty Acid Glyceride in Insulating Liquid [Wt %] |
| Ex. 1 | Polyester Resin | 125 | 1.34 | 1.13 | 115 | 131 | LN, OL, LL | 53 | 61 |
| Ex. 2 | Polyester Resin | 125 | 1.23 | 1.20 | 118 | 138 | OL, LN, LL | 24 | 61 |
| Ex. 3 | Polyester Resin | 125 | 1.35 | 1.30 | 113 | 132 | OL, LN | 3 | 61 |

TABLE 1-continued

| | | | | | | | | | |
|---|---|---|---|---|---|---|---|---|---|
| Ex. 4 | Polyester Resin | 125 | 2.57 | 1.05 | 114 | 127 | LN, OL, LL | 53 | 61 |
| Ex. 5 | Polyester Resin | 125 | 0.87 | 1.34 | 124 | 113 | LN, OL, LL | 53 | 61 |
| Ex. 6 | Polyester Resin | 125 | 1.28 | 1.25 | 121 | 142 | LL, LN, OL | 15 | 61 |
| Ex. 7 | Polyester Resin | 125 | 1.32 | 1.38 | 128 | 143 | LL, LN, OL | 11 | 61 |
| Ex. 8 | Polyester Resin | 125 | 1.55 | 1.28 | 126 | 118 | LN, OL, LL | 53 | 61 |
| Ex. 9 | Polyester Resin | 125 | 1.15 | 1.21 | 122 | 141 | LN, OL, LL | 53 | 39 |
| Ex. 10 | Polyester Resin | 125 | 1.24 | 1.13 | 111 | 132 | LN, OL, LL | 53 | 30 |
| Ex. 11 | Polyester Resin | 125 | 1.30 | 1.29 | 128 | 146 | LN, OL, LL | 53 | 83 |
| Ex. 12 | Polyester Resin | 125 | 1.22 | 1.09 | 114 | 128 | LN, OL, LL | 53 | 18 |
| Ex. 13 | Polyester Resin | 125 | 1.08 | 1.16 | 113 | 124 | LN, OL, LL | 53 | 24 |
| Ex. 14 | Polyester Resin | 125 | 1.72 | 1.20 | 118 | 136 | LN, OL, LL | 53 | 79 |
| Ex. 15 | Polyester Resin | 123 | 1.03 | 1.38 | 129 | 142 | LN, OL, LL | 53 | 61 |
| Ex. 16 | Epoxy Resin | 80.5 | 1.53 | 1.34 | 127 | 148 | LN, OL, LL | 53 | 61 |
| Ex. 17 | Polyester Resin | 125 | 1.40 | 1.20 | 117 | 124 | LN, OL, LL | 53 | 97 |
| Comp. Ex. 1 | Polyester Resin | 125 | 1.27 | 1.18 | 113 | 127 | — | — | — |
| Comp. Ex. 2 | Polyester Resin | 125 | 0.98 | 1.24 | 122 | 117 | — | — | — |
| Comp. Ex. 3 | Polyester Resin | 125 | 3.54 | 0.98 | 113 | 141 | LN, OL, LL | 53 | 61 |
| Comp. Ex. 4 | Polyester Resin | 125 | 0.68 | 1.37 | 135 | 123 | LN, OL, LL | 53 | 61 |
| Comp. Ex. 5 | Polyester Resin | 125 | 1.47 | 1.82 | 140 | 153 | LN, OL, LL | 53 | 61 |

| | Insulating Liquid | | | | | |
|---|---|---|---|---|---|---|
| | Fatty Acid Monoester | | | | | |
| | Unsaturated Fatty Acid Component in Fatty Acid Component [mol %] | Type of Unsaturated Fatty Acid | Content B of Fatty Acid Monoester in Insulating Liquid [Wt %] | A/B | Iodine Value | Viscosity [mPa · s] |
| Ex. 1 | 84 | LN, OL, LL | 37 | 1.6 | 135 | 200 |
| Ex. 2 | 91 | OL, LN, LL | 37 | 1.6 | 160 | 110 |
| Ex. 3 | 97 | OL, LN | 37 | 1.6 | 105 | 140 |
| Ex. 4 | 84 | LN, OL, LL | 37 | 1.6 | 135 | 130 |
| Ex. 5 | 84 | LN, OL, LL | 37 | 1.6 | 135 | 260 |
| Ex. 6 | 89 | LL, LN, OL | 37 | 1.6 | 188 | 170 |
| Ex. 7 | 89 | LL, LN, OL | 37 | 1.6 | 201 | 180 |
| Ex. 8 | 7 | OL, LN | 37 | 1.6 | 94 | 160 |
| Ex. 9 | 84 | LN, OL, LL | 59 | 0.7 | 140 | 70 |
| Ex. 10 | 84 | LN, OL, LL | 4 | 7.5 | 48 | 40 |
| Ex. 11 | 84 | LN, OL, LL | 14 | 5.9 | 126 | 210 |
| Ex. 12 | 84 | LN, OL, LL | 27 | 0.7 | 53 | 30 |
| Ex. 13 | 84 | LN, OL, LL | 74 | 0.3 | 142 | 50 |
| Ex. 14 | 84 | LN, OL, LL | 9 | 8.8 | 113 | 170 |
| Ex. 15 | 84 | LN, OL, LL | 37 | 1.6 | 135 | 130 |
| Ex. 16 | 84 | LN, OL, LL | 37 | 1.6 | 135 | 130 |
| Ex. 17 | — | — | — | — | 125 | 300 |
| Comp. Ex. 1 | — | — | — | — | — | 550 |
| Comp. Ex. 2 | 84 | LN, OL, LL | 99 | — | 145 | 15 |

TABLE 1-continued

| | | | | | | |
|---|---|---|---|---|---|---|
| Comp. Ex. 3 | 84 | LN, OL, LL | 37 | 1.6 | 135 | 130 |
| Comp. Ex. 4 | 84 | LN, OL, LL | 37 | 1.6 | 135 | 320 |
| Comp. Ex. 5 | 84 | LN, OL, LL | 37 | 1.6 | 135 | 280 |

[2] Evaluation

The liquid developers obtained by using the aforementioned method were evaluated.

[2.1] Micro Letter Printing Ability

By using the image forming apparatus as shown in FIGS. 2 to 7, monochromatic 2 point-size letters were formed on recording paper (Seiko Epson Corp., high quality paper LPCPPA4) with the respective liquid developers of the Examples and the Comparative Examples described above, and thermal fixation was performed thereon.

Thereafter, quality of the obtained toner image (2 point-size letter) was evaluated by visual observation in accordance with criteria of five grades as described below.

A: 2 point-size letter is very clearly visible.

B: 2 point-size letter is clearly visible.

C: 2 point-size letter is slightly dim but visible.

D: 2 point-size letter is dimly visible.

E: 2 point-size letter is not visible.

[2.2] Evaluation of Defects, Stripes, and Uneven Concentrations

By using the image forming apparatus as shown in FIGS. 2 to 7, monochromatic images of a predetermined pattern were formed on recording paper (Seiko Epson Corp., high quality paper LPCPPA4) with the respective liquid developers of the Examples and the Comparative Examples described above, and thermal fixation was performed thereon.

Thereafter, quality of the obtained toner image was evaluated by visual observation in accordance with criteria of five grades as described below.

A: Defects, stripes, uneven concentrations on the toner image are not observed.

B: Defects, stripes, uneven concentrations on the toner image are hardly observed.

C: Defects, stripes, uneven concentrations on the toner image are observed in some spots.

D: A lot of defects, stripes, uneven concentrations on the toner image are observed.

E: A lot of defects, stripes, uneven concentrations on the toner image are remarkably observed.

[2.3] Long-Term Stability of Toner Image (Stable Period)

By using the image forming apparatus as shown in FIGS. 2 to 7, monochromatic images of a predetermined pattern were formed on recording paper (Seiko Epson Corp., high quality paper LPCPPA4) with the respective liquid developers of the Examples and the Comparative Examples described above, and thermal fixation was performed thereon by setting the temperature of a heat fixing roller to 150° C. Just after fixation, image concentration of the toner image was measured by "X-Rite model 404" manufactured by X-Rite Inc. Thereafter, the toner image was left under the condition of air temperature 15 to 35° C., humidity 50 to 70%, and atmosphere under sunshine. After confirming non-offset domain of the toner image for every one month, the fixed image on the recording paper was rubbed two times by an eraser (a sand eraser "LION 261-11" manufactured by Lion-Jimuki corp.) with a pressure load of 1.0 kgf, and the image density thereof was measured by "X-Rite model 404" manufactured by X-Rite Inc. Comparing the measured image density with the image density just formed, a period in which a persistence rate of the toner image is 85% or more is referred to as a stable period of the toner image, and the result was evaluated in accordance with criteria of five grades as described below.

A: Stable period of the toner image is not less than 24 months (very good).

B: Stable period of the toner image is not less than 18 months and less than 24 months (good).

C: Stable period of the toner image is not less than 12 months and less than 18 months (normal).

D: Stable period of the toner image is not less than 6 months and less than 12 months (poor).

E: Stable period of the toner image is less than 6 months (very poor).

[2.4] Cleaning Ability and Recycling Ability

By using the image forming apparatus as shown in FIGS. 2 to 7, monochromatic images of a predetermined pattern were formed on recording paper (Seiko Epson Corp., high quality paper LPCPPA4) with the respective liquid developers of the Examples and the Comparative Examples described above, and thermal fixation was performed thereon by setting the temperature of a heat fixing roller to 150° C. The image formation mentioned above continuously proceeded for 48 hours. Thereafter, by observing the inner portion of the image forming apparatus and the toner particles adhering to the members such as the photosensitive member, the developing roller, and the intermediate transferring section, and the result was evaluated in accordance with criteria of five grades as described below.

A: No toner particles can be found in the members such as the photosensitive member, the developing roller, and the intermediate transferring section.

B: Toner particles can be hardly found in the members such as the photosensitive member, the developing roller, and the intermediate transferring section.

C: Some toner particles can be found in the members such as the photosensitive member, the developing roller, and the intermediate transferring section.

D: Toner particles can be found in the members such as the photosensitive member, the developing roller, and the intermediate transferring section.

E: A lot of toner particles can be found in the members such as the photosensitive member, the developing roller, and the intermediate transferring section.

Additionally, with respect to the liquid developer in the liquid developer reservoir, the state of the toner in the liquid developer was evaluated by visual observation in accordance with criteria of five grades as described below.

A: Floating and coagulation settling of the toner particles were not observed at all.

B: Floating and coagulation settling of the toner particles were hardly observed.

C: Some floating and coagulation settling of the toner particles were observed, but it is an allowable range to be used as a liquid developer.

D: Floating and coagulation settling of the toner particles were clearly observed.

E: Floating and coagulation settling of the toner particles were remarkably observed.

Additionally, with respect to the insulating liquid in the insulating liquid reservoir, the state of the insulating liquid was evaluated by visual observation in accordance with criteria of five grades as described below.

A: Turbidity of the insulating liquid was not observed at all.

B: Turbidity of the insulating liquid was hardly observed.

C: Some turbidity of the insulating liquid was observed, but it is an allowable range to be used.

D: Turbidity of the insulating liquid was clearly observed.

E: Turbidity of the insulating liquid was remarkably observed.

[2.5] Fixation Intensity

The fixing device was removed from the image forming apparatus as illustrated in FIG. 8, and images of a predetermined pattern were formed on recording paper (Seiko Epson Corp., high quality paper LPCPPA4) with the respective liquid developers of the Examples and the Comparative Examples described above. Thereafter, a heat fixation by using an oven was performed on the image formed on the recording paper. The heat fixation proceeded at 110° C. for 20 minutes.

After confirming non-offset domain of the toner image, the fixed image on the recording paper was rubbed two times by an eraser (a sand eraser "LION 261-11" manufactured by Lion-Jimuki corp.) with a pressure load of 1.0 kgf, and persistence rate of the image density thereof was measured by "X-Rite model 404" manufactured by X-Rite Inc was evaluated in accordance with criteria of five grades as described below.

A: Persistence rate of image density is not less than 95% (very good).

B: Persistence rate of image density is not less than 90% and less than 95% (good).

C: Persistence rate of image density is not less than 80% and less than 90% (normal).

D: Persistence rate of image density is not less than 70% and less than 80% (poor).

E: Persistence rate of image density is less than 70% (very poor).

[2.6] Transfer Efficiency

A secondary transferring roller P19 and the fixing device as shown in FIG. 9 was removed from the image forming apparatus as shown in FIG. 8, and the image formation was performed by an intermediate transferring roller P18. The remained toner on the photosensitive member P2 and the toner adhering to on the intermediate transferring roller P18 were taken by mending tapes, respectively. By measuring the image concentration of the toner image on each mending tape by using "X-Rite model 404" manufactured by X-Rite Inc., and obtaining the transfer efficiency represented by the following formula, and the result was evaluated in accordance with criteria of four grades as described below.

$$\text{Transfer Efficiency (\%)}=b/(a+b)\times 100$$

where a is defined as the image density of the toner image on the mending tape having the remained toner obtained from the photosensitive member P2, and b is defined as the image density of the toner image on the mending tape having the remained toner obtained from the intermediate transferring roller P18.

A: Transfer efficiency is not less than 95% (very good).

B: Transfer efficiency is not less than 85% and less than 95% (good).

C: Transfer efficiency is not less than 75% and less than 85% (poor).

D: Transfer efficiency is less than 75% (very poor).

[2.7] Development Efficiency

The intermediate transferring roller P18, the secondary transferring roller P19 and the fixing device as shown in FIG. 9 was removed from the image forming apparatus as shown in FIG. 8, and the development was performed on the photosensitive member P2. The remained toner on the photosensitive member P2 and the toner adhering to on a developing roller P13 were taken by mending tapes, respectively. By measuring the image concentration of the toner image on each mending tape by using "X-Rite model 404" manufactured by X-Rite Inc., and obtaining the development efficiency represented by the following formula, and the result was evaluated in accordance with criteria of four grades as described below.

$$\text{Development Efficiency (\%)}=d/(c+d)\times 100$$

where c is defined as the image density of the toner image on the mending tape having the remained toner obtained from the developing roller P13, and d is defined as the image density of the toner image on the mending tape having the remained toner obtained from the photosensitive member P2.

A: Development efficiency is not less than 98% (very good).

B: Development efficiency is not less than 95% and less than 98% (good).

C: Development efficiency is not less than 90% and less than 95% (normal).

D: Development efficiency is not less than 80% and less than 90% (poor).

E: Development efficiency is less than 80% (very poor).

[2.8] Resolution

By using the image forming apparatus as illustrated in FIG. 8, images of a predetermined pattern were formed on recording paper (Seiko Epson Corp., high quality paper LPCPPA4) with the respective liquid developers of the Examples and the Comparative Examples described above, and the resolutions of the images were investigated by visual observation.

[2.9] Glossiness

By using the image forming apparatus as illustrated in FIG. 8, images of a predetermined pattern were formed on recording paper (Seiko Epson Corp., high quality paper LPCPPA4) with the respective liquid developers of the Examples and the Comparative Examples described above. Thereafter, specular gloss was measured by the measuring method (JIS Z 8741-1997) of JIS standard, and the result was evaluated in accordance with criteria of five grades as described below.

A: Glossiness is not less than 55% (very good).

B: Glossiness is not less than 50% and less than 55% (good).

C: Glossiness is not less than 45% and less than 50% (normal).

D: Glossiness is not less than 40% and less than 45% (poor).

E: Glossiness is less than 40% (very poor).

[2.10] Storage Property

The respective liquid developers obtained in the Examples and the Comparative Examples described above were left to stand for 6 months in an environment at a temperature of 15 to 25° C. Thereafter, the appearance of the toner in the liquid developers was confirmed by naked eyes, and was evaluated according to the following criteria of five grades.

A: Floating and coagulation settling of the toner particles are not observed at all.

B: Floating and coagulation settling of the toner particles are hardly observed.

C: Some floating and coagulation settling of the toner particles are observed, but it is an allowable range to be used as a liquid developer.

D: Floating and coagulation settling of the toner particles are clearly observed.

E: Floating and coagulation settling of the toner particles are remarkably observed.

[2.11] High Speed Printing Fitness

By using the liquid developers of the Examples and the Comparative Examples described above and the image forming apparatus as shown in FIG. 8, the fixation temperature of the image forming apparatus and nip time of the fixing roller were set to 160° C. and 0.06 sec, respectively, and the images were formed without using ultraviolet irradiation of an ultraviolet irradiator F8. Thereafter, with respect to the obtained images, image quality defects such as uneven density and blur were evaluated in accordance with criteria of four grades as described below (condition 1).

A: Image quality defects such as uneven density and blur are not observed at all.

B: Some image quality defects such as uneven density and blur are observed.

C: Image quality defects such as uneven density and blur are clearly observed.

D: Image quality defects such as uneven density and blur are remarkably observed.

Additionally, By using the liquid developers of the Examples and the Comparative Examples described above, the fixation temperature of the image forming apparatus and nip time of the fixing roller were set to 140° C. and 0.03 sec, respectively, and the images were formed with using ultraviolet irradiation of an ultraviolet irradiator F5. Thereafter, with respect to the images obtained by using the same, image quality defects were evaluated (condition 2).

These results are represented by Table 2 and Table 3.

TABLE 2

| | Toner Image | | | | Recycling Ability | |
|---|---|---|---|---|---|---|
| | Micro Letter Print | Defect, Stripe Uneven Concentration | Long-Term Stability (Stable Period [Month]) | Cleaning Ability | Toner Particle | Insulating Liquid |
| Ex. 1 | A | A | A(38) | A | A | A |
| Ex. 2 | A | A | B(23) | A | A | A |
| Ex. 3 | B | B | C(17) | A | A | B |
| Ex. 4 | B | C | A(28) | A | A | A |
| Ex. 5 | A | A | A(34) | C | B | B |
| Ex. 6 | B | B | A(26) | B | B | B |
| Ex. 7 | B | B | C(15) | B | B | C |
| Ex. 8 | B | B | A(30) | B | C | B |
| Ex. 9 | A | B | A(31) | A | B | A |
| Ex. 10 | B | A | B(23) | A | A | A |
| Ex. 11 | B | B | B(21) | B | B | B |
| Ex. 12 | A | A | C(16) | A | A | A |
| Ex. 13 | A | A | B(22) | A | A | A |
| Ex. 14 | B | A | A(26) | A | A | A |
| Ex. 15 | A | C | A(29) | B | B | C |
| Ex. 16 | B | C | A(27) | C | B | C |
| Ex. 17 | B | A | A(30) | A | A | A |
| Comp. Ex. 1 | C | A | E(2) | A | A | A |
| Comp. Ex. 2 | B | B | E(3) | B | A | B |
| Comp. Ex. 3 | E | E | B(18) | A | A | C |
| Comp. Ex. 4 | A | E | C(14) | E | D | E |
| Comp. Ex. 5 | C | E | A(27) | E | D | E |

TABLE 3

| | Fixation Intensity | Transfer Efficiency | Development Efficiency | Resolution [Vol./mm] | Glossiness | Storage Property | High Speed Printing Fitness Condition 1 | High Speed Printing Fitness Condition 2 |
|---|---|---|---|---|---|---|---|---|
| Ex. 1 | A | A | A | 9.2 | A | A | A | A |
| Ex. 2 | A | A | B | 9.3 | B | A | A | A |
| Ex. 3 | B | A | B | 8.6 | C | B | A | A |
| Ex. 4 | B | A | A | 7.2 | B | B | A | B |
| Ex. 5 | B | A | B | 10 | A | B | A | A |
| Ex. 6 | A | B | B | 7.4 | B | C | A | A |
| Ex. 7 | A | B | C | 7.3 | C | B | A | A |
| Ex. 8 | B | B | B | 7.5 | B | A | A | B |
| Ex. 9 | B | A | A | 8.9 | A | C | A | B |
| Ex. 10 | C | A | B | 8.5 | C | B | B | B |
| Ex. 11 | B | B | C | 7.0 | C | B | A | A |
| Ex. 12 | C | A | B | 8.2 | C | B | B | B |
| Ex. 13 | C | A | A | 10 | A | C | A | B |
| Ex. 14 | B | A | B | 7.4 | B | B | A | A |
| Ex. 15 | B | B | B | 9.0 | B | C | A | B |
| Ex. 16 | B | B | B | 7.4 | B | C | A | B |
| Ex. 17 | D | C | D | 8.0 | C | C | A | B |
| Comp. Ex. 1 | E | B | C | 6.4 | E | E | B | D |
| Comp. Ex. 2 | E | C | C | 7.9 | B | D | B | C |
| Comp. Ex. 3 | D | D | E | 5.3 | E | D | B | C |
| Comp. Ex. 4 | D | C | D | 8.9 | D | E | B | C |
| Comp. Ex. 5 | D | C | E | 6.7 | E | E | B | C |

As represented in Table 2, the liquid developer of the invention is suitable for forming fine letters and images. Additionally, the toner image formed by the liquid developer of the invention had excellent long-term stability and small defects, stripes, and uneven concentrations. On the contrary, desired results were not obtained from the liquid developers of Comparative Examples.

In addition, the liquid developers in which SF1 and SF2 of toner particles are in the allowable range mentioned above had excellent cleaning ability and recycling ability.

Additionally, as represented in Table 3, the liquid developers of which the insulating liquid include fatty acid monoester according to the invention was excellent in transfer efficiency and development efficiency of the toner image; resolution, Glossiness, and fixation intensity of the formed image; and storage property of the liquid developer.

When ultraviolet beams were irradiated by the ultraviolet irradiator upon fixation of the toner image, the liquid developers of the Examples had good image quality by performing fixation at low temperature for short time.

Figure 11:
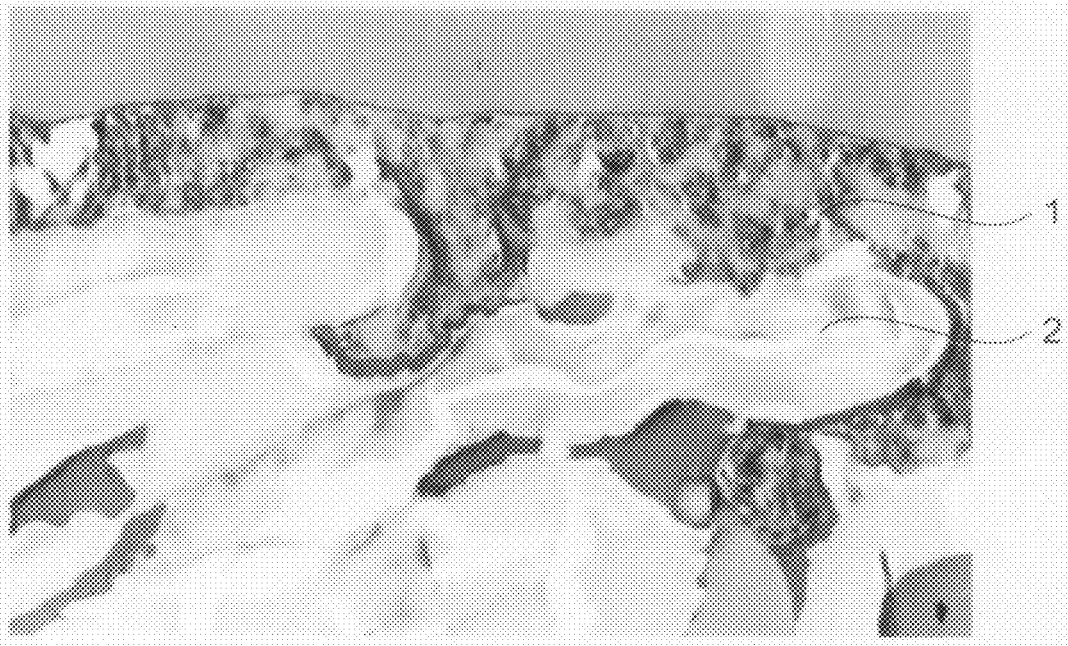
FIG. 11 is a cross-sectional photograph of a recording medium on which an image is formed by a liquid developer containing a fatty acid monoester.

Additionally, by using the image forming apparatus as shown in FIGS. 2 to 7 and the liquid developers of Example 1, monochromatic images of a predetermined pattern were formed on recording paper (Seiko Epson Corp., high quality paper LPCPPA4), and thermal fixation was performed thereon by setting the temperature of a heat fixing roller to 110° C. After fixation, cutting and extracting the sectional part from the toner image formed on the recording paper, the section was observed by microscope. FIG. 11 is a picture obtained by the observation. In the section of the observed recording medium 2, the state where the toner particles 1 penetrated into between fibers of the recording medium 2 (recording paper) was observed. A fatty acid monoester (soyate fatty acid methyl) cause the plasticizing effect to the toner particles 1, and thus it is considerable that the fixation is enabled to appropriately interlock the toner particles 1 with the fibers of the recording medium 2.

When the liquid developers were prepared and evaluated in the same manner as described above other than using a pigment red 122, a pigment yellow 180, a carbon black (manufactured by Degussa, Printex L) instead of cyan based pigment as a colorant, the same result was obtained.

[3] Preparation of Liquid Developer

Example 18

Preparation of Liquid Composing Insulating Liquid

A liquid mainly containing an unsaturated fatty acid glyceride and a liquid mainly containing a fatty acid methyl ester to be used as the insulating liquid were prepared as follows.

First, crude soybean oil was purified as follows to obtain purified soybean oil.

First, crude soybean oil was subjected to crude purification by a low temperature crystallization method using methanol, diethyl ether, petroleum ether, acetone or the like as the solvent.

Next, 300 parts by volume of the roughly purified crude soybean oil (first roughly purified oil) was introduced into a flask, and then 100 parts by volume of boiling water was poured into the flask, which was then stoppered.

Next, the flask was shaken to mix the roughly purified soybean oil (first roughly purified oil) and boiling water.

Next, the flask was left to stand until the liquid mixture in the flask underwent separation to three layers.

After confirming complete separation, the flask was transferred to a freezer and was left to stand for 24 hours.

Thereafter, unfrozen components were transferred to another flask.

These unfrozen components were repeatedly subjected to the operation described above, and the resulting unfrozen components were removed to obtain crude oil and fat (second roughly purified oil).

Next, 100 parts by volume of the crude oil and fat (second roughly purified oil) obtained as described above, and 35 parts by volume of activated white clay mainly composed of hydrated aluminum silicate were mixed and agitated in a flask.

Then, the resulting mixture was stored under pressure (0.18 MPa) for 48 hours to completely precipitate the activated white clay.

Thereafter, the precipitate was removed, and purified soybean oil (hereinafter, simply referred to as soybean oil) was obtained. In addition, the soybean oil mainly contained fatty acid triglycerides having linolic acid as the main component, and the content of the fatty acid triglycerides contained in the soybean oil was 98 wt %. The linolic acid component occupied 53% by mole of the total fatty acid components.

Next, a portion of this soybean oil was subjected to a transesterification reaction with methanol, and glycerin generated by this reaction was removed to obtain a liquid composed mainly of fatty acid monoesters. In addition, by purifying this liquid, a soyate fatty acid methyl ester having a content of the fatty acid monoester of about 99.9 wt % or greater was obtained. The fatty acid monoester thus obtained was mainly composed of unsaturated fatty acid monoesters such as methyl oleate, methyl linolate, methyl α-linoleate and the like, and saturated fatty acid monoesters such as methyl palmitate, methyl stearate and the like.

Preparation of Colorant Master Solution

First a mixture (weight ratio 50:50) of a polyester resin (softening temperature: 125° C., glass transition temperature: 60.5° C., and acid number: 7.7) and a cyan pigment (Dainichiseika Color & Chemicals Mfg. Co., Ltd., Pigment Blue 15:3) as a colorant was provided. These components were mixed using a 20 L type Henschel mixer to obtain a raw material for toner preparation.

Next, this raw material (mixture) was kneaded using a twin-screw kneading extruder. The kneading product extruded through the extrusion orifice of the twin-screw kneading extruder was cooled.

The kneading product thus cooled was subjected to coarse pulverization to obtain a powder having an average particle size of 1.0 mm or less. The coarse pulverization of the kneading product was performed using a hammer mill.

Methyl ethyl ketone was added so that the content of the solid components in the resulting powder of the kneading product became 30% by weight, and the resultant was subjected to wet dispersion with an Aiger motor mill (Aiger US, Inc., M-1000), thus to prepare a colorant master solution.

Preparation of Resin Solution 140 parts by weight of methyl ethyl ketone and 60 parts by weight of the above-described polyester resin were added to 133 parts by weight of the colorant master solution, and the resultant was mixed with an Aiger motor mill (Aiger US, Inc., M-1000) to prepare a resin solution. In addition, the pigment was uniformly microdispersed in this solution.

Preparation of Aqueous Emulsion

In a 2-L cylindrical separable flask having a Maxblend stirring blade, 500 parts by weight of the resin solution and 45.5 parts by weight of methyl ethyl ketone were introduced, and the content of the solid components in the resin solution was adjusted to 55%.

Then, 41.7 parts by weight of 1 Normal aqueous ammonia (molar equivalent ratio with respect to the total amount of the carboxyl group carried by the polyester resin is 1.1) was added to the resin solution in the flask, and was sufficiently stirred by a Three One Motor (Shinto Scientific Co., Ltd.), with the speed of rotation of the stirring blade set at 210 rpm (peripheral speed of the stirring blade: 0.71 m/s). Thereafter, while maintaining the stirring, 133 parts by weight of deionized water was added. The temperature of the solution inside the flask was adjusted to 25° C., and stirring was continued. 133 parts by weight of deionized water was added dropwise to the resin solution to induce phase inversion emulsification, thus to obtain an aqueous emulsion in which a dispersoid containing the resin material was dispersed.

Preparation of Associated Particles by Association

Next, while continuing the stirring in the flask, 285 parts by weight of deionized water was added so that the total amount of 1 Normal aqueous ammonia and water in the aqueous emulsion became 593 parts by weight. Subsequently, 2.6 parts by weight of Emal O (Kao Corp.), an anionic emulsifier, was diluted in 30 parts of deionized water, and the resultant was added to the aqueous emulsion.

Thereafter, while maintaining the temperature of the aqueous emulsion at 25° C., 300 parts by weight of a 3.5% aqueous solution of ammonium sulfate was added dropwise at a speed of rotation of the stirring of 150 rpm (peripheral speed of the stirring blade: 0.54 m/s), and the particle size of the association product of the dispersoid was adjusted to 3.5 μm. After the dropwise addition, stirring was continued until the particle size of the association product of the dispersoid increased to 5.0 μm, and the association operation was terminated.

The resulting association product dispersion was dried by distilling off the organic solvent under reduced pressure, to obtain associated particles.

In addition, the average particle sizes of the respective particles in the Examples and Comparative Examples were volume-based average particle sizes, and the average particle size and particle size distribution of these particles were measured by a Mastersizer 2000 particle analyzer (Malvern Instruments, Ltd.).

Preparation of Liquid Developer

The associated particles of 40 g thus obtained, the soyate fatty acid methyl ester of 60 g, the soybean oil of 100 g, a polyamine aliphatic polycondensation product of 1 g (Lubrizol Japan, Ltd., trade name "Solsperse 11200"), and aluminum stearate of 0.5 g (Nippon Oils and Fats Corp.) were introduced into a ceramic pot (internal capacity 600 ml), and zirconium oxide balls (ball diameter: 3 mm) were further introduced into the ceramic pot to a volumetric filling ratio of 30%. Disintegration was performed for 120 hours with a bench pot mill at a speed of rotation of 210 rpm, and the dispersion in the pot was separated from the zirconium oxide balls to obtain a liquid developer.

Example 19

Crude rapeseed oil was purified in the same way as the soybean oil of Example 1, and the purified rapeseed oil (hereinafter, it is simply referred to as rapeseed oil) was obtained. Additionally, since the rapeseed oil mainly contains fatty acid glyceride which contains oleic acid as a main component, the content of unsaturated fatty acid glyceride in the rapeseed oil was about 98 wt %. Additionally, the contents of the oleic acid component and the linoleic acid component in the total fatty acid component were about 58 mol % and 24 mol %, respectively.

Next, by causing transesterification reaction between a moiety of the rapeseed oil and methanol and removing the glycerin caused by the reaction, glycerin generated by this reaction was removed to obtain a liquid composed mainly of fatty acid monoesters. In addition, by purifying this liquid, a rapeseed oil fatty acid methyl ester having a content of the fatty acid monoester of about 99.9 wt % or greater was obtained.

Hereinafter, other than using rapeseed oil fatty acid methyl ester of 60 g instead of the soyate fatty acid methyl ester as insulating liquid and rapeseed oil of 100 g instead of soybean oil, the liquid developer was prepared in the same manner as Example 18.

Example 20

Crude castor oil was purified in the same way as the soybean oil of Example 1, and the purified castor oil (hereinafter, it is simply referred to as castor oil) was obtained. Additionally, since the castor oil mainly contains fatty acid glyceride which contains oleic acid as a main component, the content of unsaturated fatty acid glyceride in the castor oil was about 98 wt %. Additionally, the contents of the oleic acid component and the linoleic acid component in the total fatty acid component were about 92 mol % and 3 mol %, respectively. Next, by causing transesterification reaction between a moiety of the castor oil and methanol and removing the glycerin caused by the reaction, glycerin generated by this reaction was removed to obtain a liquid composed mainly of fatty acid monoesters. In addition, by purifying this liquid, a castor oil fatty acid methyl ester having a content of the fatty acid monoester of about 99.9 wt % or greater was obtained.

Hereinafter, other than using castor oil fatty acid methyl ester of 60 g instead of the soyate fatty acid methyl ester as insulating liquid and castor oil of 100 g instead of soybean oil, the liquid developer was prepared in the same manner as Example 18.

Example 21

Other than using soyate fatty acid methyl ester of 120 g and soybean oil of 40 g as insulating liquid, the liquid developer was prepared in the same manner as Example 18.

Example 22

Other than setting disintegration time in a bench pot mill to 96 hours, the liquid developer was prepared in the same manner as Example 18.

Example 23

In the disintegration process by using the bench pot mill, the liquid developer was prepared in the same manner as Example 18 other than using a zirconium oxide ball having diameter of 1 mm and setting disintegration time to 168 hours.

Example 24

Crude linseed oil was purified in the same way as the soybean oil of Example 1, and the purified linseed oil (hereinafter, it is simply referred to as linseed oil) was obtained. Additionally, since the linseed oil mainly contains fatty acid glyceride which contains α-linolenic acid as a main component, the content of unsaturated fatty acid glyceride in the linseed oil was about 98 wt %. Additionally, the contents of the α-linolenic acid component and the linoleic acid component in the total fatty acid component were about 18 mol % and 15 mol %, respectively.

Next, by causing transesterification reaction between a moiety of the linseed oil and methanol and removing the glycerin caused by the reaction, glycerin generated by this reaction was removed to obtain a liquid composed mainly of fatty acid monoesters. In addition, by purifying this liquid, a linseed oil fatty acid methyl ester having a content of the fatty acid monoester of about 99.9 wt % or greater was obtained.

Hereinafter, other than using linseed oil fatty acid methyl ester of 60 g instead of the soyate fatty acid methyl ester as insulating liquid and linseed oil of Bog and soybean oil of 20 g instead of soybean oil, the liquid developer was prepared in the same manner as Example 18.

Example 25

First, 80 parts by weight of a polyester resin (glass transition point: 55° C., softening temperature: 123° C.) that is used as a self-dispersion resin and of which side chains have a number of —SO3-groups (sulfone acid Na group), and 20 parts by weight of a cyan based pigment (manufactured by Dainichiseika corp., pigment blue 15:3) that is used as a colorant were provided. Raw material for producing a toner was obtained by mixing the respective components by 20 L type Henschel mixer.

Next, the raw material (mixture) was kneaded by using a twin screw kneading extruder. The kneaded material extruded from an extruding outlet of the twin screw kneading extruder was cooled.

The kneading product cooled as described above was subjected to coarse pulverization to obtain a powder having an average particle size of 1.0 mm. A hammer mill was used for the coarse pulverization of the kneading product.

Next, 100 parts by weight of the coarse pulverization product of the kneading product was added to 250 parts by weight of toluene, and the resultant was treated for 1 hour using an ultrasonic homogenizer (output power: 400 μA), to obtain a solution in which the self-dispersion resin of the kneading product was dissolved. Also, the pigment was uniformly microdispersed in such solution.

Meanwhile, an aqueous liquid having 700 parts by weight of ion-exchanged water was provided.

The aqueous liquid was agitated, while the speed of rotation was adjusted using a homomixer (Tokushu Kika Kogyo Co., Ltd.).

The solution (toluene solution of the kneading product) was added dropwise to the aqueous liquid which had been agitated. Thus, an aqueous emulsion in which a dispersoid having an average particle size of 0.2 μm is uniformly dispersed could be obtained.

Thereafter, under the conditions such as at a temperature of 100° C. and a pressure of 80 kPa, toluene in the aqueous emulsion was removed, the resultant was cooled to room temperature, and then a predetermined amount of water was added to adjust the concentration, thereby to obtain an aqueous suspension having solid microparticles dispersed therein. The obtained aqueous suspension did not substantially have any toluene remaining. The solid component (dispersoid) concentration in the resulting aqueous suspension was 30.5 wt %. Also the average particle size of the dispersoid (solid microparticles) dispersed in the suspension was 0.15 μm.

The suspension liquid obtained by the method mentioned above was discharged from a discharging outlet while controlling discharge rate by using piezoelectiric pulse, a dispersion medium of a droplet was removed, and then a heating process proceeded, thereby toner particles having no unevenness, spherical shape, and uniform particle diameter were obtained.

The obtained toner particles of 40 g, soyate fatty acid methyl ester of 60 g and soybean oil of 100 g as an insulating liquid, a polyamine aliphatic polycondensation product of 1 g (Lubrizol Japan, Ltd., trade name "Solsperse 11200") as a dispersoid and magnesium stearate of 0.5 g as a charge control agent were provided.

These components was made to be dispersed by using an emulsifying and dispersing apparatus (manufactured by M technique corp.) of which revolution speed was set to 10000 rpm, while observing liquid temperature so as not to be resin's glass transition temperature or more.

Additionally, an average particle diameter of the toner particles in the obtained liquid developer was 1.03 μm.

Example 26

Other than using soybean oil of 160 g without using soyate fatty acid methyl ester as insulating liquid, the liquid developer was prepared in the same manner as Example 18.

Example 27

Other than using linseed oil fatty acid methyl ester of 60 g instead of the soyate fatty acid methyl ester as insulating liquid and the linseed oil of 100 g instead of the soybean oil, the liquid developer was prepared in the same manner as Example 18.

Example 28

Crude olive oil was purified in the same way as the soybean oil of Example 18, and the purified olive oil (hereinafter, it is simply referred to as olive oil) was obtained. Additionally, since the olive oil mainly contains fatty acid glyceride which contains oleic acid as a main component, the content of unsaturated fatty acid glyceride in the olive oil was about 98 wt %. Additionally, the contents of the oleic acid component and the linoleic acid component in the total fatty acid component were about 73 mol % and 11 mol %, respectively.

Next, by causing transesterification reaction between a moiety of the olive oil and methanol and removing the glycerin caused by the reaction, glycerin generated by this reaction was removed to obtain a liquid composed mainly of fatty acid monoesters. In addition, by purifying this liquid, an olive oil fatty acid methyl ester having a content of the fatty acid monoester of about 99.9 wt % or greater was obtained.

Hereinafter, other than using olive oil fatty acid methyl ester of 60 g instead of the soyate fatty acid methyl ester as insulating liquid and olive oil of 100 g instead of soybean oil, the liquid developer was prepared in the same manner as Example 18.

Comparative Example 6

Other than using adepsine oil of 160 g instead of soyate fatty acid methyl ester and soybean oil as insulating liquid, the liquid developer was prepared in the same manner as Example 18.

Comparative Example 7

Other than setting disintegration time in a bench pot mill to 40 hours, the liquid developer was prepared in the same manner as Example 18.

Comparative Example 8

In the disintegration process by using the bench pot mill, the liquid developer was prepared in the same manner as Example 18 other than using a zirconium oxide ball having diameter of 1 mm and setting disintegration time to 300 hours.

Comparative Example 9

In the disintegration process by using the bench pot mill, the liquid developer was prepared in the same manner as Example 18 other than using a zirconium oxide ball having diameter of 5 mm.

Regarding to the aforementioned examples and comparative examples, producing conditions and physical properties of the liquid developers are represented by Table 4. With respect to items of unsaturated fatty acids in the table, oleic acid, linoleic acid, and α-linolenic acid are referred to as OL, LN, and LL, respectively.

TABLE 4

| | Toner Particle | | | | | | Insulating Liquid Unsaturated Fatty Acid Glyceride | |
|---|---|---|---|---|---|---|---|---|
| | Resin Material | | Average | | | | | Linoleic Acid |
| | Type | Softening Temperature [° C.] | Particle Size [μm] | Particle Size Distribution S | SF1 | SF2 | Type of Unsaturated Fatty Acid | Component in Fatty Acid Component [mol %] |
| Ex. 18 | Polyester Resin | 125 | 1.34 | 1.13 | 113 | 130 | LN, OL, LL | 53 |
| Ex. 19 | Polyester Resin | 125 | 1.23 | 1.20 | 116 | 134 | OL, LN, LL | 24 |
| Ex. 20 | Polyester Resin | 125 | 1.35 | 1.30 | 122 | 119 | OL, LN | 3 |
| Ex. 21 | Polyester Resin | 125 | 1.08 | 1.21 | 121 | 128 | LN, OL, LL | 53 |
| Ex. 22 | Polyester Resin | 125 | 2.57 | 1.05 | 112 | 130 | LN, OL, LL | 53 |
| Ex. 23 | Polyester Resin | 125 | 0.87 | 1.34 | 124 | 147 | LN, OL, LL | 53 |
| Ex. 24 | Polyester Resin | 125 | 1.28 | 1.25 | 127 | 144 | OL, LN, LL | 15 |
| Ex. 25 | Polyester Resin | 123 | 1.03 | 1.11 | 118 | 124 | LN, OL, LL | 53 |
| Ex. 26 | Polyester Resin | 125 | 1.40 | 1.20 | 115 | 132 | LN, OL, LL | 53 |
| Ex. 27 | Polyester Resin | 125 | 1.32 | 1.38 | 112 | 112 | LL, LN, OL | 15 |
| Ex. 28 | Polyester Resin | 125 | 1.45 | 1.20 | 117 | 134 | OL, LN, LL | 11 |
| Comp. Ex. 6 | Polyester Resin | 125 | 1.27 | 1.18 | 114 | 136 | — | — |
| Comp. Ex. 7 | Polyester Resin | 125 | 3.54 | 0.98 | 114 | 144 | LN, OL, LL | 53 |
| Comp. Ex. 8 | Polyester Resin | 125 | 0.64 | 1.37 | 132 | 132 | LN, OL, LL | 53 |
| Comp. Ex. 9 | Polyester Resin | 125 | 1.47 | 1.82 | 126 | 157 | LN, OL, LL | 53 |

| | Insulating Liquid | | | | |
|---|---|---|---|---|---|
| | Unsaturated Fatty Acid Glyceride | Fatty Acid Monoester | | | |
| | Content of Unsaturated Fatty Acid Glyceride in Insulating Liquid [Wt %] | Type of Unsaturated Fatty Acid | Content of Fatty Acid Monoester in Insulating Liquid [Wt %] | Iodine Value | Viscosity [mPa · s] |
| Ex. 18 | 61 | LN, OL, LL | 37 | 135 | 200 |
| Ex. 19 | 61 | OL, LN, LL | 37 | 160 | 110 |
| Ex. 20 | 61 | OL, LN | 37 | 105 | 140 |
| Ex. 21 | 24 | LN, OL, LL | 74 | 140 | 80 |
| Ex. 22 | 61 | LN, OL, LL | 37 | 135 | 130 |
| Ex. 23 | 61 | LN, OL, LL | 37 | 135 | 260 |
| Ex. 24 | 61 | OL, LN, LL | 37 | 188 | 160 |
| Ex. 25 | 61 | LN, OL, LL | 37 | 135 | 130 |
| Ex. 26 | 97 | — | — | 130 | 300 |
| Ex. 27 | 61 | LL, LN, OL | 37 | 201 | 180 |
| Ex. 28 | 61 | OL, LN, LL | 37 | 86 | 140 |

TABLE 4-continued

| | | | | | |
|---|---|---|---|---|---|
| Comp. Ex. 6 | — | — | — | — | 550 |
| Comp. Ex. 7 | 61 | LN, OL, LL | 37 | 135 | 130 |
| Comp. Ex. 8 | 61 | LN, OL, LL | 37 | 135 | 320 |
| Comp. Ex. 9 | 61 | LN, OL, LL | 37 | 135 | 280 |

[4] Evaluation

The liquid developers obtained by using the aforementioned method were evaluated.

[4.1] Micro Letter Printing Ability

By using the image forming apparatus as shown in FIGS. 2 to 7, monochromatic 2 point-size letters were formed on recording paper (Seiko Epson Corp., high quality paper LPCPPA4) with the respective liquid developers of the Examples 18 to 28 and the Comparative Examples 6 to 9 described above, and thermal fixation was performed thereon.

Thereafter, quality of the obtained toner image (2 point-size letter) was evaluated by visual observation in accordance with criteria of five grades as described below.

A: 2 point-size letter is very clearly visible.
B: 2 point-size letter is clearly visible.
C: 2 point-size letter is slightly dim but visible.
D: 2 point-size letter is dimly visible.
E: 2 point-size letter is not visible.

[4.2] Evaluation of Defects, Stripes, and Uneven Concentrations

By using the image forming apparatus as shown in FIGS. 2 to 7, monochromatic images of a predetermined pattern were formed on recording paper (Seiko Epson Corp., high quality paper LPCPPA4) with the respective liquid developers of the Examples 18 to 28 and the Comparative Examples 6 to 9 described above, and thermal fixation was performed thereon.

Thereafter, quality of the obtained toner image was evaluated by visual observation in accordance with criteria of five grades as described below.

A: Defects, stripes, uneven concentrations on the toner image are not observed.
B: Defects, stripes, uneven concentrations on the toner image are hardly observed.
C: Defects, stripes, uneven concentrations on the toner image are observed in some spots.
D: A lot of defects, stripes, uneven concentrations on the toner image are observed.
E: A lot of defects, stripes, uneven concentrations on the toner image are remarkably observed.

[4.3] Long-Term Stability of Toner Image (Stable Period)

By using the image forming apparatus as shown in FIGS. 2 to 7, monochromatic images of a predetermined pattern were formed on recording paper (Seiko Epson Corp., high quality paper LPCPPA4) with the respective liquid developers of the Examples 18 to 28 and the Comparative Examples 6 to 9 described above, and thermal fixation was performed thereon by setting the temperature of a heat fixing roller to 150° C. Just after fixation, image concentration of the toner image was measured by "X-Rite model 404" manufactured by X-Rite Inc. Thereafter, the toner image was left under the condition of air temperature 15 to 35° C., humidity 50 to 70%, and atmosphere under sunshine. After confirming non-offset domain of the toner image for every one month, the fixed image on the recording paper was rubbed two times by an eraser (a sand eraser "LION 261-11" manufactured by Lion-Jimuki corp.) with a pressure load of 1.0 kgf, and the image density thereof was measured by "X-Rite model 404" manufactured by X-Rite Inc. Comparing the measured image density with the image density just formed, a period in which a persistence rate of the toner image is 85% or more is referred to as a stable period of the toner image, and the result was evaluated in accordance with criteria of five grades as described below.

A: Stable period of the toner image is not less than 24 months (very good).
B: Stable period of the toner image is not less than 18 months and less than 24 months (good).
C: Stable period of the toner image is not less than 12 months and less than 18 months (normal).
D: Stable period of the toner image is not less than 6 months and less than 12 months (poor).
E: Stable period of the toner image is less than 6 months (very poor).

[4.4] Cleaning Ability and Recycling Ability

By using the image forming apparatus as shown in FIGS. 2 to 7, monochromatic images of a predetermined pattern were formed on recording paper (Seiko Epson Corp., high quality paper LPCPPA4) with the respective liquid developers of the Examples 18 to 28 and the Comparative Examples 6 to 9 described above, and thermal fixation was performed thereon by setting the temperature of a heat fixing roller to 150° C. The image formation mentioned above continuously proceeded for 48 hours. Thereafter, by observing the inner portion of the image forming apparatus and the toner particles adhering to the members such as the photosensitive member, the developing roller, and the intermediate transferring section, and the result was evaluated in accordance with criteria of five grades as described below.

A: No toner particles can be found in the members such as the photosensitive member, the developing roller, and the intermediate transferring section.
B: Toner particles can be hardly found in the members such as the photosensitive member, the developing roller, and the intermediate transferring section.
C: Some toner particles can be found in the members such as the photosensitive member, the developing roller, and the intermediate transferring section.
D: Toner particles can be found in the members such as the photosensitive member, the developing roller, and the intermediate transferring section.
E: A lot of toner particles can be found in the members such as the photosensitive member, the developing roller, and the intermediate transferring section.

Additionally, with respect to the liquid developer in the liquid developer reservoir, the state of the toner in the liquid developer was evaluated by visual observation in accordance with criteria of five grades as described below.

A: Floating and coagulation settling of the toner particles were not observed at all.
B: Floating and coagulation settling of the toner particles were hardly observed.

C: Some floating and coagulation settling of the toner particles were observed, but it is an allowable range to be used as a liquid developer.

D: Floating and coagulation settling of the toner particles were clearly observed.

E: Floating and coagulation settling of the toner particles were remarkably observed.

Additionally, with respect to the insulating liquid in the insulating liquid reservoir, the state of the insulating liquid was evaluated by visual observation in accordance with criteria of five grades as described below.

A: Turbidity of the insulating liquid was not observed at all.

B: Turbidity of the insulating liquid was hardly observed.

C: Some turbidity of the insulating liquid was observed, but it is an allowable range to be used.

D: Turbidity of the insulating liquid was clearly observed.

E: Turbidity of the insulating liquid was remarkably observed.

[4.5] Fixation Intensity

The fixing device was removed from the image forming apparatus as illustrated in FIG. 8, and images of a predetermined pattern were formed on recording paper (Seiko Epson Corp., high quality paper LPCPPA4) with the respective liquid developers of the Examples 18 to 28 and the Comparative Examples 6 to 9 described above. Thereafter, a heat fixation by using an oven was performed on the image formed on the recording paper. The heat fixation proceeded at 120° C. for 30 minutes.

After confirming non-offset domain of the toner image, the fixed image on the recording paper was rubbed two times by an eraser (a sand eraser "LION 261-11" manufactured by Lion-Jimuki corp.) with a pressure load of 1.0 kgf, and the image density thereof was measured by "X-Rite model 404" manufactured by X-Rite Inc.

A: Persistence rate of image density is not less than 95% (very good).

B: Persistence rate of image density is not less than 90% and less than 95% (good).

C: Persistence rate of image density is not less than 80% and less than 90% (normal).

D: Persistence rate of image density is not less than 70% and less than 80% (poor).

E: Persistence rate of image density is less than 70% (very poor).

[4.6] Transfer Efficiency

A secondary transferring roller P19 and the fixing device as shown in FIG. 9 was removed from the image forming apparatus as shown in FIG. 8, and the image formation was performed by an intermediate transferring roller P18. The remained toner on the photosensitive member P2 and the toner adhering to on the intermediate transferring roller P18 were taken by mending tapes, respectively. By measuring the image concentration of the toner image on each mending tape by using "X-Rite model 404" manufactured by X-Rite Inc., and obtaining the transfer efficiency represented by the following formula, and the result was evaluated in accordance with criteria of four grades as described below.

$$\text{Transfer Efficiency (\%)}=b/(a+b)\times 100$$

where a is defined as the image density of the toner image on the mending tape having the remained toner obtained from the photosensitive member P2, and b is defined as the image density of the toner image on the mending tape having the remained toner obtained from the intermediate transferring roller P18.

A: Transfer efficiency is not less than 90% (very good).

B: Transfer efficiency is not less than 80% and less than 90% (good).

C: Transfer efficiency is not less than 70% and less than 80% (poor).

D: Transfer efficiency is less than 70% (very poor).

[4.7] Development Efficiency

The intermediate transferring roller P18, the secondary transferring roller P19 and the fixing device as shown in FIG. 9 was removed from the image forming apparatus as shown in FIG. 8, and the development was performed on the photosensitive member P2 by using the liquid developer obtained by the Example 18 to 28 and the Comparative Example 6 to 9. The remained toner on the photosensitive member P2 and the toner adhering to on a developing roller P13 were taken by mending tapes, respectively. By measuring the image concentration of the toner image on each mending tape by using "X-Rite model 404" manufactured by X-Rite Inc., and obtaining the development efficiency represented by the following formula, and the result was evaluated in accordance with criteria of five grades as described below.

$$\text{Development Efficiency (\%)}=d/(c+d)\times 100$$

where c is defined as the image density of the toner image on the mending tape having the remained toner obtained from the developing roller P13, and d is defined as the image density of the toner image on the mending tape having the remained toner obtained from the photosensitive member P2

A: Development efficiency is not less than 95% (very good).

B: Development efficiency is not less than 90% and less than 95% (good).

C: Development efficiency is not less than 80% and less than 90% (normal).

D: Development efficiency is not less than 70% and less than 80% (poor).

E: Development efficiency is less than 70% (very poor).

[4.8] Resolution

By using the image forming apparatus as illustrated in FIG. 8, images of a predetermined pattern were formed on recording paper (Seiko Epson Corp., high quality paper LPCPPA4) with the respective liquid developers of the Example 18 to 28 and the Comparative Example 6 to 9 described above, and the resolutions of the images were investigated by visual observation.

[4.9] High Speed Printing Fitness

By using the liquid developers of the Example 18 to 28 and the Comparative Example 6 to 9 described above and the image forming apparatus as shown in FIG. 8, the fixation temperature of the image forming apparatus and nip time of the fixing roller were set to 160° C. and 0.06 sec, respectively, and the images were formed without using ultraviolet irradiation of an ultraviolet irradiator F8. Thereafter, with respect to the obtained images, image quality defects such as uneven density and blur were evaluated in accordance with criteria of four grades as described below (condition 1).

A: Image quality defects such as uneven density and blur are not observed at all.

B: Some image quality defects such as uneven density and blur are observed.

C: Image quality defects such as uneven density and blur are clearly observed.

D: Image quality defects such as uneven density and blur are remarkably observed.

Additionally, By using the liquid developers of the Example 18 to 28 and the Comparative Example 6 to 9 described above, the fixation temperature of the image forming apparatus and nip time of the fixing roller were set to 140° C. and 0.03 sec, respectively, and the images were formed with using ultraviolet irradiation of an ultraviolet irradiator F8. Thereafter, with respect to the images obtained by using the same, image quality defects were evaluated (condition 2).

These results with respect to the liquid developer of Examples and Comparative Examples are represented by Table and Table 6.

TABLE 5

| | Toner Image | | | | Recycling Ability | |
|---|---|---|---|---|---|---|
| | Micro Letter Print | Defect, Stripe Uneven Concentration | Long-Term Stability (Stable Period[Month]) | Cleaning Ability | Toner Particle | Insulating Liquid |
| Ex. 18 | A | A | A(34) | A | A | A |
| Ex. 19 | A | B | B(23) | A | A | A |
| Ex. 20 | A | B | C(17) | B | B | B |
| Ex. 21 | A | B | B(22) | A | A | B |
| Ex. 22 | B | C | A(27) | A | A | A |
| Ex. 23 | A | A | A(30) | C | B | C |
| Ex. 24 | B | B | B(20) | B | C | B |
| Ex. 25 | A | A | A(32) | A | A | A |
| Ex. 26 | B | A | A(27) | A | A | A |
| Ex. 27 | C | C | B(19) | C | C | B |
| Ex. 28 | B | A | C(11) | A | A | A |
| Comp. Ex. 6 | E | A | E(3) | A | A | A |
| Comp. Ex. 7 | E | E | B(19) | A | A | C |
| Comp. Ex. 8 | B | E | C(8) | E | E | E |
| Comp. Ex. 9 | C | E | A(26) | E | E | E |

TABLE 6

| | Fixation Intensity | Transfer Efficiency | Development Efficiency | Resolution [Vol./mm] | High Speed Printing Fitness Condition 1 | Condition 2 |
|---|---|---|---|---|---|---|
| Ex. 18 | A | A | A | 9.2 | A | A |
| Ex. 19 | B | A | B | 9.3 | A | A |
| Ex. 20 | B | B | C | 9.2 | A | A |
| Ex. 21 | B | A | B | 10 | A | B |
| Ex. 22 | B | A | A | 7.2 | A | B |
| Ex. 23 | B | B | C | 10 | A | A |
| Ex. 24 | B | B | C | 7.4 | A | B |
| Ex. 25 | B | A | A | 8.8 | A | B |
| Ex. 26 | B | B | B | 8.3 | A | A |
| Ex. 27 | B | D | D | 6.3 | A | B |
| Ex. 28 | D | C | C | 5.9 | B | D |
| Comp. Ex. 6 | E | B | B | 6.4 | B | D |
| Comp. Ex. 7 | D | D | D | 5.3 | B | C |
| Comp. Ex. 8 | D | D | D | 8.7 | B | C |
| Comp. Ex. 9 | D | D | E | 6.7 | B | C |

As represented in Table 5, the liquid developer of the invention is suitable for forming fine letters and images. Additionally, the toner image formed by the liquid developer of the invention had excellent long-term stability and small defects, stripes, and uneven concentrations. On the contrary, desired results were not obtained from the liquid developers of Comparative Examples.

In addition, the liquid developers in which SF1 and SF2 of toner particles are in the allowable range mentioned above had excellent cleaning ability and recycling ability.

Additionally, as represented in Table 6, the liquid developers of which an iodine value of the insulating liquid is in the allowable range as described above in the Examples was excellent in transfer efficiency and development efficiency of the toner image; and resolution and fixation intensity of the formed image.

When ultraviolet beams were irradiated by the ultraviolet irradiator upon fixation of the toner image, the liquid developers of which an iodine value of the insulating liquid is in the allowable range as described above in the Examples had good image quality by performing fixation at low temperature for short time.

When the liquid developers were prepared and evaluated in the same manner as described above other than using a pigment red 122, a pigment yellow 180, a carbon black (manufactured by Degussa, Printex L) instead of cyan based pigment as a colorant, the same result was obtained.

What is claimed is:

1. A liquid developer comprising:

insulating liquid; and toner particles dispersed in the insulating liquid, wherein an average particle diameter of the toner particles based on volume is in the range of 0.7 to 3 μm, and wherein a width S of particle size distribution of the toner particles represented by the following formula (I) is 1.4 or less, and the insulating liquid includes a unsaturated fatty acid glyceride:

$$S=[D(90)-D(10)]/D(50) \quad \text{(I)},$$

where D(90), D(10) and D(50) represent diameters of the toner particles for which the percentages by volume at those diameters are 90%, 10% and 50%, respectively.

2. The liquid developer according to claim 1, wherein a shape factor SF1 of the toner particles represented by the following formula (II) is in the range of 100 to 130, and a shape factor SF2 of the toner particles represented by the following formula (III) is in the range of 110 to 150:

$$SF1=\{(ML)^2/A\}\times(100\pi/4) \quad \text{(II); and}$$

$$SF2=\{(CL)^2/A\}\times(100/4\pi) \quad \text{(III),}$$

where A [$\mu m^2$] is an area of a figure generated when the toner particles are projected onto a two-dimensional plane, and ML [μm] and CL [μm] are the maximum length and the circumferential length of the figure, respectively.

3. The liquid developer according to claim 1, wherein an iodine value of the insulating liquid is in the range of 100 to 200.

4. The liquid developer according to claim 1, wherein a viscosity of the insulating liquid is in the range of 5 to 1000 mPa·s.

5. The liquid developer according to claim 1, wherein the unsaturated fatty acid glyceride includes linoleic acid as an unsaturated fatty acid component.

6. The liquid developer according to claim 5, wherein the content ratio of the linoleic acid to the total fatty acid components of the unsaturated fatty acid glyceride is 15 mol % or more.

7. The liquid developer according to claim 1, wherein the insulating liquid includes a fatty acid monoester containing an ester bond between monovalent alcohol and fatty acid.

8. The liquid developer according to claim 7, wherein the content ratio of the fatty acid monoester in the insulating liquid is in the range of 5 to 55 wt %.

9. The liquid developer according to claim 7, wherein when the content ratio of the unsaturated fatty acid glyceride in the insulating liquid is referred to as A [wt %], and the content ratio of the fatty acid monoester is referred to as B [wt %], the relationship of $0.6 \leqq A/B \leqq 8.0$ is satisfied.

10. The liquid developer according to claim 7, wherein the fatty acid monoester includes unsaturated fatty acid as a fatty acid component.

11. The liquid developer according to claim 1, wherein a resin material constituting the toner particles is a polyester resin.

12. A method of preparing a liquid developer, the method comprising:

obtaining associated particles by allowing microparticles mainly composed of a resin material to associate;

obtaining toner particles by disintegrating the associated particles using a small amount of an insulating liquid; and dispersing the toner particles in a liquid containing a unsaturated fatty acid glyceride, wherein the liquid developer thus obtained includes the insulating liquid and the toner particles dispersed in the insulating liquid, an average particle diameter of the toner particles based on volume is in the range of 0.7 to 3 μm, a width S of particle size distribution of the toner particles represented by the following formula (I) is 1.4 or less, and the insulating liquid includes the unsaturated fatty acid glyceride:

$$S=[D(90)-D(10)]/D(50) \quad \text{(I)}$$

where D(90), D(10) and D(50) represent diameters of the toner particles for which the percentages by volume at those diameters are 90%, 10% and 50%, respectively.

* * * * *